US011623126B1

(12) United States Patent
Lagree et al.

(10) Patent No.: US 11,623,126 B1
(45) **Date of Patent: *Apr. 11, 2023**

(54) SYSTEM AND METHOD FOR NETWORKING FITNESS MACHINES

(71) Applicant: Lagree Technologies, Inc., Burbank, CA (US)

(72) Inventors: Sebastien Anthony Louis Lagree, Burbank, CA (US); Samuel D. Cox, Yuba City, CA (US); Todd G. Remund, Yuba City, CA (US); Andy H. Gibbs, Tucson, AZ (US)

(73) Assignee: Lagree Technologies, Inc., Chatsworth, CA (US)

( * ) Notice: Subject to any disclaimer, the term of this patent is extended or adjusted under 35 U.S.C. 154(b) by 445 days.

This patent is subject to a terminal disclaimer.

(21) Appl. No.: 16/921,822

(22) Filed: Jul. 6, 2020

Related U.S. Application Data

(63) Continuation of application No. 15/915,578, filed on Mar. 8, 2018, now Pat. No. 10,702,760.
(Continued)

(51) Int. Cl.
*A63B 71/06* (2006.01)
*A63B 21/00* (2006.01)
(Continued)

(52) U.S. Cl.
CPC ..... *A63B 71/0619* (2013.01); *A63B 1/00* (2013.01); *A63B 21/0428* (2013.01);
(Continued)

(58) Field of Classification Search
CPC ... A63B 71/0619; A63B 1/00; A63B 21/0428; A63B 21/4017; A63B 21/4034;
(Continued)

(56) References Cited

U.S. PATENT DOCUMENTS 1,621,477 A 8/1925 Pilates
1,866,868 A 7/1932 Thomson
(Continued)

FOREIGN PATENT DOCUMENTS

EP 0354785 A2 2/1990
WO 2004/096376 A1 11/2004

OTHER PUBLICATIONS

PCT International Search Report and Written Opinion for PCT/US2015/033463; Received and Downloaded on Sep. 1, 2015.
(Continued)

*Primary Examiner* — Sundhara M Ganesan
(74) *Attorney, Agent, or Firm* — Neustel Law Offices

(57) ABSTRACT

A system and method for networking fitness machines for allowing an instructor to control various settings for a plurality of exercise machines simultaneously, and for allowing an individual user and/or trainer to modify the settings of an individual exercise machine. The system and method for networking fitness machines generally includes a trainer remote control device, one or more machine-mounted onboard trainer controllers, and a machine-mounted onboard user controller. The trainer remote control device may be securely mounted to the arm of a trainer so that the trainer's hands remain free to instruct exercisers. The trainer remote control device includes a touch screen that displays selections corresponding to various settings on the exercise machines. The trainer remote control communicates with the plurality of exercise machines via a wireless network or Bluetooth connection allowing the trainer to change the settings of a plurality of exercise machines in a class mode simultaneously.

20 Claims, 44 Drawing Sheets

Related U.S. Application Data

(60) Provisional application No. 62/519,552, filed on Jun. 14, 2017, provisional application No. 62/469,095, filed on Mar. 9, 2017.

(51) Int. Cl.

| | |
|---|---|
| ***A63B 24/00*** | (2006.01) |
| ***A63B 22/00*** | (2006.01) |
| ***A63B 23/04*** | (2006.01) |
| ***A63B 23/035*** | (2006.01) |
| ***A63B 1/00*** | (2006.01) |
| ***A63B 21/04*** | (2006.01) |

(52) U.S. Cl.

CPC ..... *A63B 21/4017* (2015.10); *A63B 21/4034* (2015.10); *A63B 21/4035* (2015.10); *A63B 22/0087* (2013.01); *A63B 23/03525* (2013.01); *A63B 23/0417* (2013.01); *A63B 24/0087* (2013.01); *A63B 2024/0081* (2013.01); *A63B 2071/065* (2013.01); *A63B 2071/0661* (2013.01); *A63B 2225/093* (2013.01); *A63B 2225/50* (2013.01)

(58) Field of Classification Search

CPC ..... A63B 21/4035; A63B 23/03525; A63B 23/0417; A63B 24/0087; A63B 2024/0081; A63B 2071/065; A63B 2071/0661; A63B 2225/093; A63B 2225/50

See application file for complete search history.

(56) References Cited

U.S. PATENT DOCUMENTS 3,770,267 A 11/1973 McCarthy
4,240,627 A 12/1980 Brentham
4,759,540 A 7/1988 Yu
4,798,378 A 1/1989 Jones
5,066,005 A 11/1991 Luecke
5,263,913 A 11/1993 Boren
D362,700 S 9/1995 Breibart
D382,319 S 8/1997 Gerschefske
5,681,249 A 10/1997 Endelman
5,820,478 A 10/1998 Wood
5,885,197 A 3/1999 Barton
5,895,340 A 4/1999 Keller
5,967,955 A 10/1999 Westfall
6,050,924 A 4/2000 Shea
6,152,856 A 11/2000 Studor
6,179,753 B1 1/2001 Barker
6,458,060 B1 10/2002 Watterson
6,749,537 B1 6/2004 Hickman
6,902,513 B1 6/2005 McClure
7,056,265 B1 6/2006 Shea
7,163,500 B2 1/2007 Endelman
7,192,387 B2 3/2007 Mendel
7,270,628 B2 9/2007 Campanaro
7,530,929 B2 5/2009 Feldman
7,628,730 B1 12/2009 Watterson
7,803,095 B1 9/2010 Lagree
7,914,420 B2 3/2011 Daly
7,931,570 B2 4/2011 Hoffman
7,935,032 B1 5/2011 Jackson
8,012,073 B2 9/2011 Barnett
8,192,332 B2 6/2012 Baker
8,764,609 B1 7/2014 Elahmadie
8,911,328 B2 12/2014 Alessandri
9,011,293 B2 4/2015 Shavit
9,125,785 B2 9/2015 Trees
2001/0056011 A1 12/2001 Endelman
2002/0022551 A1 2/2002 Watterson
2003/0119635 A1 6/2003 Arbuckle
2004/0077464 A1 4/2004 Feldman
2004/0127335 A1 7/2004 Watterson
2004/0248710 A1 12/2004 Rodgers, Jr.
2005/0164856 A1 7/2005 Parmater
2005/0233861 A1* 10/2005 Hickman ..... H04Q 9/00 482/8
2006/0046914 A1 3/2006 Endelman
2006/0172862 A1 8/2006 Badameh
2006/0199712 A1 9/2006 Barnard
2006/0211543 A1 9/2006 Feldman
2006/0293156 A1 12/2006 Trees
2008/0070765 A1 3/2008 Brown
2008/0207401 A1 8/2008 Harding
2008/0242511 A1 10/2008 Munoz
2008/0248935 A1 10/2008 Solow
2009/0023556 A1 1/2009 Daly
2009/0209393 A1 8/2009 Crater
2009/0263772 A1 10/2009 Root
2009/0270226 A1* 10/2009 Watterson ..... A63B 22/0235 482/4
2009/0270227 A1 10/2009 Ashby
2010/0227748 A1 9/2010 Campanaro
2011/0003664 A1 1/2011 Richard
2011/0010188 A1 1/2011 Yoshikawa
2011/0082016 A1 4/2011 Kim
2011/0143898 A1 6/2011 Trees
2011/0152032 A1 6/2011 Barnett
2011/0166002 A1 7/2011 Savsek
2011/0172069 A1 7/2011 Gerschefske
2012/0071301 A1 3/2012 Kaylor
2012/0088634 A1 4/2012 Heidecke
2012/0190505 A1 7/2012 Shavit
2012/0295771 A1 11/2012 Lagree
2013/0116807 A1 5/2013 Cheung
2013/0150219 A1 6/2013 Chang
2014/0011645 A1 1/2014 Johnson
2014/0038781 A1 2/2014 Foley
2014/0100089 A1 4/2014 Kermath
2014/0121076 A1 5/2014 Lagree
2014/0121078 A1 5/2014 Lagree
2014/0121079 A1 5/2014 Lagree
2014/0141948 A1 5/2014 Aronson
2014/0174174 A1 6/2014 Uehara
2015/0011362 A1 1/2015 Oh
2015/0024914 A1 1/2015 Lagree
2015/0057127 A1 2/2015 Lagree
2015/0065318 A1 3/2015 Lagree
2015/0072841 A1 3/2015 Lagree
2015/0141204 A1 5/2015 Lagree
2015/0217164 A1 8/2015 Lagree
2015/0220523 A1 8/2015 Lagree
2015/0246263 A1 9/2015 Campanaro
2015/0273272 A1 10/2015 Wang
2015/0297944 A1 10/2015 Lagree
2015/0343250 A1 12/2015 Lagree
2015/0360068 A1 12/2015 Lagree
2015/0360083 A1 12/2015 Lagree
2015/0360113 A1 12/2015 Lagree
2015/0364058 A1 12/2015 Lagree
2015/0367166 A1 12/2015 Lagree
2016/0008657 A1 1/2016 Lagree
2016/0059060 A1 3/2016 Lagree
2016/0059061 A1 3/2016 Lagree
2016/0096059 A1 4/2016 Lagree
2016/0166870 A1 6/2016 Lagree
2016/0193496 A1 7/2016 Lagree
2016/0256733 A1 9/2016 Lagree
2016/0271452 A1 9/2016 Lagree
2016/0317858 A1 11/2016 Lagree
2016/0325145 A1 11/2016 Pinkerton
2016/0346593 A1 12/2016 Lagree
2016/0361602 A1 12/2016 Lagree
2016/0375308 A1* 12/2016 Anderson ..... A63B 24/0075 482/5
2017/0014664 A1 1/2017 Lagree
2017/0014672 A1 1/2017 Lagree
2017/0036057 A1 2/2017 Lagree
2017/0036061 A1 2/2017 Lagree
2017/0043210 A9 2/2017 Lagree
2017/0065846 A1 3/2017 Lagree

(56) References Cited

U.S. PATENT DOCUMENTS

| | | | |
|---|---|---|---|
| 2017/0072252 | A1 | 3/2017 | Lagree |
| 2017/0087397 | A1 | 3/2017 | Lagree |
| 2017/0100625 | A1 | 4/2017 | Lagree |
| 2017/0100629 | A1 | 4/2017 | Lagree |
| 2017/0106232 | A1 | 4/2017 | Lagree |
| 2017/0113091 | A1 | 4/2017 | Lagree |
| 2017/0120101 | A1 | 5/2017 | Lagree |
| 2017/0144013 | A1 | 5/2017 | Lagree |
| 2017/0157452 | A1 | 6/2017 | Lagree |
| 2017/0157458 | A1 | 6/2017 | Lagree |
| 2017/0165518 | A1 | 6/2017 | Lagree |
| 2017/0165555 | A1 | 6/2017 | Lagree |
| 2017/0189740 | A1 | 7/2017 | Lagree |
| 2017/0189741 | A1 | 7/2017 | Lagree |
| 2017/0209728 | A1 | 7/2017 | Lagree |
| 2017/0239526 | A1 | 8/2017 | Lagree |
| 2017/0246491 | A1 | 8/2017 | Lagree |
| 2017/0246499 | A1 | 8/2017 | Lagree |
| 2017/0296865 | A1 | 10/2017 | Lagree |
| 2017/0304673 | A1 | 10/2017 | Lagree |
| 2017/0326406 | A1 | 11/2017 | Lagree |
| 2017/0340947 | A1 | 11/2017 | Lagree |
| 2017/0354840 | A1 | 12/2017 | Lagree |
| 2018/0015319 | A1 | 1/2018 | Lagree |
| 2018/0021621 | A1 | 1/2018 | Lagree |
| 2018/0021655 | A1 | 1/2018 | Lagree |
| 2018/0036583 | A1 | 2/2018 | Lagree |
| 2018/0056109 | A1 | 3/2018 | Lagree |
| 2018/0056133 | A1 | 3/2018 | Lagree |

OTHER PUBLICATIONS

PCT Preliminary Report on Patentability from International Searching Authority for PCT/US2015/033463; Received Dec. 15, 2016.

PCT International Search Report and Written Opinion for PCT/US2016/022888; Received and Printed Jul. 26, 2016.

PCT Preliminary Report on Patentability from International Searching Authority for PCT/US2016/022888; Received Sep. 28, 2017.

http://www.walmart.com/ip/total-gym-1400/23816097?adid=150000000000027727770; Webpage from Walmart.com for the Total Gym 1400; Received and Printed Aug. 25, 2014.

* cited by examiner

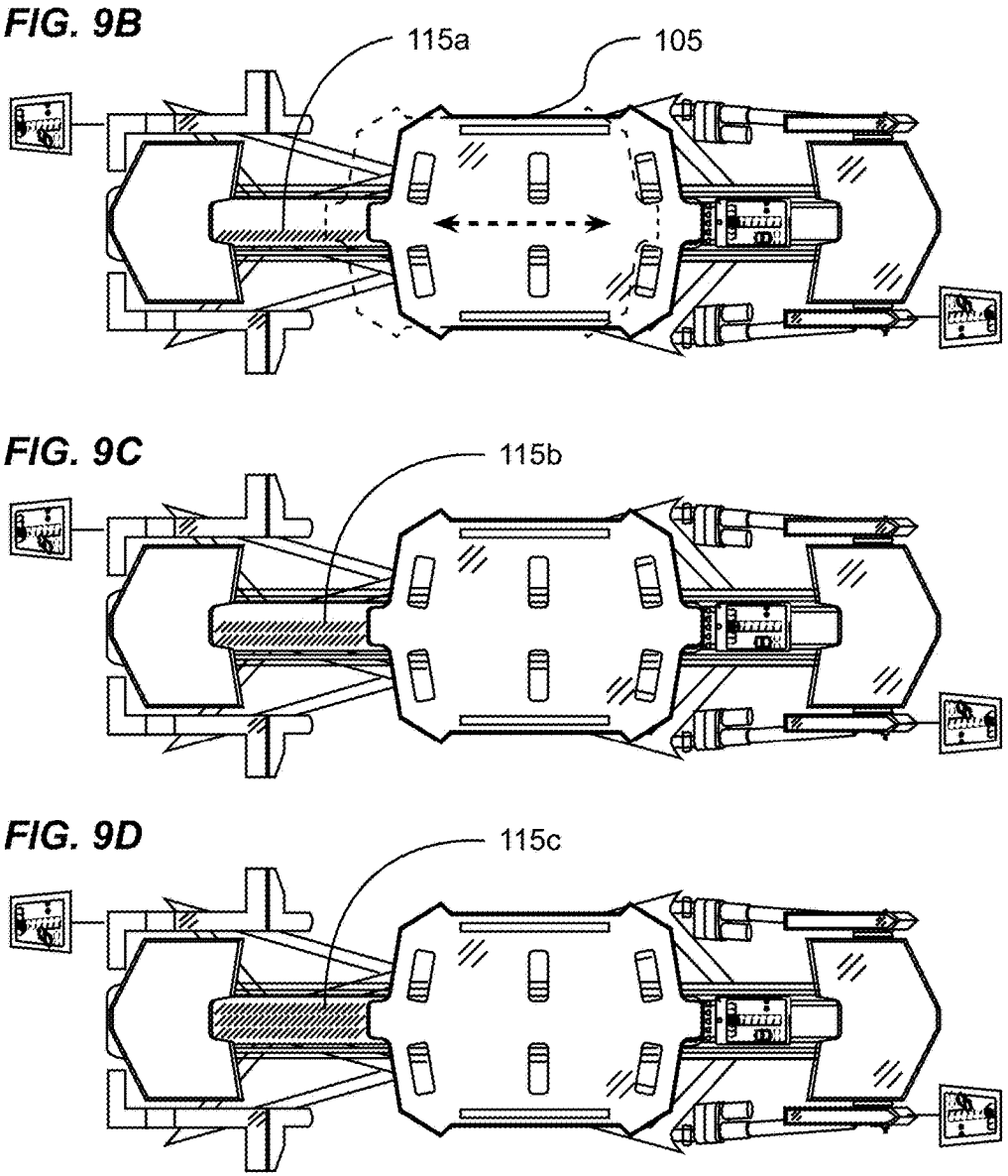
FIG. 9B
FIG. 9C
FIG. 9D
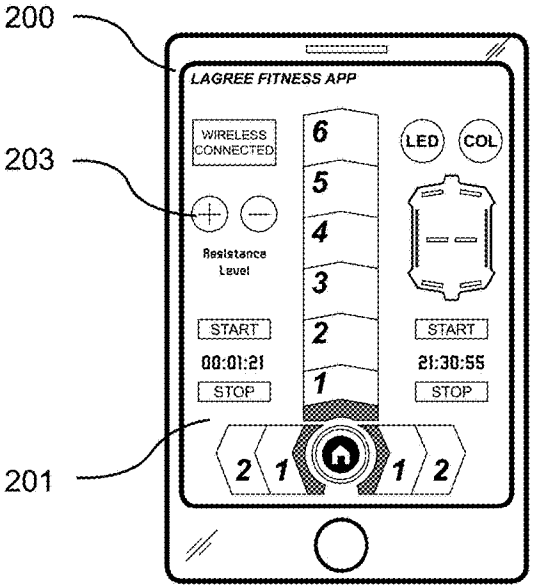
FIG. 9A

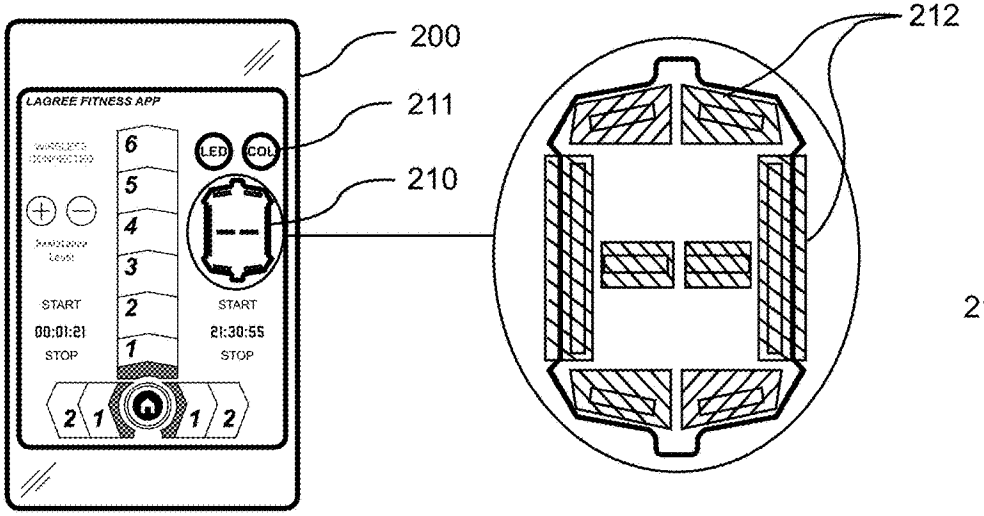
FIG. 10A
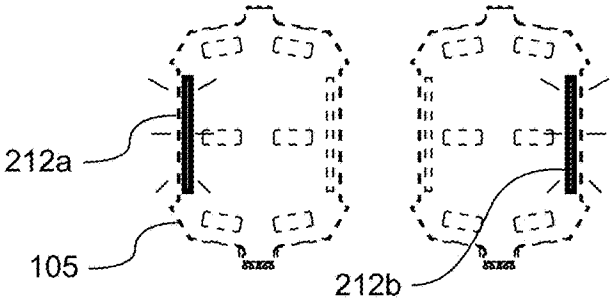
FIG. 10B
FIG. 10C
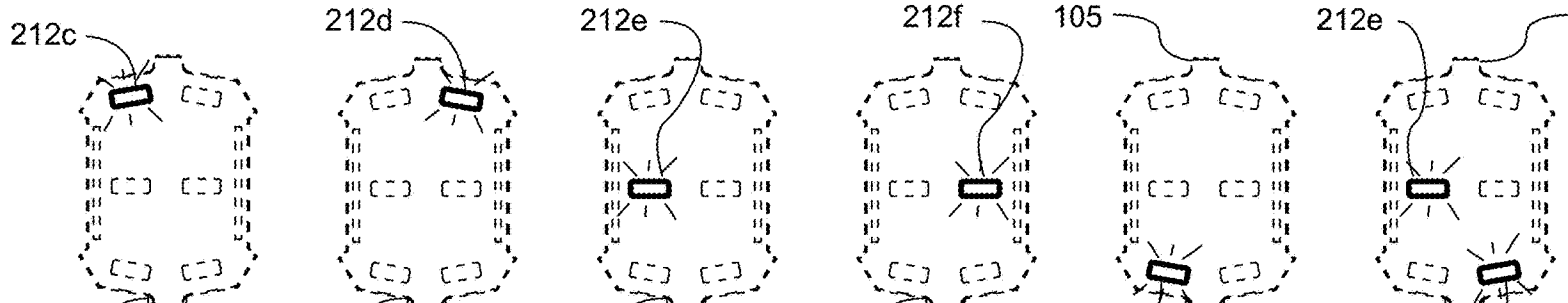
FIG. 10D FIG. 10E FIG. 10F FIG. 10G FIG. 10H FIG. 10I Section S-S

SYSTEM AND METHOD FOR NETWORKING FITNESS MACHINES

CROSS REFERENCE TO RELATED APPLICATIONS

The present application is a continuation of U.S. application Ser. No. 15/915,578 filed on Mar. 8, 2018 which issues as U.S. Pat. No. 10,702,760 on Jul. 7, 2020, which claims priority to U.S. Provisional Application No. 62/469,095 filed Mar. 9, 2017 and U.S. Provisional Application No. 62/519,552 filed on Jun. 14, 2017. Each of the aforementioned patent applications, and any applications related thereto, is herein incorporated by reference in their entirety.

STATEMENT REGARDING FEDERALLY SPONSORED RESEARCH OR DEVELOPMENT

Not applicable to this application.

BACKGROUND

Field

Example embodiments in general relate to a system and method for networking fitness machines for allowing a trainer to simultaneously control machine settings for a plurality of fitness machines in a fitness studio environment, and further allows for individual users and/or fitness trainers to modify exercise machine settings.

Related Art

Any discussion of the related art throughout the specification should in no way be considered as an admission that such related art is widely known or forms part of common general knowledge in the field.

Exercising in a class environment, for instance, participation by a plurality of exercisers at a scheduled time in a gym or fitness studio, has increased in popularity. In such environments, each class participant mounts one of a plurality of similar machines within a dedicated area of the facility, and simultaneously performs exercises at the specific direction of the class trainer. Many types of machines used in a class environment have very few machine settings that may be changed at the direction of the instructor. For instance, exercise bicycles, known to those skilled in the art as spin cycles, have one resistance adjustment. During a class, the instructor may direct participants to peddle faster or slower, but participants need only make one adjustment at the direction of the instructor, that being increasing or decreasing the resistance on the spinning wheel.

On the other hand, increasingly complex exercise apparatus are emerging that may incorporate many adjustments, such as apparatus providing for adjustment of the pitch and roll of the exercise platform, positioning adjustments of specific body parts on specified areas of the apparatus, and weight or resistance adjustments. In such instances, trainers cannot rely on class participants to quickly and accurately make the adjustments to their individual machines without considerable disruption to the class schedule.

In many exercise class environments, an instructor's job is facilitated by use of a tablet or similar remote control device which may display, for instance, the sequence of exercises to be performed throughout the scheduled class, or to remotely control the settings on one or more machines while they are being used by the exercisers.

The instructor of such classes oftentimes circulates throughout the facility during the class period, providing individual instruction or directives to certain exercisers. Instructors may reposition an exerciser's foot or hand to a different part of the machine so they may more correctly perform the exercise. When instructors provide individual assistance, they must set down the remote control device during the one-on-one instruction, then retrieve it once the personalized instruction is completed.

There is value in a system and method that provides for an instructor to simultaneously and uniformly make adjustments to all apparatuses within the class environment using an arm mounted remote control device that provides for the instructor's hands to remain free to assist class participants in making any of the myriad adjustments necessary for proper performance of an exercise.

SUMMARY

Example embodiments are directed to a system and method for networking fitness machines. The system and method for networking fitness machines includes a trainer remote control device, one or more machine-mounted onboard trainer controllers, and a machine-mounted onboard user controller.

The trainer remote control device may be securely mounted to the arm of a trainer via a device holder and strap assembly leaving the trainer's hands free to instruct exercisers on a plurality of exercise machines. The device holder may include a power source, lighting, and buttons for controlling facility and machine lighting and other settings.

The trainer remote control device preferably comprises a touch screen and software application program. The touch screen simultaneously displays a plurality of selections corresponding to various settings on the exercise machines, such as tilt and roll, elevation, resistance level, and body positioning light indicia. The trainer remote control communicates with the plurality of exercise machines directly or indirectly via a communications network or link. The machines have a plurality of actuators for changing the settings on the machines. Using the trainer remote control, a trainer can remotely activate the actuators to change the settings of a plurality of exercise machines in common.

The machine-mounted onboard trainer controllers and user controller provide the ability for the trainer or an exerciser to change the settings of an individual machine either during class in a class mode or in a private training mode. The onboard controllers may be used to override settings on an individual machine previously set by the trainer remotely for a plurality of machines functioning in a class mode.

The various example embodiments provide for a novel system and machine control method whereby a fitness instructor can simultaneously make myriad adjustments to a plurality of similar exercise apparatuses being used in a class training environment, the apparatuses being in communication with a communication network, and further provide for instructors to actuate visual indicia visible to exercisers as a means for body repositioning upon the apparatus in response to the instructor's audible instruction.

Further, the various example embodiments provide for an instructor to make further adjustments to individual apparatuses, such adjustments overriding the adjustments communicated by the instructor's remote control device to all of the apparatuses in the class.

Still further, the various example embodiments provide for exercisers to make adjustment enhancements to each adjustment instruction communicated over the network, the adjustment enhancements being limited to specific adjustments that override the adjustments communicated to all of the apparatuses in the class.

Various example embodiments further provide for a novel system and machine control method whereby a fitness instructor can affix a machine control device securely to their forearm and wrist, freeing their hands from holding any instruction tablet or remote control device throughout an exercise class.

Further, the various example embodiments provide for securely retaining a machine control device to a trainer's forearm and wrist even during high intensity activity which causes perspiration on the forearm and wrist.

There has thus been outlined, rather broadly, some of the example embodiments of the system and method for networking fitness machines in order that the detailed description thereof may be better understood, and in order that the present contribution to the art may be better appreciated. There are additional example embodiments of the system and method for networking fitness machines that will be described hereinafter and that will form the subject matter of the claims appended hereto. In this respect, before explaining at least one example embodiment of the system and method for networking fitness machines in detail, it is to be understood that the system and method for networking fitness machines is not limited in its application to the details of construction or to the arrangements of the components set forth in the following description or illustrated in the drawings. The system and method for networking fitness machines is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

FIG. 9A is an exemplary diagram showing the user interface topology of a wireless remote control device adapted to control resistance settings on a plurality of improved exercise machines in accordance with an example embodiment.

FIG. 9B is an exemplary diagram showing an improved exercise machine having a first resistance setting in accordance with an example embodiment.

FIG. 9C is an exemplary diagram showing an improved exercise machine having a second resistance setting in accordance with an example embodiment.

FIG. 9D is an exemplary diagram showing an improved exercise machine having a third resistance setting in accordance with an example embodiment.

FIG. 10A is an exemplary diagram showing the user interface topology of a wireless remote control device adapted to control indicia to be illuminated on a plurality of improved exercise machines in accordance with an example embodiment.

FIG. 10B is an exemplary diagram showing an improved exercise machine with a first body positioning indicia illuminated in accordance with an example embodiment.

FIG. 10C is an exemplary diagram showing an improved exercise machine with a second body positioning indicia illuminated in accordance with an example embodiment.

FIG. 10D is an exemplary diagram showing an improved exercise machine with a third body positioning indicia illuminated in accordance with an example embodiment.

FIG. 10E is an exemplary diagram showing an improved exercise machine with a fourth body positioning indicia illuminated in accordance with an example embodiment.

FIG. 10F is an exemplary diagram showing an improved exercise machine with a fifth body positioning indicia illuminated in accordance with an example embodiment.

FIG. 10G is an exemplary diagram showing an improved exercise machine with a sixth body positioning indicia illuminated in accordance with an example embodiment.

FIG. 10H is an exemplary diagram showing an improved exercise machine with a seventh body positioning indicia illuminated in accordance with an example embodiment.

FIG. 10I is an exemplary diagram showing an improved exercise machine with an eighth body positioning indicia illuminated in accordance with an example embodiment.

FIG. 16B is an exemplary diagram showing a side view of an improved exercise machine in an inclined position under control of a machine-mounted, user-interactive controller in accordance with an example embodiment.

FIG. 16C is an exemplary diagram showing a back end view of an improved exercise machine in a rotated position under control of a machine-mounted, user-interactive controller in accordance with an example embodiment.

FIG. 16D is an exemplary diagram showing side and views of an improved exercise machine in a default home state under control of a machine-mounted, user-interactive controller in accordance with an example embodiment.

DETAILED DESCRIPTION

Figure 1:
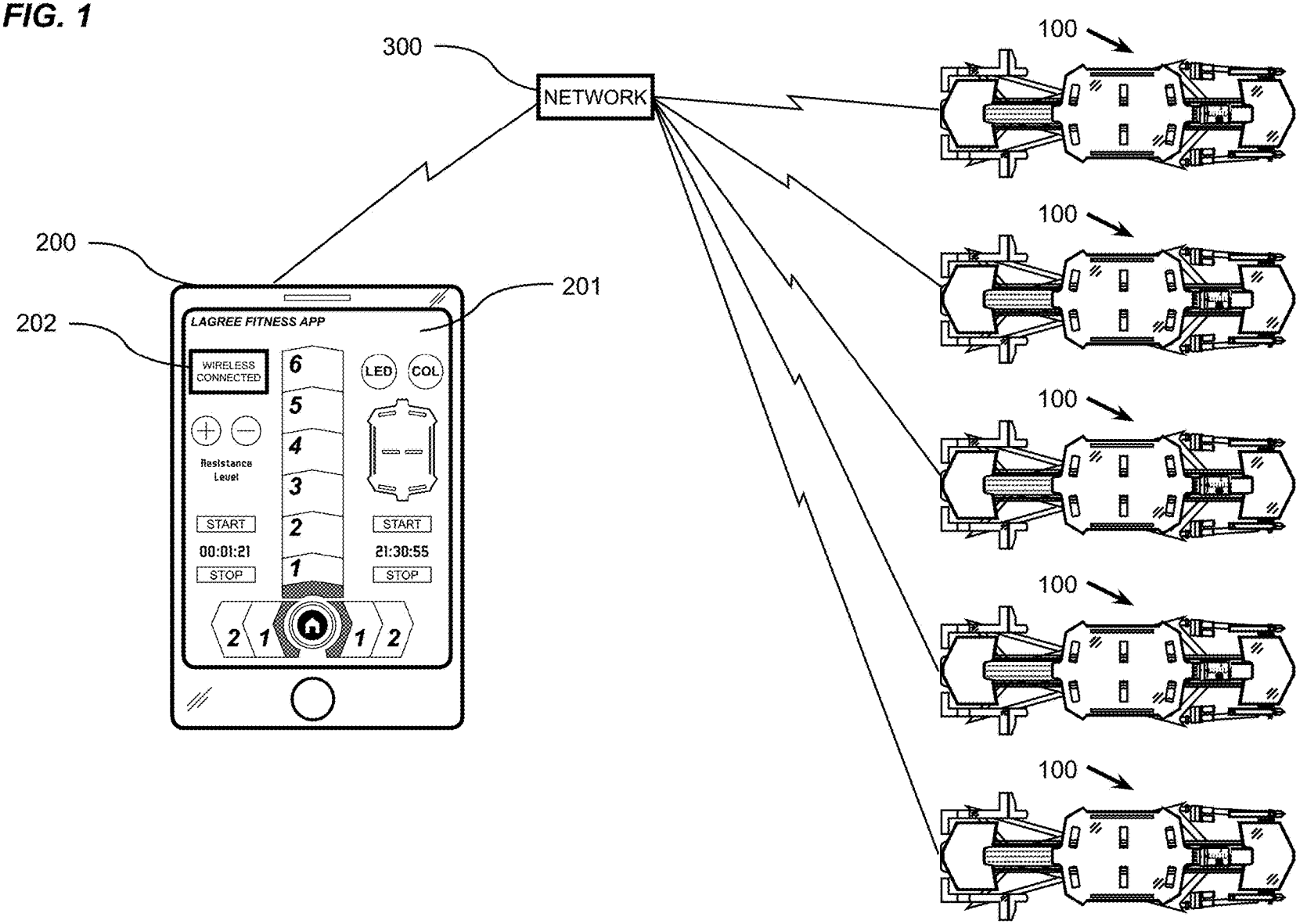
FIG. 1 is an exemplary diagram showing a remote control device in communication with a plurality of apparatuses over a communication network in accordance with an example embodiment.

The words "exerciser" and "user" are used herein to mean an individual person exercising on an improved exercise machine and may be interchangeably used without any difference in scope or meaning. The terms "trainer" and "instructor" are used interchangeably herein to refer to a person or persons training or instructing exercisers and/or users.

The phrases "communication network" and "wireless communication" as used herein are not meant to be limiting. Wireless communication modalities are well known to those skilled in the art, and may include Bluetooth, WiFi, wireless USB, infrared (IR), ultrasonic, cellular, free space optical communication, radio, microwave, and other modes of short and/or long range wireless communication that are known or that may become known. The various example embodiments provide for simplex and/or duplex wireless communication over a plurality of communication links between two or more devices, the communication links using any of one or a combination or hybrid of more than one modality.

A. Overview.

An example system and method for networking fitness machines generally includes a trainer remote control device, one or more machine-mounted onboard trainer controllers, and a machine-mounted onboard user controller. The trainer remote control device may be securely mounted to the arm of a trainer via a device holder and strap assemblies leaving the trainer's hands free to instruct exercisers on a plurality of exercise machines. The device holder may include lighting, controls for facility and machine lighting, and device charging. The trainer remote control device preferably comprises a touch screen and software application program. The touch screen displays selections corresponding to various settings on the exercise machines, such as tilt and roll, elevation, resistance level, and body positioning light indicia. The trainer remote control communicates with the plurality of exercise machines directly or indirectly via a wireless network, Bluetooth connection, or other communications network or link. Using the trainer remote control, a trainer can change the settings of a plurality of exercise machines in a class mode simultaneously via actuators on the machines.

The machine-mounted onboard trainer controllers and user controller provide the ability for the trainer or an exerciser to change the settings of an individual machine either during class in a class mode or in a private training mode. The onboard controllers may be used to override settings on an individual machine previously set by the trainer for a plurality of machines functioning in a class mode.

B. Exemplary Communications Networks.

The system and method for networking fitness machines may be utilized upon and may utilize any telecommunications network or link capable of transmitting data including voice data and other types of electronic data. Examples of suitable telecommunications networks for the system and method for networking fitness machines include but are not limited to global computer networks (e.g. Internet), wireless networks, cellular networks, satellite communications networks, cable communication networks (via a cable modem), microwave communications network, local area networks (LAN), wide area networks (WAN), campus area networks (CAN), metropolitan-area networks (MAN), home area networks (HAN). The system and method for networking fitness machines may also be utilized upon and may utilize long range as well as relatively short range wireless links such as Bluetooth. The system and method for networking fitness machines may communicate via a single telecommunications network or link or multiple telecommunications networks concurrently. Various protocols may be utilized by the electronic devices for communications such as but not limited to HTTP, SMTP, FTP, WAP (wireless Application Protocol), TCP/IP, and RFCOMM (Bluetooth protocol). The system and method for networking fitness machines may be implemented upon various wireless networks and links such as but not limited to 3G, 4G, LTE, CDPD, CDMA, GSM, PDC, PHS, TDMA, FLEX, REFLEX, IDEN, TETRA, DECT, DATATAC, MOBITEX, and Bluetooth. The system and method for networking fitness machines may also be utilized with online services and internet service providers.

The Internet also may be an exemplary telecommunications network for the system and method for networking fitness machines. The Internet is comprised of a global computer network having a plurality of computer systems around the world that are in communication with one another. Via the Internet, the computer systems are able to transmit various types of data between one another. The communications between the computer systems may be accomplished via various methods such as but not limited to wireless, Ethernet, cable, direct connection, telephone lines, and satellite.

C. Exemplary Computing Platforms.

Any type of conventional computing platform may be used for practicing the various aspects of the system and method for networking fitness machines. For example, the computing platform can comprise a personal computer (e.g. APPLE® based computer, an IBM based computer, or compatible thereof), handheld computer, wearable computer, or tablet computer (e.g. IPAD®). The computing platform may also be comprised of various other conventional electronic circuits and/or devices capable of sending and receiving electronic data. The computing platform also may be embodied in various electronic devices such as smartphones, mobile phones, telephones, personal digital assistants (PDAs), mobile electronic devices, handheld wireless devices, two-way radios, smart phones, communicators, video viewing units, television units, television receivers, cable television receivers, pagers, communication devices, and digital satellite receiver units.

The computing platform may comprise a conventional microprocessor or microcontroller and other well-known associated peripheral circuits. It also may comprise a conventional computer system which in turn may include a display screen (or monitor), a printer, a hard disk or solid state drive, a network interface, and/or a keyboard. A suitable computer system typically will comprise a microprocessor, a memory bus, random access memory (RAM), read only memory (ROM), a peripheral bus, I/O controller, communications controller, and/or a keyboard controller. The microprocessor is a general-purpose digital processor that controls the operation of the computer. The microprocessor can be a single-chip processor or implemented with multiple components. Using instructions retrieved from memory, the microprocessor controls the reception and manipulations of input data and the output and display of data on output devices. The memory bus is utilized by the microprocessor to access the RAM and the ROM. RAM is used by microprocessor as a general storage area and as scratch-pad memory, and can also be used to store input data and processed data. ROM can be used to store instructions or program code followed by microprocessor as well as other data.

The peripheral bus typically is used to access the input, output and storage devices used by the computer. Devices accessed via the peripheral bus typically include a display screen, a printer device, a hard disk or solid state drive, a network interface, and other peripherals. A keyboard controller may be used to receive input from a keyboard and to send decoded symbols for each pressed key to the microprocessor over a bus. The keyboard may be used by a user to input commands and other instructions to the computer system. Other types of user input devices can also be used in conjunction with the system and method for networking fitness machines. For example, pointing devices such as a computer mouse, a track ball, a stylus, or a tablet may be used to manipulate a pointer on a screen of the computer system.

A display screen may be used as an output device that displays images of data provided by the microprocessor via the peripheral bus or provided by other components in the computer. A printer device when operating as a printer typically provides an image on a sheet of paper or a similar surface. A hard disk or solid state drive can be utilized to store various types of data.

The microprocessor together with an operating system operates to execute computer code and produce and use data. The computer code and data may reside on RAM, ROM, or hard disk or solid state drive. The computer code and data can also reside on a removable program medium and be loaded or installed onto the computer system when needed. Removable program mediums include, for example, CD-ROM, PC-CARD, USB drives, floppy disk and magnetic tape.

A network interface circuit and/or communications controller may be utilized to send and receive data over a network or other link connected to other computer systems or devices. An interface card or similar device and appropriate software implemented by the microprocessor can be utilized to connect the computer system to an existing network and transfer data according to standard protocols.

D. Remote and Machine Mounted Control Devices and Improved Exercise Machines.

FIG. 1 is an exemplary diagram showing a control device in communication with a plurality of apparatuses on a communication network. More specifically, a plurality of substantially similar exercise machines 100 are located within a given fitness facility, the plurality of machines providing for a plurality of users to simultaneously exercise at the direction of a fitness trainer. In the drawing, the plurality of machines is in communication with a network 300. The number of machines shown that may be connected to a network is not meant to be limiting, and any number of machines reasonably co-located within a facility may be in communication with the network.

A fitness trainer conducts the class exercise regimen for the duration of a scheduled class, the trainer therefore providing direction to the users on myriad parameters related to the exercise, including but not limited to body position upon the machine, the name of the exercise, and instruction on how to properly perform the exercise.

Now then, as a means to ensure that all of the plurality of exercise machines are in communication with the network, and correspondingly the exercisers upon the machines all respond in unison to the trainer's direction, the trainer uses a remote control device 200 that when in communication with the network 300 may dynamically and simultaneously control the settings of all of the machines in common by making selections of machine settings using the interactive touch screen 201 of the remote control device. The remote control device may include an indicator 202 showing wireless connection to the network 300.

Figure 2:
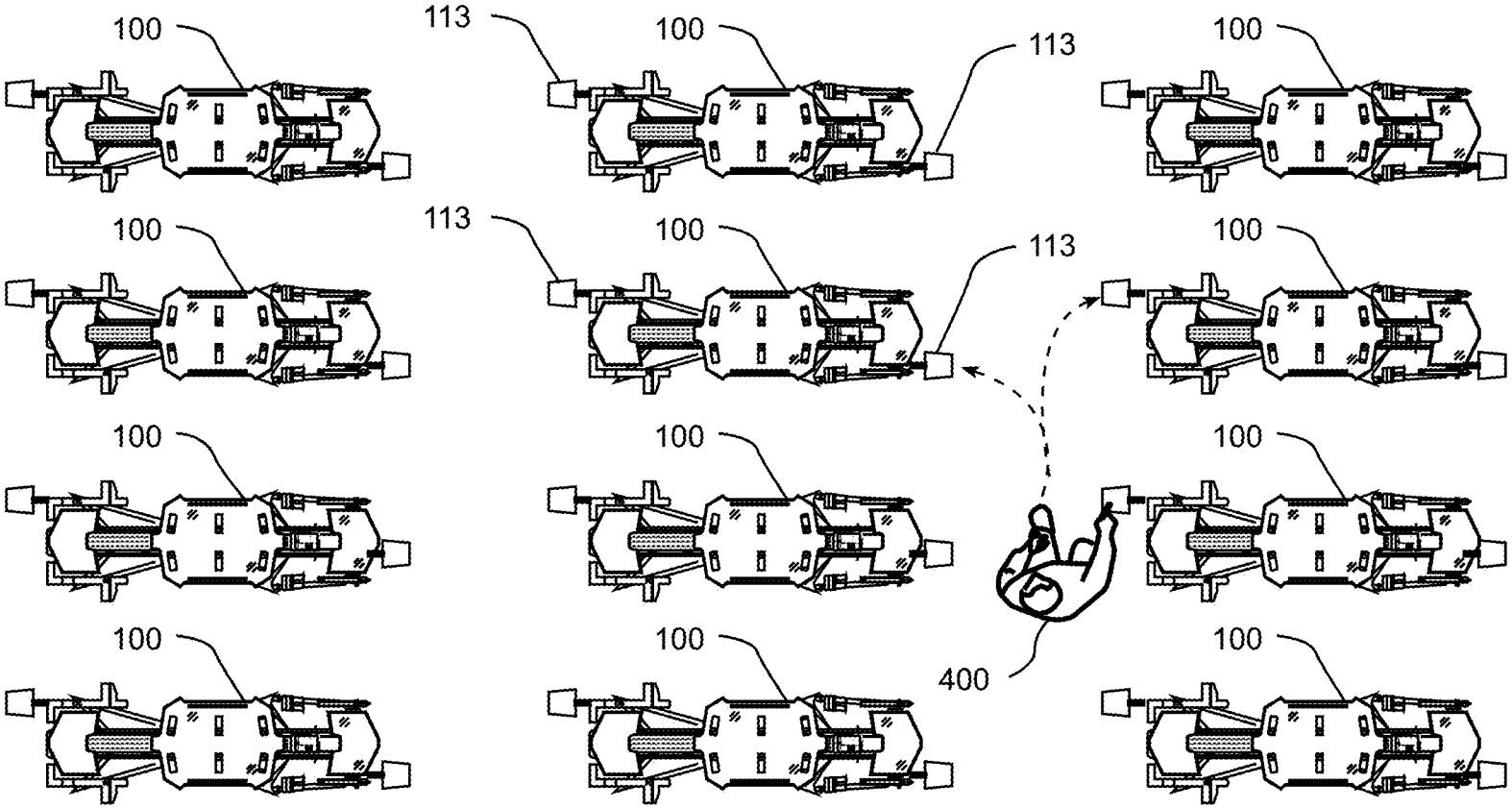
FIG. 2 is an exemplary diagram showing a top view of an instructor in one typical position walking amongst a plurality of apparatuses in a class environment in accordance with an example embodiment.

FIG. 2 is an exemplary diagram showing a top view of an instructor in one typical position walking amongst a plurality of exercise machines 100 in a class environment. Those skilled in the art will appreciate that the arrangement of like kinds of fitness machines used for fitness classes within a facility oftentimes assume a grid-like pattern whereby machines are placed in a plurality of columns and rows, the number of columns and rows being dependent on the number of machines, and the geometry of the floor space within the facility. However, any arrangement of exercise machines in which the machines may be connected to and communicate over a network is suitable and the present invention is not intended to be limited with respect to any particular arrangement of machines.

Now then, a fitness trainer 400 typically walks about the machines during the instruction of exercises as a means to inspect, and if needed instruct on individual changes to body position or machine settings. The various example embodiments described herein, which link a plurality of exercise machines to a network, and further to the trainer's remote control device, provide for all machines to tilt, rotate, or otherwise automatically change machine settings substantially in unison. In some instances, it is preferred that the trainer makes minor modifications to the settings of individual machines of certain users, for instance, to lower the machine resistance setting for new exercisers, or to increase machine tilt for more experienced exercisers.

Certain exercise machines that may be used with the present invention are relatively large, typically in excess of eight feet in length, and three feet in width. In order to make adjustments to any given machine of that size, it is preferred that an onboard trainer control device 113 is affixed to each such machine. Preferably at least one onboard control device is mounted substantially at or near one end of each such machine, but more preferably an onboard control device is mounted at or near each of two opposite distal ends of each such machine to allow easy, fast access to the individual machine controls. It is noted however, that the present invention is not intended to be limited with respect to any particular size or configuration of machines, or any particular number or placement of onboard controllers on a machine.

In the instances just described, the trainer may use the onboard control device 113 to override the global settings that the trainer remotely set for all machines through the network, the onboard control device therefore preferably comprising substantially all of the same controls available to the trainer on the remote control device 200. As can be readily seen in the drawing, a trainer walking between two rows of machines may easily make adjustments to any machine by using the front onboard control device on machines on the right side of the trainer, while using the back onboard control device on machines on the left side of the trainer. Therefore, those skilled in the art will appreciate the advantages of the machine front and back located onboard control devices provided for by the various example embodiments described herein.

Figure 3:
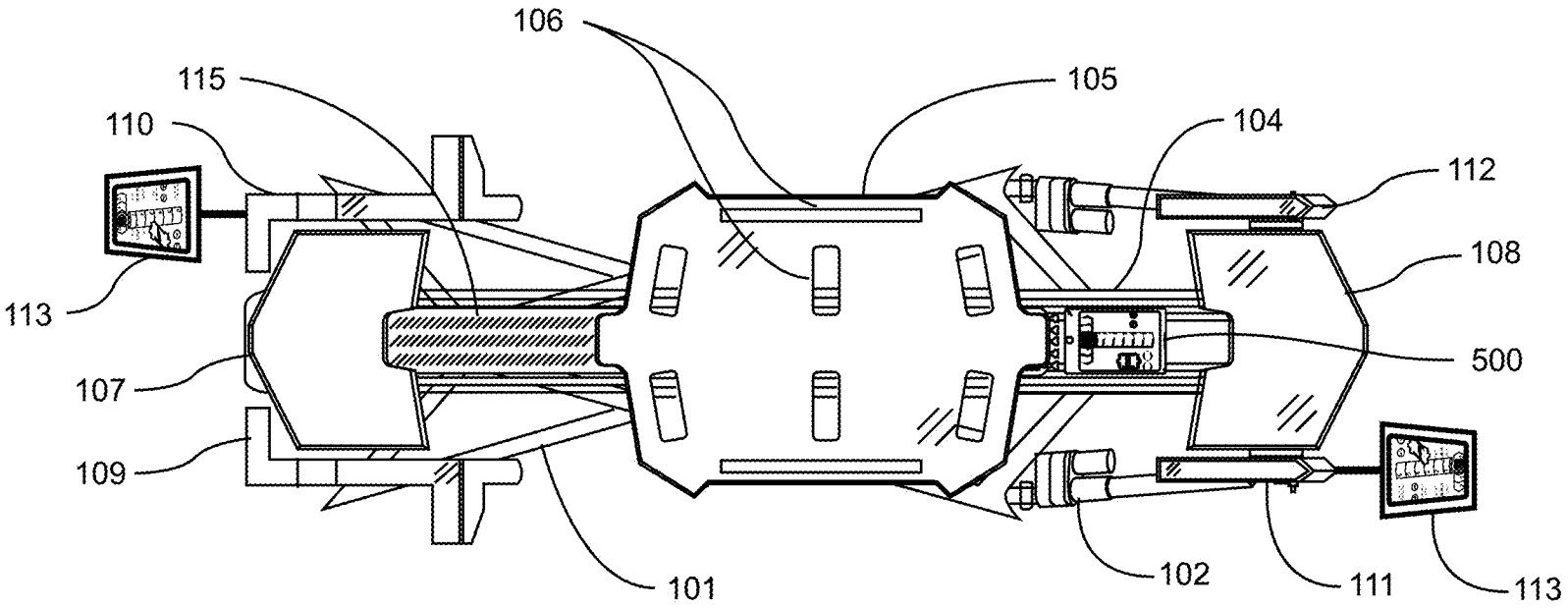
FIG. 3 is an exemplary diagram showing a top view of an improved exercise machine in accordance with an example embodiment.

FIG. 3 is an exemplary diagram showing a top view of an improved exercise machine. The exercise machine is comprised of a base support structure and a pair of linear actuators 102 extending substantially between the base support structure and an upper exercise machine structure, the upper structure providing for a longitudinal monorail member 104 extending substantially the length of the machine, and the monorail member having parallel rails affixed to each side. The rails just described, but not detailed in the drawing, provide for a rolling surface on each side of the monorail member upon which a movable exercise platform, referred to herein as a movable carriage 105, is movably attached.

A front stationary platform 107 and a back stationary platform 108 are affixed to the upper machine structure, the upper surface of the stationary platforms just described being on substantially the same plane as the upper surface of the moveable carriage 105. In use, the movable carriage rolls upon the parallel rails substantially between the front and back stationary platforms.

A front left handle assembly 109 and a front right handle assembly 110 affixed to the upper machine structure provide for gripping or pushing surfaces used by the exerciser when performing exercises on the front end of the machine. A back left handle assembly 111 and a back right handle assembly 112 affixed to the upper machine structure provide for gripping or pulling surfaces used by the exerciser when performing exercises on the back end of the machine.

One or more resistance members 115, for instance, extension springs, are affixed at one end to substantially the front end structure of the machine, and the opposed end of the extension members removably attached to the movable carriage 105. The resistance members create a resistance force upon the movable carriage against which an exerciser must overcome in the course of performing an exercise.

As a means to allow trainers to make changes to machine settings during the course of an exercise class, an onboard trainer controller 113 is preferably mounted to at least one end of the machine, but more preferably to both opposed distal ends of the machine. As a means to allow users to make further changes to their individual machine settings during the course of an exercise class, an onboard user controller 500 preferably is provided at least at one user-accessible location on the machine. The user controller preferably provides the user with at least a subset of control functions provided for by the onboard trainer controller 113.

Figure 4:
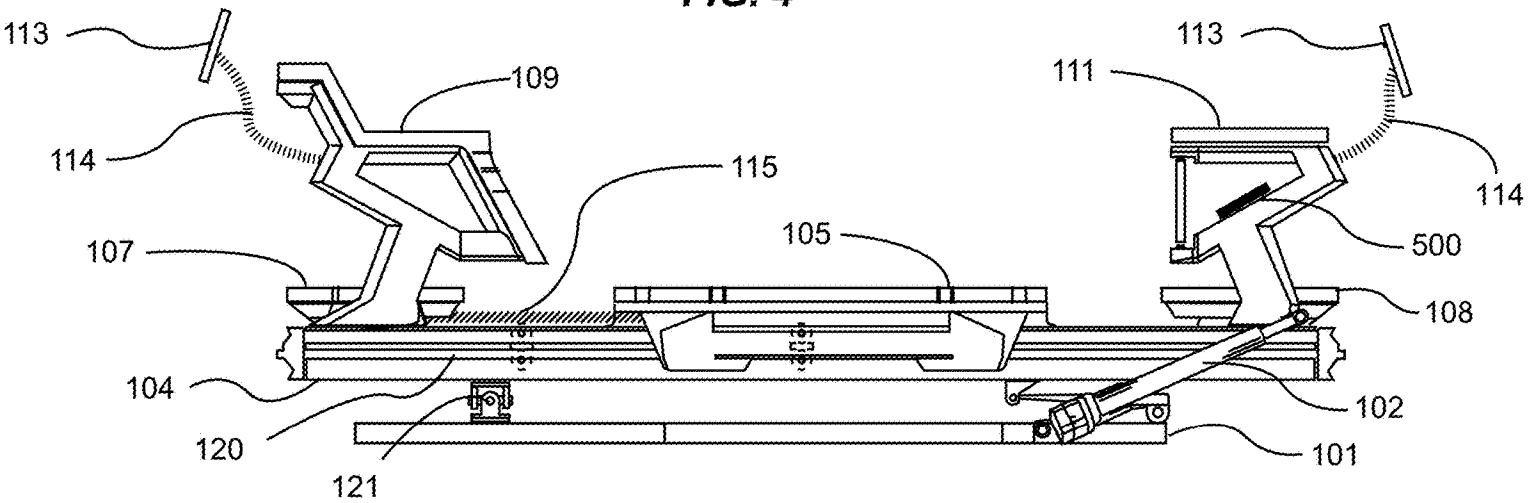
FIG. 4 is an exemplary diagram showing a side view of an improved exercise machine in accordance with an example embodiment.

FIG. 4 is an exemplary diagram showing a side view of an improved exercise machine. A base support structure 101 supports the upper exercise machine structure preferably by means of at least one pivotable universal joint 121 proximate to the front end of the machine, and a pair of actuators 102 proximate to the back end of the machine, the actuators providing for pitching and tilting the upper surface of the exercise platforms of the exercise machine relative to the horizontal plane.

A monorail member 104 extends substantially the length of the exercise machine, the monorail providing for a pair of parallel rails 120 affixed to the lateral sides of the monorail. A movable carriage 105 is movably affixed to the parallel rails by means of a plurality of wheeled trolleys (not shown), the movable carriage movable substantially the length of the monorail structure between the front stationary platform 107 and the back stationary platform 108. One or more resistance members 115 are shown with a front end affixed to the upper structure proximate to the front stationary platform, and the opposed end removably attached to the movable carriage 105, the resistance members thereby providing a resistance force upon the movable carriage which must be overcome by an exerciser in order to roll the movable carriage in a direction opposed to the front end of the machine.

Two instances of an onboard trainer controller 113 are shown, specifically a substantially forward facing trainer controller movably affixed to a front right handle assembly 109 by means of an articulating controller mounting member 114, and a substantially rearward facing trainer controller movably affixed to a back left handle assembly 111 by means of an articulating controller mounting member 114.

Preferably, an onboard user controller 500 provides for the exerciser to execute various commands that alter certain settings of the machine during exercise, for example, increase or decrease the tilt angle of the back end of the machine as a means to increase or decrease the difficulty in moving the movable carriage in a direction opposed to the resistance members.

Figure 5:
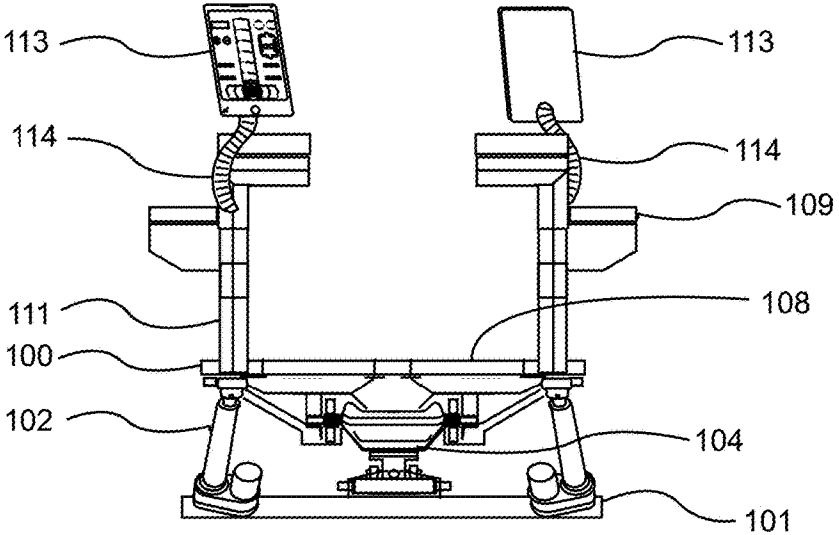
FIG. 5 is an exemplary diagram showing an end view of an improved exercise machine in accordance with an example embodiment.

FIG. 5 is an exemplary diagram showing an end view of an improved exercise machine. A base support structure 101 supports the upper exercise machine structure by various movable means and at least a pair of actuators 102 proximate to the near end of the machine.

A centrally positioned monorail member 104 extends substantially the length of the exercise machine, the monorail providing for a pair of parallel rails 120 affixed to the lateral sides of the monorail. The upper exercise surface of a back stationary platform 108 is preferably coplanar with the upper exercise surfaces of the movable carriage 105 and the front stationary platform 107, both of which are obscured by the back stationary platform.

Two instances of an onboard trainer controller 113 are shown, specifically a substantially forward facing trainer controller movably affixed to a front right handle assembly 109 by means of an articulating controller mounting member 114, and a substantially rearward facing trainer controller movably affixed to a back left handle assembly 111 by means of an articulating controller mounting member 114.

Figure 6:
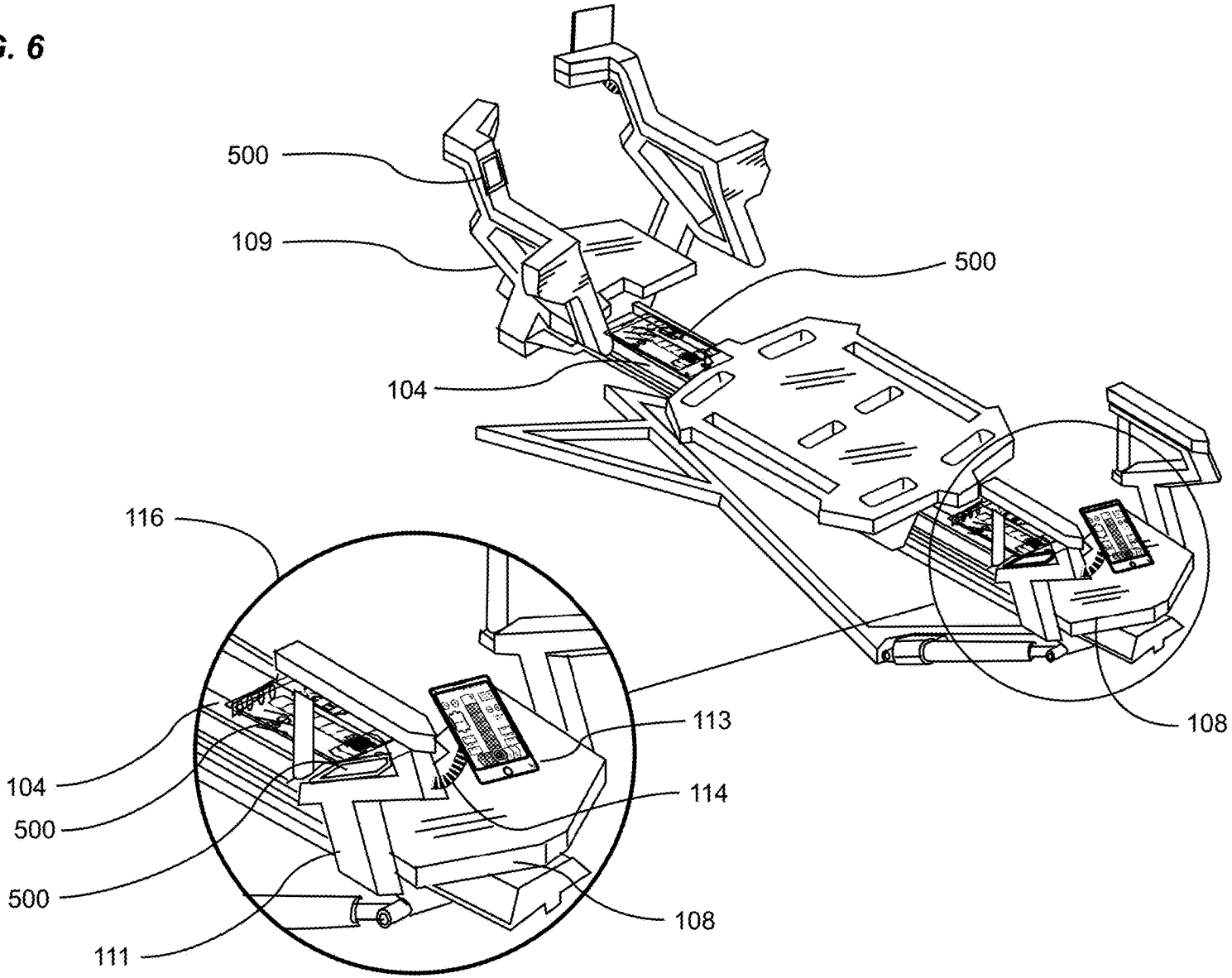
FIG. 6 is an exemplary diagram showing a perspective view of an improved exercise machine in accordance with an example embodiment.

FIG. 6 is an exemplary diagram showing a perspective view of an improved exercise machine. More specifically, an exercise machine is shown comprising an onboard user controller 500 in various positions. It is not the intention of the various embodiments of the present invention to limit the number or position of user controllers. Those skilled in the art will appreciate that the controllers are preferably positioned in locations where they are viewable, and/or readily accessible to the user during exercise.

In the drawing, one possible position of an onboard user controller 500 is upon a front left handle assembly 109, although a position on the front right handle assembly 110 may be considered as a variation. Another possible position of an onboard user controller 500 is upon the front top surface of the monorail member 104.

An enlarged perspective view 116 provides for a greater detailed view of possible mounting variations of the onboard user controller 500 proximate to the back end of the machine. The enlarged detail shows one possible position of an onboard user controller 500 upon a front left handle assembly 109, although a position on the front right handle assembly 110 may be considered as a variation.

As another variation, a user controller 500 may be positioned on the back top surface of the monorail member 104, or a user controller may be positioned on a substantially upward-facing surface of the back left handle assembly 111. Merely for reference, a separate onboard trainer controller 113 and controller mounting member 114 are shown as a means to differentiate between the onboard user and trainer controllers.

Figure 7:
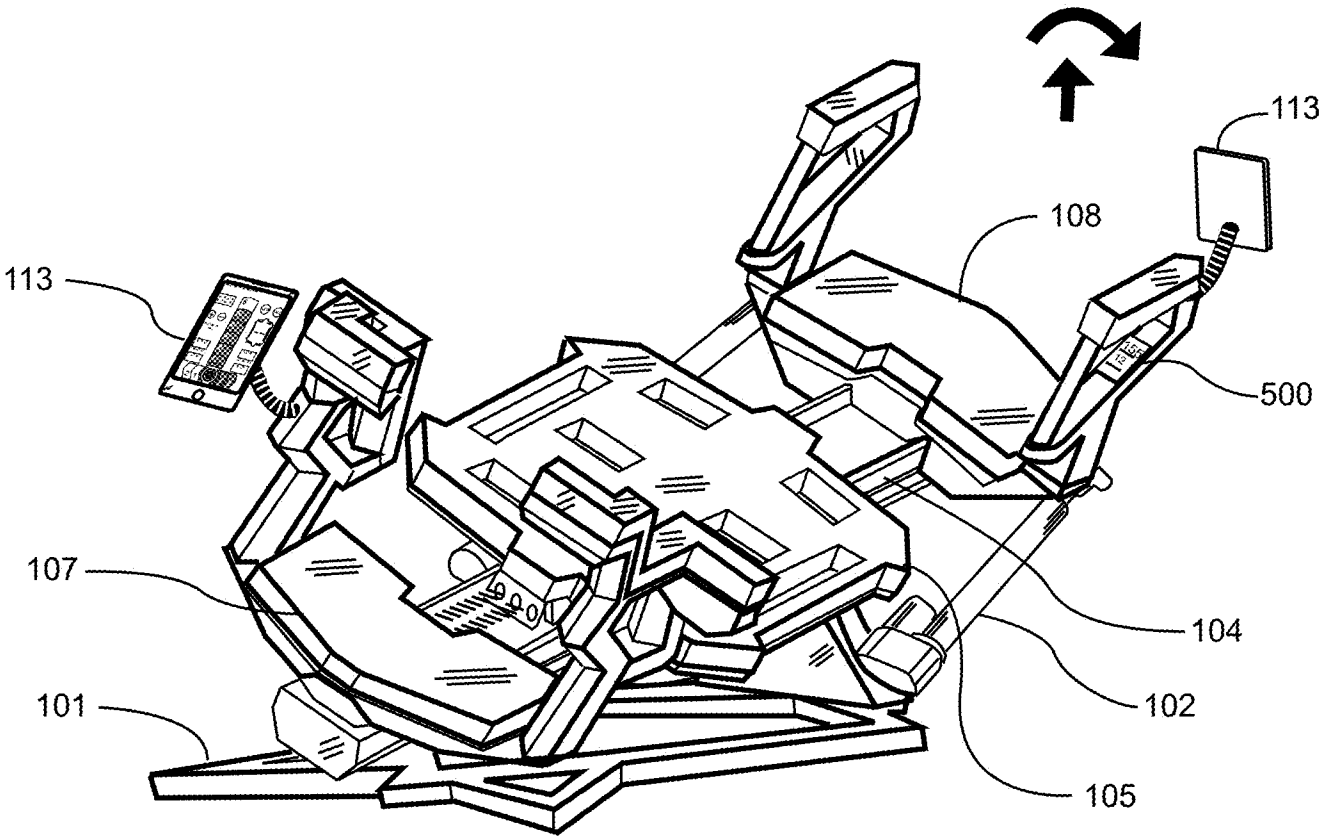
FIG. 7 is an exemplary diagram showing a perspective view of an improved exercise machine having been repositioned about two axes in accordance with an example embodiment.

FIG. 7 is an exemplary diagram showing a perspective view of an improved exercise machine having been repositioned about two axes. A base support structure 101 supports the upper exercise machine structure preferably by means of at least a pair of actuators 102 proximate to the back end of the machine, the actuators providing for pitching and tilting the upper surface of the exercise platforms of the exercise machine relative to the horizontal plane.

The upper structure of the machine comprises at least a monorail member 104 extending substantially the length of the exercise machine, the monorail parallel rails affixed to the monorail as previously described, a movable carriage 105 movably affixed to the parallel rails by means of a plurality of wheeled trolleys (not shown), a front stationary platform 107, and a back stationary platform 108. Two instances of an onboard trainer controller 113 as previously described are shown. Further, one possible position of an onboard user controller 500 on a back handle assembly adjacent to the back stationary platform 108 provides for the user to execute various commands that alter certain settings of the machine during exercise.

In the drawing, the upper structure of the exercise machine has been substantially tilted upward by means of extending the linear actuators 102 at the back end of the machine as indicated by the upward pointing arrow, and further, the top surface of the exercise platforms 107, 108, 105 have been substantially rolled towards the left side of the machine, indicated by the clockwise arrow.

Those skilled in the art will appreciate that repositioning the exercise surfaces of an exercise machine in a manner as just described is beneficial and novel, however such extreme angles may make it difficult for a trainer to make adjustments to the machine settings while the machine is in use by an exerciser. One novel solution that provides easy access to machine settings by a trainer is the mounting of one or more onboard trainer controllers 113 at opposed ends of the machine, the controllers being mounted on a flexible controller mounting member 114 that provides for repositioning of one or more of the controllers by the trainer for optimized viewing and operation.

Figure 8:
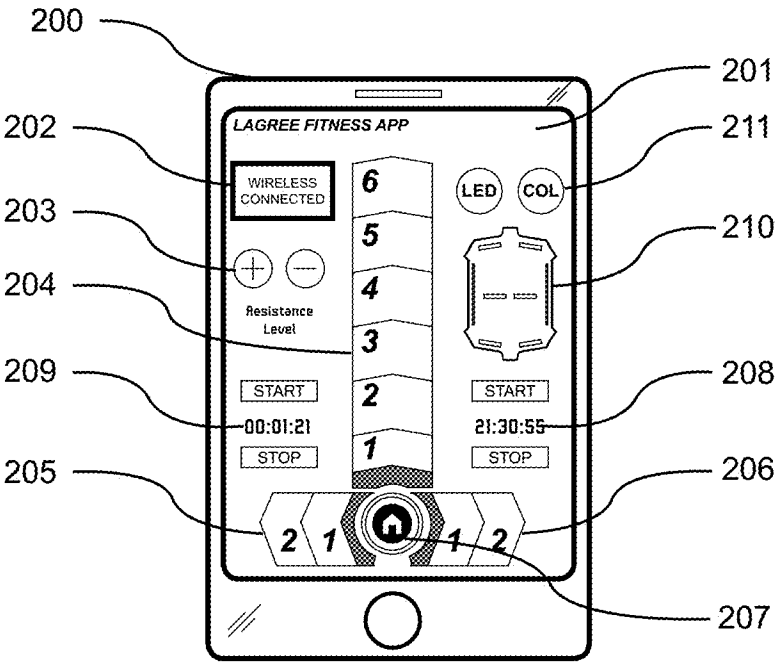
FIG. 8 is an exemplary diagram showing the user interface topology of a wireless remote control device that controls exercise machine settings in accordance with an example embodiment.

FIG. 8 is an exemplary diagram showing the user interface topology of a wireless machine control device, e.g., a trainer remote control device 200. It should be noted that the topology of the software application and touch screen of the trainer remote control device 200 may be substantially the same as the topology of the onboard trainer controller 113 as previously shown and described (see, e.g., FIG. 7) and that certain of the functions on the software application installed on the trainer remote controller may be substantially the same as the onboard trainer controller. Therefore, when certain features or functions of the trainer remote controller 200 are described, the description is not meant to be limiting, and the same or substantially similar features or functions may also apply to the onboard trainer controller 113.

The trainer remote controller 200 may be a wirelessly connected tablet computer, iPad, smartphone or similar wireless device that provides for touch screen 201 interaction by a trainer, the device having been installed with a use-specific machine controller software application. Certain functions preferably are provided on the remote trainer controller including a means to connect, or to indicate connection of the controller to a network 202, virtual buttons 203 providing for a trainer to increase or decrease the level of resistance on the exercise machines 100 by adding or reducing the number of removably attached resistance members 115, a class duration countdown timer 209, virtual buttons 211 that provide for a trainer to turn the indicia lights of a machine on or off, and to change the color of the lights, an avatar 210 of a movable carriage providing for touch activation of the lights on particular areas of the movable carriage 105 on a plurality of machines, and an exercise stopwatch timer 208.

Further, a virtual graduated positioning bar 204 provides for a trainer to precisely raise or lower the tilt of a plurality of machines in unison by touching the numeral correlating to the desired elevation, and virtual graduated positioning bars 205, 206 provide for a trainer to precisely increase or decrease the roll of the machines about their longitudinal axes, the roll being controllable clockwise or counterclockwise relative to the default horizontal plane of the exercise platforms. A home button 207 provides for ending machine control, and returns the machine substantially to the flat and level default or home starting position.

FIG. 9A is an exemplary diagram showing the user interface topology of the wireless remote trainer control device 200 adapted for controlling resistance settings of a plurality of machines 100. More specifically, a trainer may use a remote trainer controller 200 as previously described, applying pressure on the touch screen 201 over the plus or minus buttons 203, the plus button correlating to simultaneously increasing the resistance level of one or more machines in a class, the minus button correlating to simultaneously decreasing the resistance level of one or more machines in a class.

FIG. 9B is an exemplary diagram showing one machine with one resistance member 115*a* being removably attached between the front end of the machine as previously described, and the opposed end removably attached to a movable carriage 105. The single resistance member 115*a* correlates to the minimum resistance setting as may be preferred. Although the means of automating the attachment or detachment of the resistance members to the movable carriage are not shown, those skilled in the art will appreciate that many variations of automating the adjustment of total resistance applied to the movable carriage are possible. It is not the intention of the various example embodiments described herein to limit the means of automated attachment or detachment of the resistance members to the movable carriage, but to illustrate the correlation between the trainer sending a resistance increase/decrease instruction to a plurality of machines from a remote controller regardless of the means used to change the number of resistance members attached to the movable carriage.

FIG. 9C is an exemplary diagram showing a second resistance member 115*b* being removably attached between the front end of the machine as previously described, and the opposed end removably attached to a movable carriage 105. The two resistance members 115*a*, 115*b* correlate to the moderate resistance setting as may be preferred.

FIG. 9D is an exemplary diagram showing a third resistance member 115*c* being removably attached between the front end of the machine as previously described, and the opposed end removably attached to a movable carriage 105. The three resistance members 115*a*, 115*b*, 115*c* correlate to the maximum resistance setting as may be preferred. It should be noted that the present invention is not meant to be limited to three or any other specific number of resistance members, and any reasonable number of members providing a wide range of resistance levels may be used without deviating from the scope or intent of the present invention.

FIG. 10A is an exemplary diagram showing the user interface topology of a wireless remote trainer control device 200 adapted for controlling body position indicia to be actuated on the moveable carriage 105 of a plurality of machines 100. In the drawing, a remote trainer controller 200 is comprised of a touch screen and software application, the software providing for light and color selector buttons 211, and a graphical representation of a movable carriage with touch zones for carriage illumination selection 210. Because of the small size of the drawing, certain interactive touch screen elements of the various embodiments of the present invention are obscured, and are therefore provided in the enlarged view. As can be readily seen in the enlarged view, zones corresponding to each hand, foot or other body part placement feature provided on the machine's movable carriage are represented in the cross-hatched touch zones 212 of the carriage lighting selector 210.

In practice, the remote trainer controller 200 is in wireless communication with a control board installed on the improved exercise machines. In one preferred variation of operation of the touch screen zones just described, each touch of a selected touch zone 212 on the carriage lighting selector 210 generates a signal that is communicated wirelessly to all of the machines in communication with the network 300 to switch the corresponding light on their moveable carriages 105 on or off in accordance with the trainer's direction. In this preferred variation, one touch of the touch zone will turn on the corresponding light, and a second touch will turn off the corresponding light.

In a second variation of the process just described, the trainer may touch a first zone to switch on a corresponding light. A second touch on a new zone will switch on the corresponding light of the new zone, and automatically switch off the previously illuminated light. The process just described is not meant to be limiting, and other on/off sequences may be used with no difference in scope of function of the various embodiments described herein.

FIG. 10B is an exemplary diagram showing a dashed outline of a representative movable carriage 105 as previously described, with a light illuminated proximate to the left side handle indicator 212*a* as one means of alerting an exerciser as to where they should position a specified body part in accordance with the trainer's instruction. For instance, a trainer may direct the exerciser to grasp the middle of the left side handle while illuminating the left side handle indicator 212*a*.

FIG. 10C is an exemplary diagram showing a dashed outline of a representative movable carriage 105 as previously described, with a light illuminated proximate to the right side handle indicator 212*b* as one means of alerting an exerciser as to where they should position a specified body part in accordance with the trainer's instruction. For instance, a trainer may direct the exerciser to grasp the middle of the right side handle while illuminating the left side handle indicator 212*b*.

FIG. 10D is an exemplary diagram showing a dashed outline of a representative movable carriage 105 as previously described, with a light illuminated proximate to the left front opening 212*c* as one means of alerting an exerciser as to where they should position a specified body part in accordance with the trainer's instruction. For instance, a trainer may direct the exerciser to grasp the left front opening 212*c* with their left hand.

FIG. 10E is an exemplary diagram showing a dashed outline of a representative movable carriage 105 as previously described, with a light illuminated proximate to the right front opening 212*d* as one means of alerting an exerciser as to where they should position a specified body part in accordance with the trainer's instruction. For instance, a trainer may direct the exerciser to grasp the right front opening 212*d* with their right hand.

FIG. 10F is an exemplary diagram showing a dashed outline of a representative movable carriage 105 as previously described, with a light illuminated proximate to the left middle opening 212*e* as one means of alerting an exerciser as to where they should position a specified body part in accordance with the trainer's instruction. For instance, a trainer may direct the exerciser to insert a left foot into the left middle opening 212*e*.

FIG. 10G is an exemplary diagram showing a dashed outline of a representative movable carriage 105 as previously described, with a light illuminated proximate to the right middle opening 212*f* as one means of alerting an exerciser as to where they should position a specified body part in accordance with the trainer's instruction. For instance, a trainer may direct the exerciser to insert a right foot into the right middle opening 212*f*.

FIG. 10H is an exemplary diagram showing a dashed outline of a representative movable carriage 105 as previously described, with a light illuminated proximate to the left back opening 212*g* as one means of alerting an exerciser as to where they should position a specified body part in accordance with the trainer's instruction. For instance, a trainer may direct the exerciser to grasp the left back opening 212*g*.

FIG. 10I is an exemplary diagram showing a dashed outline of a representative movable carriage 105 as previously described, with a light illuminated proximate to the left middle opening 212*e* and the right back opening 212*h* as one means of alerting an exerciser as to where they should position two specified body parts in accordance with the trainer's instruction. For instance, a trainer may direct the exerciser to insert the left foot into the left middle opening 212*e* and insert the right foot into the right back opening 212*h*.

While FIGS. 10A-10I illustrate various locations on the touch zone 212 of the carriage lighting selector 210 of the remote trainer control device 200 and various corresponding locations on a moveable carriage 105 to be lighted, it is noted that the number and positions of these locations are merely exemplary and it is not intended that the scope of the present invention be limited to any specific number or placement of touch zones on a remote control or corresponding light locations on an exercise machine. Depending on the exercise machines involved and the needs of particular applications, more or fewer locations may be present and the specific locations themselves may be varied without departing from the scope or spirit of the invention.

Figure 11A:
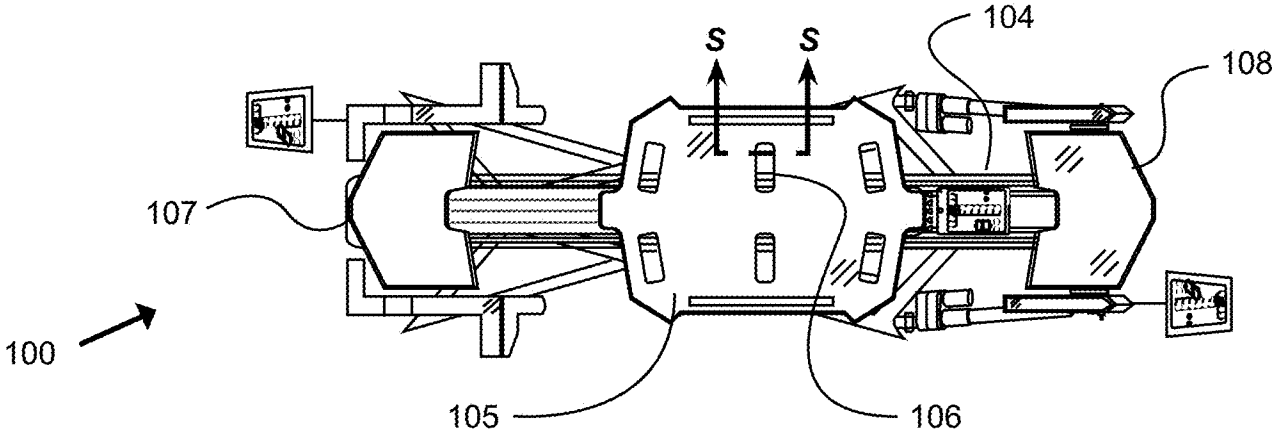
FIG. 11A is an exemplary diagram showing a top view of an improved exercise machine with a callout for one section of a movable carriage in accordance with an example embodiment.

FIG. 11A is an exemplary diagram showing a top view of an improved exercise machine 100 with a callout for one section of a movable carriage as indicated by the dashed line with "S" at the arrowheads. More specifically, as previously described, the improved exercise machine comprises at least a movable carriage 105, movable substantially the length of a monorail member 104 between a front stationary platform 107 and a back stationary platform 108. One or more gripping handles 106 may be provided upon or through the top surface of the movable carriage. In the drawing, the gripping handle 106 is also a substantially longitudinal slot extending completely through the thickness of the movable carriage, thereby allowing the gripping handle to also serve as a foot positioning hole.

Figure 11B:
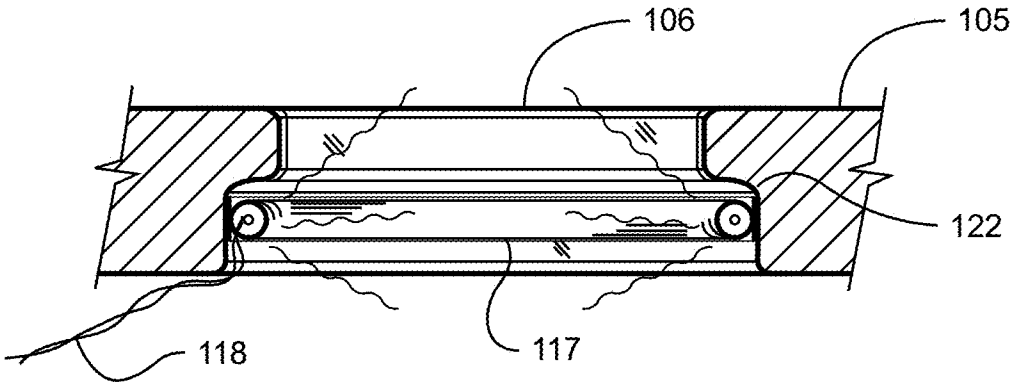
FIG. 11B is an exemplary diagram showing a sectional view of a portion of a movable carriage of the improved exercise machine of FIG. 11A detailing one means of providing illumination indicia in accordance with an example embodiment.

FIG. 11B is an exemplary diagram showing a cross-sectional view (FIG. 11A, S-S) transversely through one of the gripping handles 106 to illustrate one means of providing indicia on a movable carriage. In the drawing, a gripping handle 106 is formed into the platform of the movable carriage, thereby creating a slot extending from the top surface of the platform to the bottom surface of the carriage. A through hole undercut 122 is created so that a light emitting diode "LED" rope can be installed as a recessed light 117. The recessed illuminating device, being installed into the undercut 122 through hole, and connected to a light controller by means of electrical wires 118, remains preferably concealed from view from the top surface of the carriage. A user would therefore only see the emitted light glowing from the hand gripping surfaces, or the entirety of the interior surfaces of the through hole, rather than the actual light emitting component.

It should be noted that the use of an LED rope to illuminate the gripping surfaces or through holes is not meant to be limiting, and that any illuminating device would work without any difference in the intended scope or function. The advantage of configuring the illuminating device within the undercut is a reduction in direct light being visible and potentially distractive to the exerciser or exercisers on adjacent exercise machines.

Figure 12B:
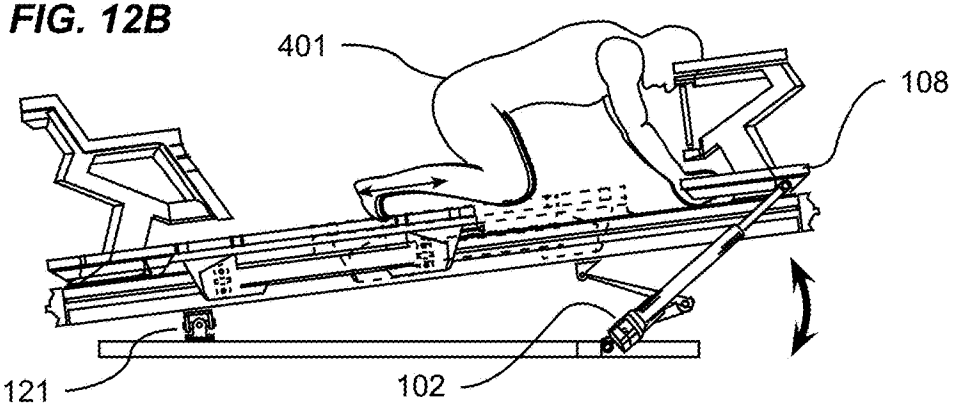
FIG. 12B is an exemplary diagram showing a side view of an exerciser on an improved exercise machine having been maximally elevated at one end in accordance with an example embodiment.
Figure 12C:
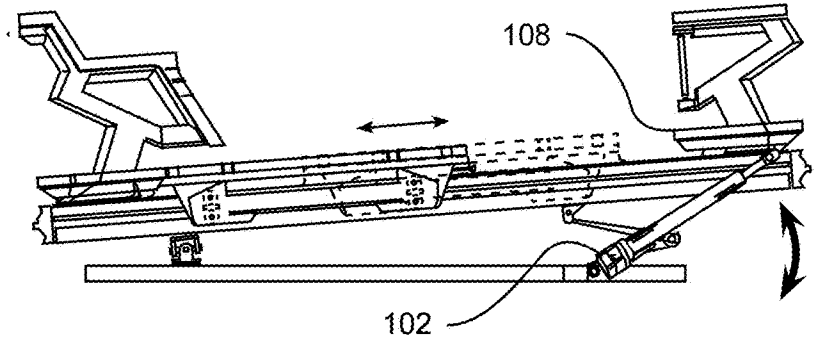
FIG. 12C is an exemplary diagram showing a side view of an improved exercise machine having been nominally elevated at one end in accordance with an example embodiment.
Figure 12D:
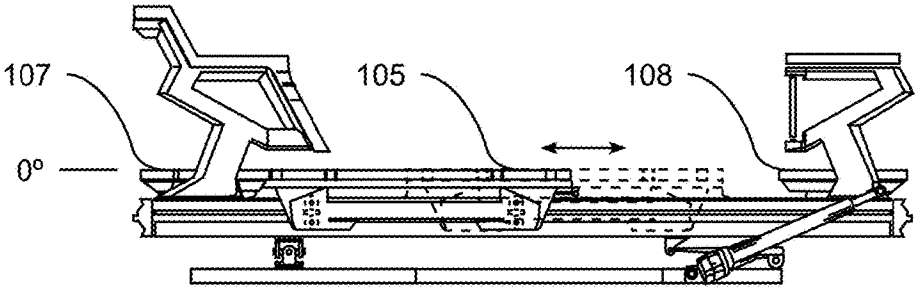
FIG. 12D is an exemplary diagram showing a side view of an improved exercise machine having been lowered to a horizontal position in accordance with an example embodiment.
Figure 12A:
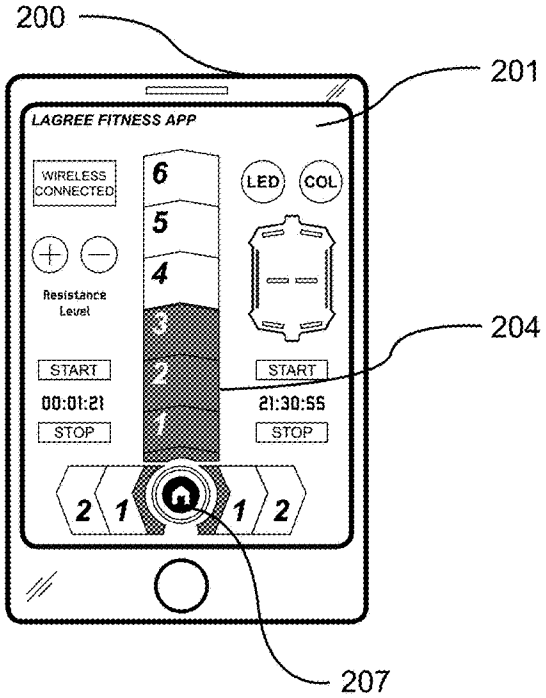
FIG. 12A is an exemplary diagram showing the user interface topology of a wireless remote control device adapted to control elevation settings of a plurality of improved exercise machines in accordance with an example embodiment.

FIG. 12A is an exemplary diagram showing the user interface topology of a wireless trainer remote control device 200 adapted for controlling the elevation settings of a plurality of improved exercise machines 100. In the drawing, the trainer remote controller 200 is comprised of a touch screen 201 and software application, the software providing for at least a machine elevation adjuster 204 and a home button 207. The virtual column of the elevation adjuster 204 is graduated with numbers 1 through 6, indicating six options for changing or setting the elevation of the back ends of the improved exercise machines. Each graduation is a discretely selectable zone on the touch screen 201 that will generate a signal that is wirelessly communicated to the plurality of machines in communication with the network 300. It should be noted that the six graduations are not meant to be limiting, and that any reasonable number of touch points can be represented on the screen and recognized by the software to correlate to any number of corresponding elevation adjustments on the improved exercise machines.

In practice, a trainer will determine the preferred elevation setting for all of the network-connected machines within the exercise studio, the elevation being preferred for a particular exercise. The trainer touches the preferred graduation zone on the tough screen of the trainer remote controller, and in response to the received communication from the network, the machines preferably will elevate substantially in unison until each has reached the preferred elevation setting. The trainer will then instruct a first exercise. At the end of first exercise, the trainer will determine the elevation setting for the second exercise, and change the elevation level of all of the machines accordingly, using the touch screen process just described.

FIG. 12B is an exemplary diagram showing a side view of an improved exercise machine having been maximally elevated at one end, and an exerciser 401 performing an exercise on an improved exercise machine. The back stationary platform 108 of the machine has been maximally elevated by means of a pair of actuators 102, the controller for the actuators having responded to the elevation signal from the trainer's remote controller as communicated to the machine controller through the network. For instance, the instant elevation may correspond to touch zone number "6" on the trainer's remote controller screen (FIG. 12A, 204). The machine will remain in the elevated position until the trainer selects a different elevation level on their remote trainer controller.

FIG. 12C is an exemplary diagram showing the side view of an improved exercise machine, the back stationary platform 108 of the machine having been moderately elevated by means of a pair of actuators 102, the controller for the actuators having responded to the elevation signal from the trainer's remote controller as communicated to the machine controller through the network. For instance, the instant elevation may correspond to touch zone number "3" on the trainer's remote controller screen (FIG. 12A, 204). The machine will remain in the elevated position until the trainer selects a different elevation level on the trainer remote controller.

FIG. 12D is an exemplary diagram showing a side view of an improved exercise machine having been lowered to a horizontal position. In practice, a trainer would select the home button (FIG. 12A, 207) on the trainer remote controller, the home button resetting all of the machine settings to the default starting position. Upon touching the home button, the machine actuators 102 retract until the top exercise surfaces of the front stationary platform 107, the movable carriage 105, and the back stationary platform 108 are coplanar with a horizontal plane.

Figure 13B:
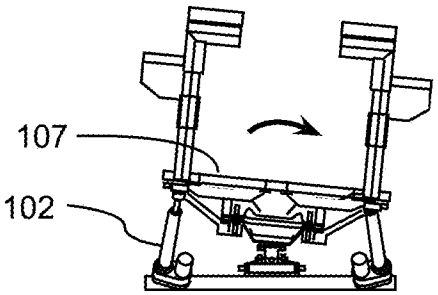
FIG. 13B is an exemplary diagram showing a front end view of an improved exercise machine having been maximally rotated in a first direction about the longitudinal axis in accordance with an example embodiment.
Figure 13C:
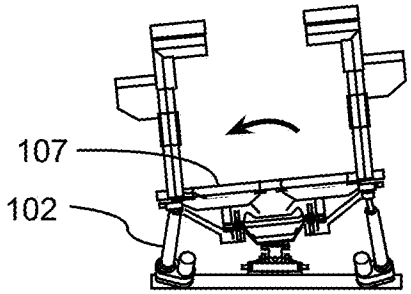
FIG. 13C is an exemplary diagram showing a front end view of an improved exercise machine having been maximally rotated in a second direction about the longitudinal axis in accordance with an example embodiment.
Figure 13D:
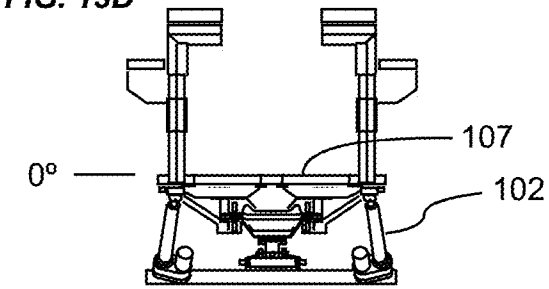
FIG. 13D is an exemplary diagram showing a front end view of an improved exercise machine with the exercise platforms having returned to a horizontal plane in accordance with an example embodiment.
Figure 13A:
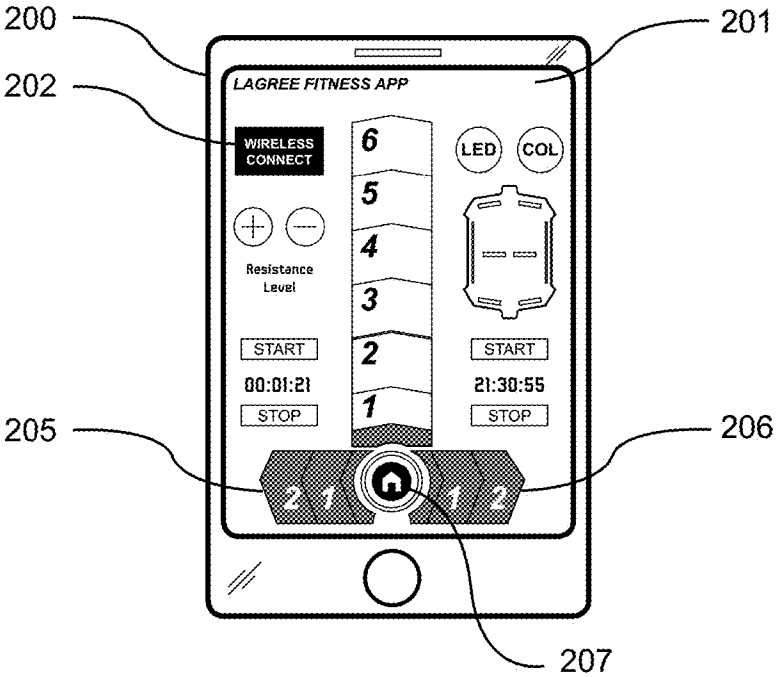
FIG. 13A is an exemplary diagram showing the user interface topology of a wireless remote control device adapted to control roll settings of a plurality of improved exercise machines in accordance with an example embodiment.

FIG. 13A is an exemplary diagram showing the user interface topology of a wireless trainer remote control device 200 adapted for controlling the roll settings of a plurality of improved exercise machines. As shown in the drawing, the controller 200 is comprised of a touch screen 201 and software application, and is in communication with a network 300 as indicated by indicator 202 on the screen. The software provides for at least a virtual machine left rotation adjuster 205, a virtual machine right rotation adjuster 206, and a virtual home button 207 on the screen. The virtual bars of the rotation adjusters 205, 206 are graduated with numbers 1 and 2, indicating two options for setting the rotation towards the left, or two options for setting the rotation towards the right, or a non-rotated position between the left and right rotations. Each graduation is a discretely selectable zone on the touch screen that will generate a signal that is wirelessly communicated to the plurality of machines in communication with the network. It should be noted that the two left and two right graduations are not meant to be limiting, and that any number of touch points can be established by the software to correlate to any number of corresponding elevation adjustments on the improved exercise machines.

In practice, a trainer will determine the preferred rotation setting for all of the network-connected machines within the exercise studio, the rotation being preferred for a particular exercise. The trainer touches the preferred graduation zone on the touch screen of the trainer remote controller, and in response to the received communication from the network, the machines preferably will rotate substantially in unison until each has reached the preferred rotation setting. The trainer will then instruct a first exercise. At the end of first exercise, the trainer will determine the rotation setting for the next exercise, and change the rotation level of all of the machines accordingly, using the touch screen process just described.

FIG. 13B is an exemplary diagram showing a front end view of an improved exercise machine having been maximally rotated in a left direction, as would be experienced by an exerciser upon the machine, about the longitudinal axis. In the drawing, an improved exercise machine has been maximally rotated towards the left about the longitudinal axis of the machine, as indicated by the left-rotated front stationary platform 107, by means of a pair of actuators 102, the controller for the actuators having responded to the rotation signal from the left rotation bar 205 of the trainer's remote controller as communicated to the machine controller through the network. The machine will remain in the rotated position until the trainer selects a different rotation position on the trainer remote controller.

FIG. 13C is an exemplary diagram showing a front end view of an improved exercise machine having been maximally rotated in a right direction, as would be experienced by an exerciser upon the machine, about the longitudinal axis. In the drawing, an improved exercise machine has been maximally rotated towards the right about the longitudinal axis of the machine, as indicated by the right-rotated front stationary platform 107, by means of a pair of actuators 102, the controller for the actuators having responded to the rotation signal from the right rotation bar 206 of the trainer's remote controller as communicated to the machine controller through the network. The machine will remain in the rotated position until the trainer selects a different rotation position on the trainer remote controller.

FIG. 13D is an exemplary diagram showing a front end view of an improved exercise machine with the exercise platforms having returned to a horizontal plane. In practice, a trainer would select the home button (FIG. 13A, 207), the home button resetting all of the machine settings to the default starting position. Upon touching the home button, the machine actuators 102 retract until the top exercise surface of the front stationary platform 107 is coplanar with a horizontal plane.

Figure 14:
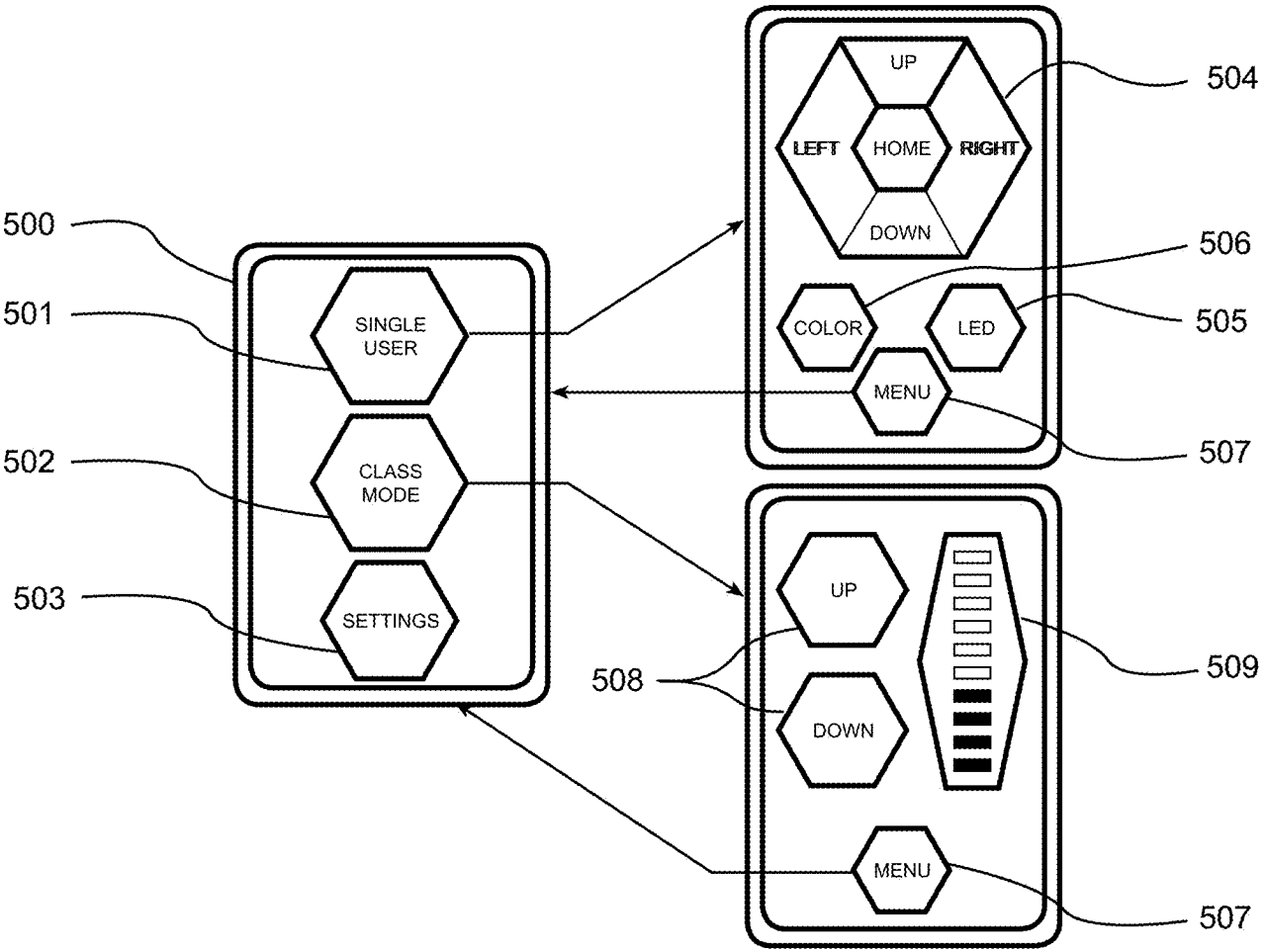
FIG. 14 is an exemplary diagram showing the topology of a machine-mounted, user-interactive control screen in accordance with an example embodiment.

FIG. 14 is an exemplary diagram showing the topology of a machine-mounted, exerciser-interactive control screen. It is often desirable that the machine user can change machine settings. In some instances, an exerciser may exercise alone, and not with a class of exercisers being instructed by a trainer. In such an instance, the user preferably has the ability to change settings in the absence of a trainer. In other instances, a user participating in an exercise class may prefer to increase or decrease a particular setting after the trainer changes the settings for all machines on a network. For instance, an experienced exerciser may prefer to increase the resistance compared to the rest of the class of exercisers, or a new user may feel that the trainer-established settings are too hard, and they prefer to lower the resistance for their workout. Those skilled in the art will appreciate the value to exercisers in providing a means to adjust the machine settings after a class trainer has established the settings for all of the machines for all of the users in a class.

In the drawing, the interactive touch screen of an onboard user controller 500 is shown with the default screen being a machine setup screen. The setup comprises the user touching on the single user button 501 if the user is not participating in an exercise class, or touching on the class mode button 502 if the user is participating in an exercise class. In the disclosed embodiment, a preferred difference between the single user and class mode settings is that the class mode setting provides fewer machine setting options as a means to reduce conflicts with the machine settings communicated from the trainer remote controller to the plurality of machines in a class. On the other hand, single users not following class instructions conducted by a trainer need not be concerned about machine instruction conflicts, and therefore have available more machine setting variations.

In practice, a user setting up a machine in single user mode touches the single user button 501 which opens a machine control screen providing for a tilt-roll selector 504 allowing a user to change the elevation of the back end of the machine by touching the "up" or "down" zones on the touch screen, or to tilt the exercise platforms about the longitudinal axis of the machine towards the left or right by touching the "left" of "right" zones on the screen. A single user may therefore elect to tilt and rotate the machine about the longitudinal and transverse axes of the machine, and adjust the roll towards the left or right, continuing to touch the up, down, left or right buttons until the desired tilt and roll are achieved. At the end of the exercise, or when no tilt or roll is preferred by the user, the user would touch the "home" zone in the center of the tilt-roll selector, thereby instructing the machine controllers to retract the actuators previously discussed to a length that results in moving the exercise platforms to a horizontal position.

Further, a user may illuminate lights on the machine by touching the LED button 505 on the touch screen, and may further change the color of the lights by touching on the color button 506 multiple times, thereby scrolling through the color options, stopping when the preferred color is illuminated. The user may continue any of the processes just described throughout their exercise period. Upon completion of the exercise, the user may return to the main setup screen by touching on the menu button 507.

When a machine is going to be used during an exercise class, the user or trainer may set up one or a plurality of machines by selecting the class mode button 502. By touching the class mode button, a subsequent screen replaces the setup screen, the subsequent screen providing for limited user options for adjusting the machine settings.

In the drawing, tilt up and down buttons of the resistance change selector 508 provide for an exerciser to increase or decrease the tilt of the machine. The effect of increasing or decreasing the tile is to correspondingly increase or decrease the resistance level for the exercise. In other words, the resistance members previously discussed, having been removably attached to the movable carriage, impart a certain resistance force against the movable carriage. As the back end of the machine is elevated relative to the front end of the machine while the resistance members are attached to the front end of the machine, the exercise force required to move the movable carriage in a direction opposed to the front end increases as the ramp angle of the machine increases. This increased force is a result of a portion of the weight of the exerciser being added to the force created by the resistance members. As a means to provide a visual reference to the current elevation setting, and the relative increase or decrease of the elevation as may preferred by the user, a resistance indicator 509 is provided with a graduation means corresponding to the elevation and elevation change. Upon completion of the exercise, the user may return to the main setup screen by touching on the menu button 507.

On the main setup screen, a settings button 503 is provided for trainer use. More specifically, the settings button provides for machine setup and/or diagnostics of the machine operation. The settings button 503 therefore opens a new screen (not shown) that provides for many variations of machine diagnostics, minimum-maximum range settings, or other machine settings as may be provided from time to time by the machine producer.

Figure 15:
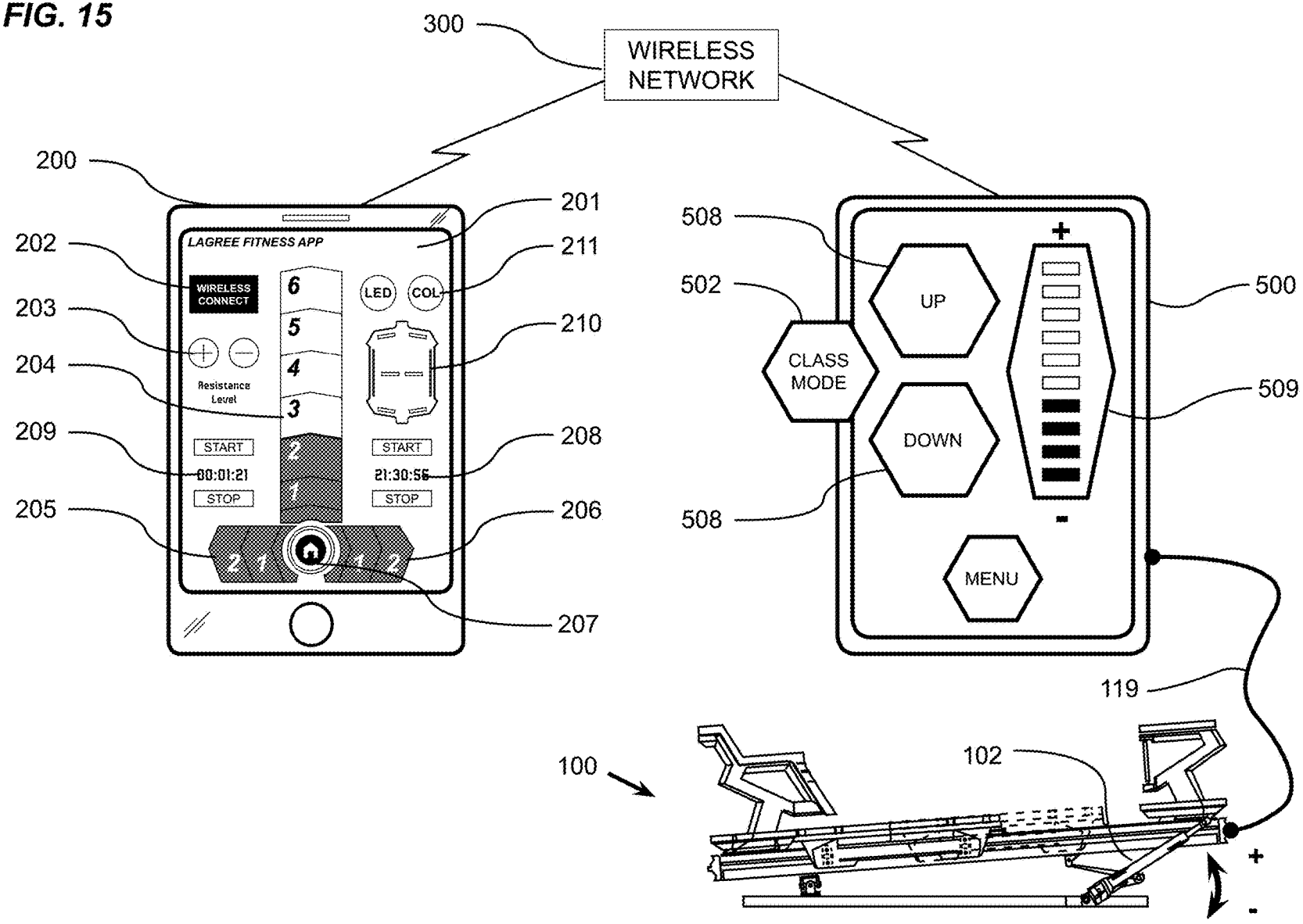
FIG. 15 is an exemplary diagram showing the relationship of control interaction between a wireless trainer remote control device and a machine-mounted, exerciser-interactive control screen in accordance with an example embodiment.

FIG. 15 is an exemplary diagram showing the relationship of control interaction between a trainer remote control device 200 and the machine-mounted, exerciser-interactive control screen 500. In the drawing, an improved exercise machine 100 is shown having been set up in class mode 502. As previously described, the user of the exercise machine may control certain machine settings during the exercise class, for example, increasing or decreasing the elevation of the back end of the machine by touching the up or down buttons of the resistance change selector 508, the relative and changed elevation therefore represented in the resistance indicator 509 of the onboard user controller 500. The onboard user controller is preferably in hard wire communication with the machine controller via a wiring harness 119, the machine controller correspondingly communicating tilt and rotation instructions to a pair of actuators 102.

As can be seen, the onboard user controller 500 of the instant machine 100, and other machines that may be used in the class, not shown but as previously discussed, are together in communication with a network 300. Further, a trainer remote controller 200 is indicated as being in communication with the network by indicator 202, the remote trainer controller thereby communicating to each and all machines on the network machine settings as desired by the trainer.

As was previously discussed, the trainer may change the elevation of the machine using the elevation adjuster 204, the left rotation using the left roll adjuster 205, the right rotation using the right roll adjuster 206, the number of resistance members exerting tension upon the movable carriage using the resistance adjuster 203, and may change illumination, color, and designate the zones of the movable carriage to be illuminated by using the carriage light selector 210 and light and color selectors 211.

The trainer may also monitor the time spent on each exercise by starting and viewing the exercise timer 208, and monitor the remaining class time by setting and viewing the class session timer 209. At the end of the exercise session, the trainer touches the home button 207, thereby disabling the onboard user controller 500, and further returning the machine to the default position wherein the top surfaces of the stationary and movable exercise platforms are set back to the lowest elevation and coplanar with the horizontal plane.

It should be noted that various other functions not discussed may be incorporated into the trainer remote controller without limitation. For instance, the home button 207 may incorporate multiple functions such as one-touch results in the machines' rotation returning to the horizontal position without adjusting the elevation of the back end of the machines, two rapid touches may return the elevated back ends of the machines to the horizontal without adjusting the rotational tilt, and a sustained touch may result in the tilt and rotation of the machines returning to the default horizontal positions.

Figure 16A:
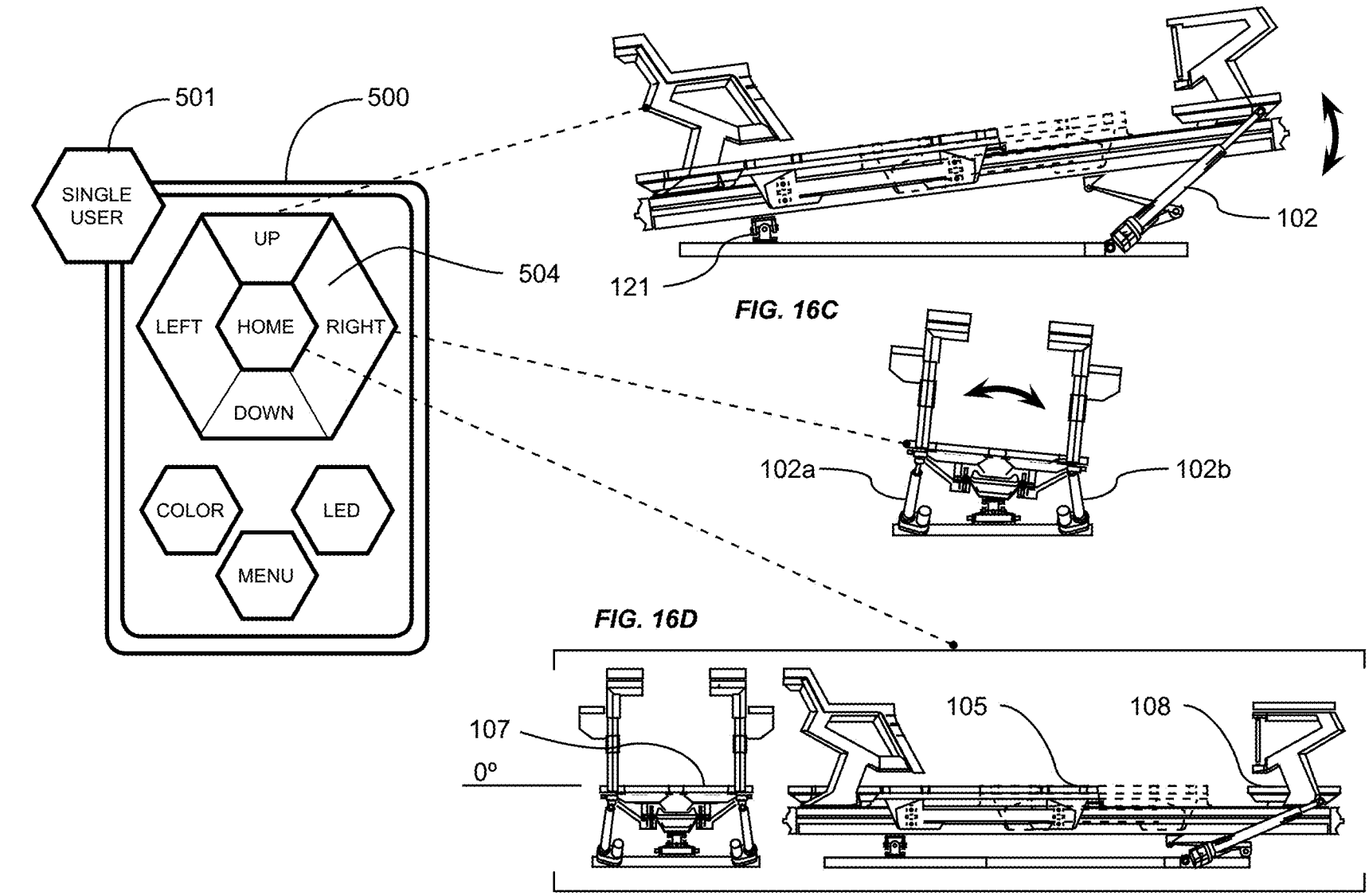
FIG. 16A is an exemplary diagram showing one representation of a machine-mounted, user-interactive controller adapted to control an improved exercise machine in accordance with an example embodiment.

FIG. 16A is an exemplary diagram showing one representation of an on-board, exerciser-interactive controller 500. The screen of the onboard user controller is shown having been opened by an exerciser after selecting the single user 501 mode. In this state, the user may change the planar orientation of the top surface of the stationary platforms 107, 108 and movable carriage 105 before, during or after exercising.

FIG. 16B is an exemplary diagram showing a side view of an improved exercise machine in a controller-directed incline. While the onboard user controller is set in the single user mode 501, the user may touch the up or down touch zones of the tilt-roll selector 504, thus signaling the machine controller to power preferably two actuators 102. By touching the "up" zone of the tilt-roll indicator, the actuators are caused to extend, thereby lifting the back end of the machine to elevate the exercise plane. On the other hand, by touching the "down" zone of the tilt-roll indicator, the actuators are caused to retract, thereby lowering the back end of the machine to elevate the exercise plane. The positioning of the back end of the machine preferably follows an arcuate path about a pivotable universal joint 121 that serves as one machine pivot point.

FIG. 16C is an exemplary diagram showing a back end view of an improved exercise machine in a controller-directed rotation. White the onboard user controller 500 is set in the single user mode 501, the user may touch the left or right touch zones of the tilt-roll selector 504, thus signaling the machine controller to power preferably two actuators 102 in opposing directions as a means to achieve a machine rotation about the longitudinal axis. By touching the "left" zone of the tilt-roll indicator, the left actuator 102*a* is caused to retract while the right actuator 102*b* is caused to remain static or extend, resulting in a counterclockwise rotation of the exercise machine relative to the horizontal floor surface. On the other hand, by touching the "right" zone of the tilt-roll indicator, the left actuator 102*a* is caused to remain static or extend while the right actuator 102*b* is caused to retract, resulting in a clockwise rotation of the exercise machine relative to the horizontal floor surface. It should be noted that the user may tilt and rotate the machine by touching the desired zones just described, the tilt and rotation actuation being either a sequential process, or achieved simultaneously by touching multiple zones on the tilt-roll selector 504.

FIG. 16D is an exemplary diagram showing a side view of an improved exercise machine in a default home state. At any time, the user may return the exercise machine to its lowest level wherein all exercise platforms are coplanar with the substantially horizontal floor surface by touching the home zone of the tilt-roll selector 504. As can be seen, in the default home position, the front stationary platform 107, the back stationary platform 108, and the movable carriage 105 are all aligned substantially with the horizontal plane.

Figure 17:
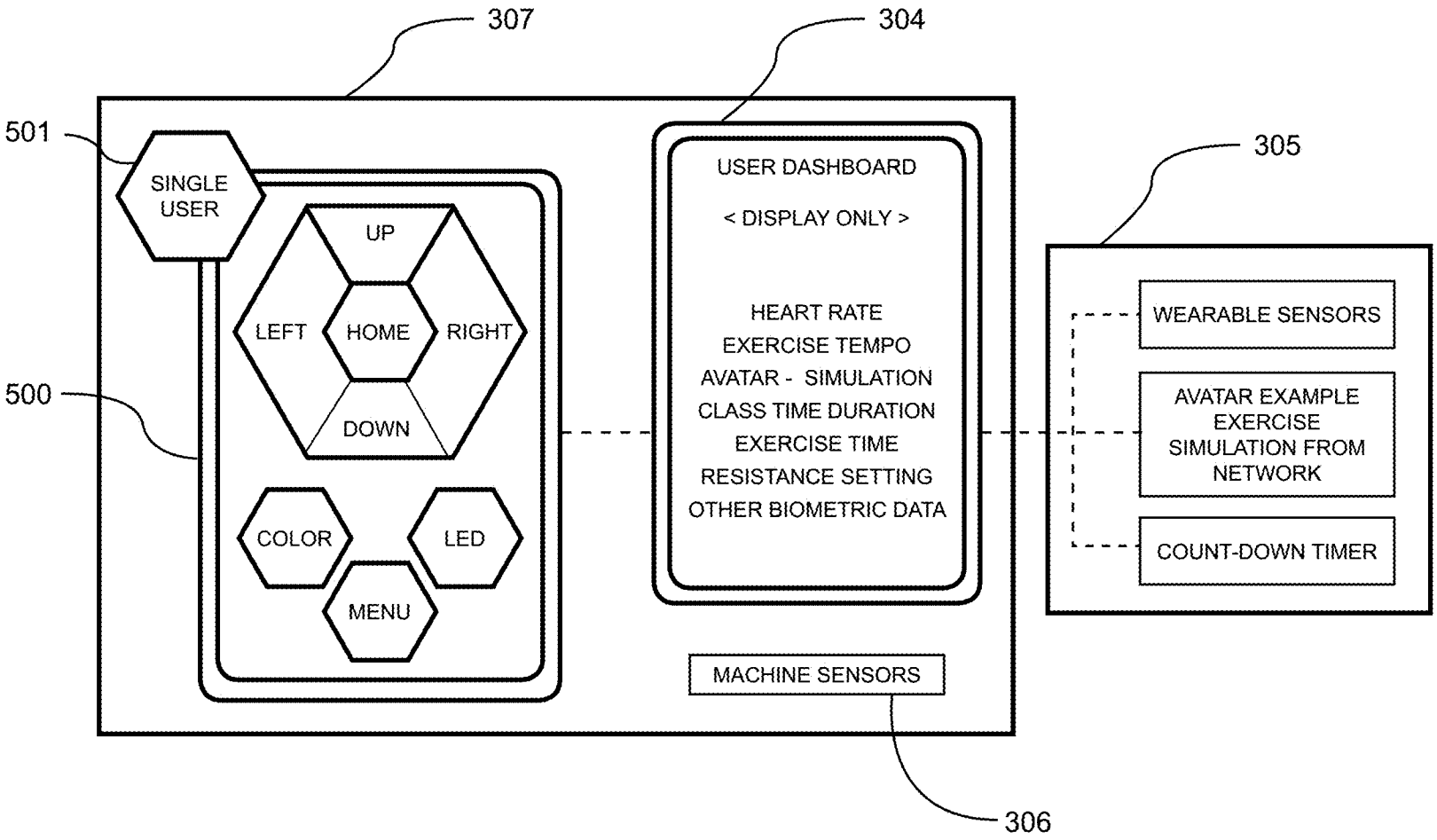
FIG. 17 is an exemplary diagram showing a block diagram of a machine-mounted, exerciser-interactive control screen in accordance with an example embodiment.

FIG. 17 is an exemplary diagram showing a block diagram of a machine-mounted, exerciser-interactive control screen. The machine control functions of the onboard user controller 500 while in the single user mode 501 have been substantially described in the foregoing. Notwithstanding the ability for a user to control certain movements of the machine using the onboard user controller, an expanded user interface to a plurality of connected onboard devices 307 may be optionally provided, the additional devices displaying useful information for the user.

For example, a display only dashboard 304 may be provided as a device affixed to the novel exercise machine, preferably positioned for optimum viewing by the user, the dashboard displaying various data including but not limited to the user's instant heart rate, the tempo of the exercises or cyclical frequency of each repetition of the exercise, or other data elements available from onboard machine sensors 306, and/or from external sources. Displayable data 305 from sources external to the improved exercise machine may include, but are not limited to user wearable sensors, such as accelerometers or body positioning sensors, video or other graphic data delivered to the dashboard via communication from the network, or other data stored in or generated by sources external to the improved exercise machine. Those skilled in the art will immediately appreciate the benefit that additional performance, machine positioning or instructional data has to a user who is focused on maximizing the strength, cardiovascular or performance benefits obtained by exercising on the improved exercise machine.

Figure 18:
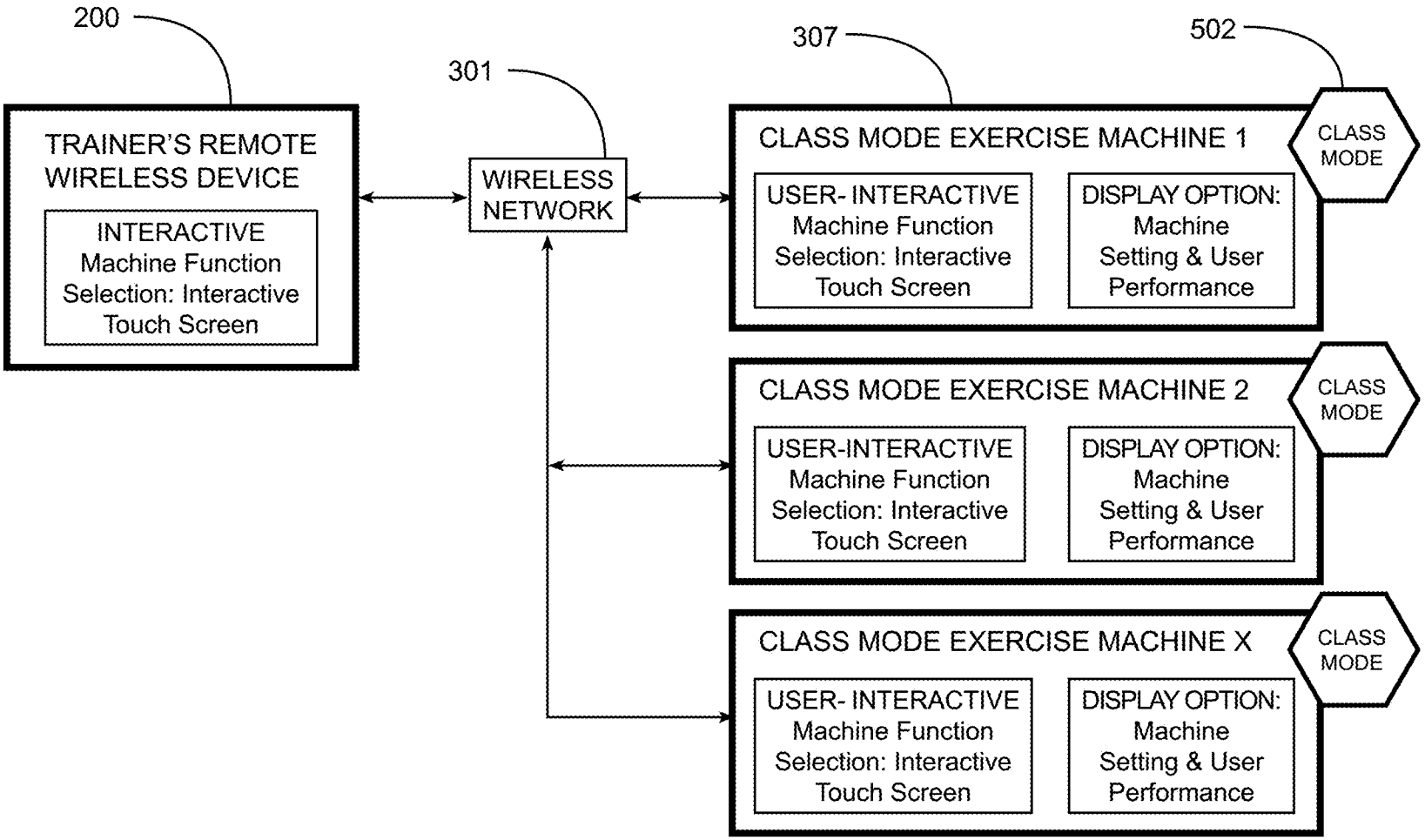
FIG. 18 is an exemplary diagram showing a block diagram of various startup modes of a machine-mounted, exerciser-interactive control screen in accordance with an example embodiment.

FIG. 18 is an exemplary diagram showing a block diagram of various modes of a machine-mounted, exerciser-interactive control screen. In the drawing, a plurality of onboard devices 307 on like machines in a facility have all started up in the class mode 502, thereby activating the user interactive functions of the onboard user controller 500, and optionally, the display dashboard 304 as just described, the latter allowing each user to view personal performance data. In class mode, all of the like exercise machines are in communication with a central wireless network 301, and will remain responsive to communication received from the trainer remote controller 200 via the network. To begin a class, a trainer activates a trainer remote controller 200, and using the control functions previously described, initiates an audible instruction for an exercise while changing, in unison, the resistance levels, tilt, rotation, indicia lighting, or other available machine settings of all of the plurality of machines in communication with the network.

Figure 19:
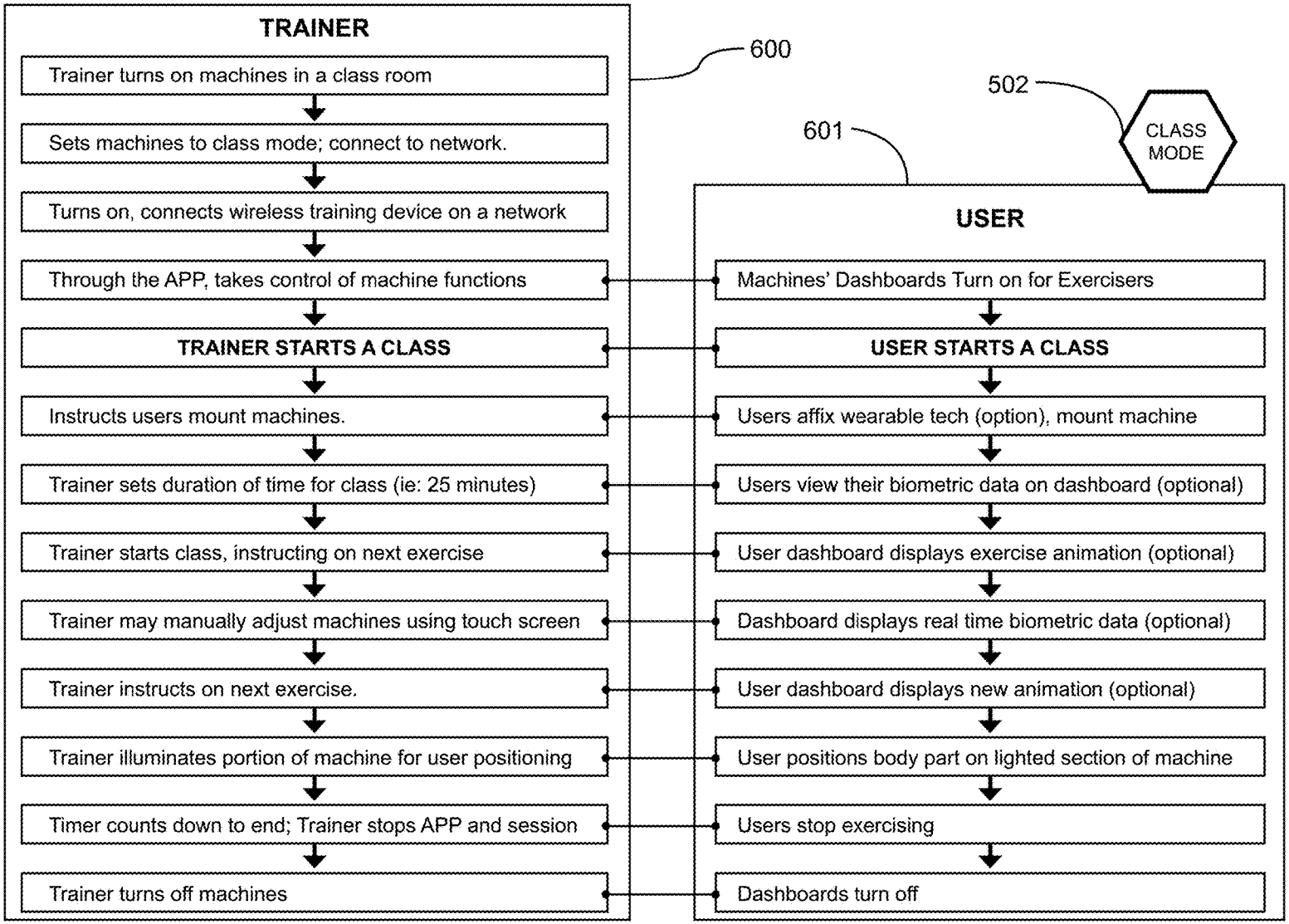
FIG. 19 is an exemplary diagram showing a flow chart for controlling improved exercise machines in a class in accordance with an example embodiment.

FIG. 19 is an exemplary diagram showing a flow chart for controlling improved exercise machines in a class. More specifically, the correlation between a trainer procedure 600 and a user procedure 601 are shown when the machines are set to class mode 502.

To prepare for a class, a trainer following trainer procedure 600 turns on the machines in the facility, sets each machine to class mode as a means of connecting the machines to a network, and turns on and connects the remote trainer controller to the network as a means to control the machines. To prepare for a class, the user, following the user procedure 601 activates the informational dashboard if the option is available. The trainer and user are now prepared to start an exercise class.

The instructor starts the class by directing users to mount the machine, while users mount the machine and affix any wearable sensors that will track and communicate personal biometric information.

The trainer sets the class duration, for example, twenty five minutes or other duration as preferred, while users verify the data feed from their optional wearable technology to the display screen.

The trainer instructs on the upcoming exercise, directing users to properly position for the exercise, while the user references the optional display screen on the dashboard to view an avatar animation demonstrating the upcoming exercise.

The trainer walks between rows and columns of the plurality of machines to ensure that each exerciser is properly performing the exercise, and may manually increase or decrease the difficulty for any given exerciser by adjusting the machine settings using the onboard trainer controller as previously described. The user's optional onboard dashboard displays in real time any changes to the biometric data that result from the change in exercise difficulty as set by the trainer.

The trainer instructs the class of the next upcoming exercise, while the optional dashboard displays the avatar animation of the next upcoming exercise as an instructional aid.

The trainer and user processes 600, 601 just described continue until the end time of the exercise class is reached. At the end of the class, the trainer stops the software application program and exercise session by touching the home button on the tilt-roll selector on the trainer remote controller as previously described, thereby returning all machines on the network, in unison, to the default horizontal plane. The users stop exercising.

The final process in completing an exercise class is for the trainer to switch off all of the machines, and for the users to turn off the dashboard that may be connected to any external data sources. The user finally dismounts the machine.

Figure 20:
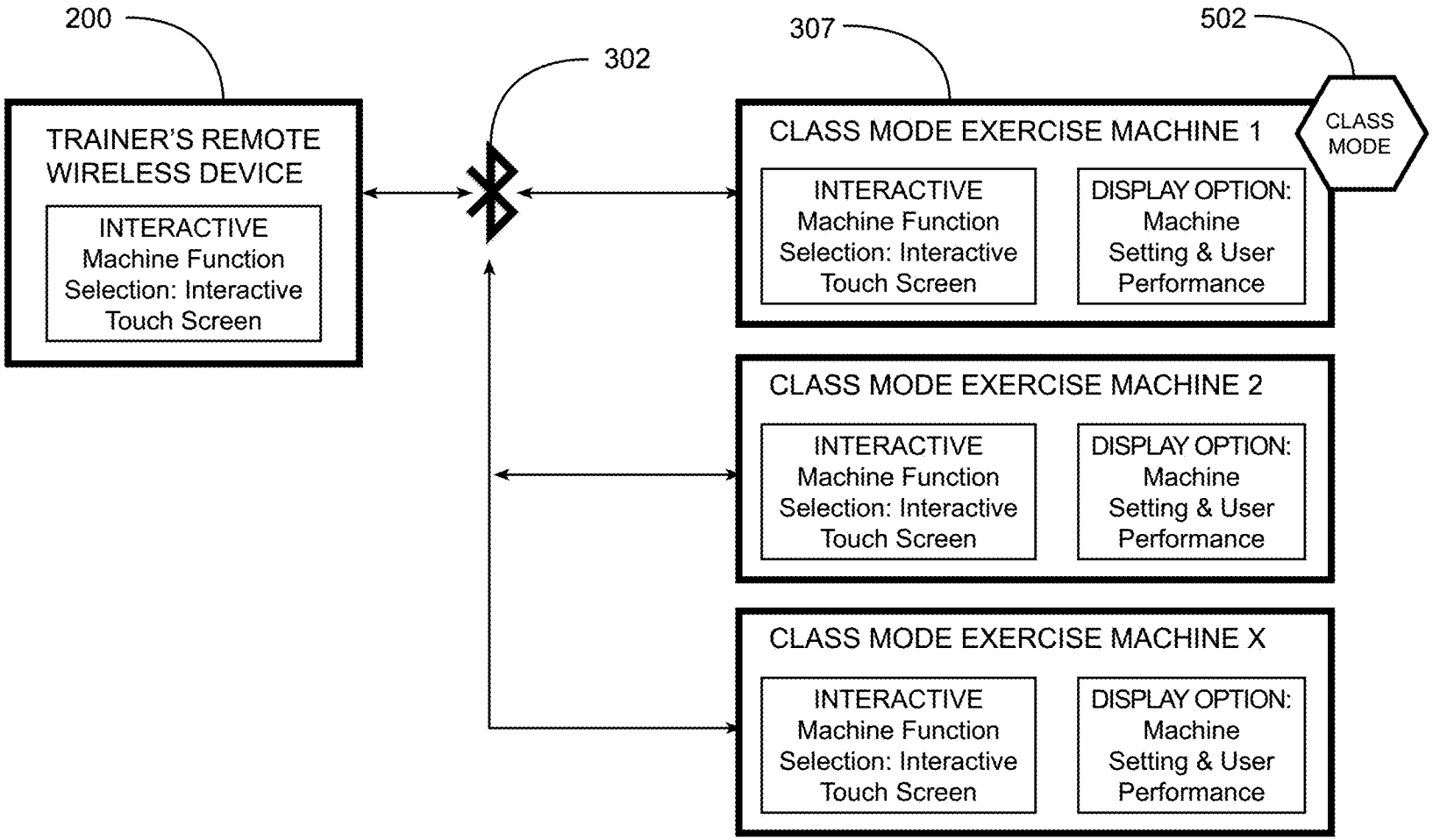
FIG. 20 is an exemplary diagram showing a block diagram of various modes of control of a plurality of improved exercise machines by a trainer remote control device over a wireless communication network in accordance in accordance with an example embodiment.

FIG. 20 is an exemplary diagram showing a block diagram of various modes of machine control by multiple control devices over a wireless communication network. It is sometimes preferable to conduct a fitness class in a facility that does not have available a wireless network router. However, a trainer may still require control over the machine settings of the machines being used by class users.

In the drawing, a Bluetooth 302 connection is shown whereby a trainer remote controller 200 is paired with a plurality of Bluetooth transceivers such as one onboard device 307. Upon machine start up, the machines are set to class mode 502, and each machine is paired to the trainer remote controller 200. After pairing, all of the communication between the remote trainer controller and the plurality of machine settings are managed through the Bluetooth communication. In practice, there is no difference in the machine setting instructions sent over Bluetooth communication between the trainer remote controller and the plurality of machines set to class mode, and the machine setting instructions sent over a wireless network communication between the trainer remote controller and the plurality of machines set to class mode.

Figure 21:
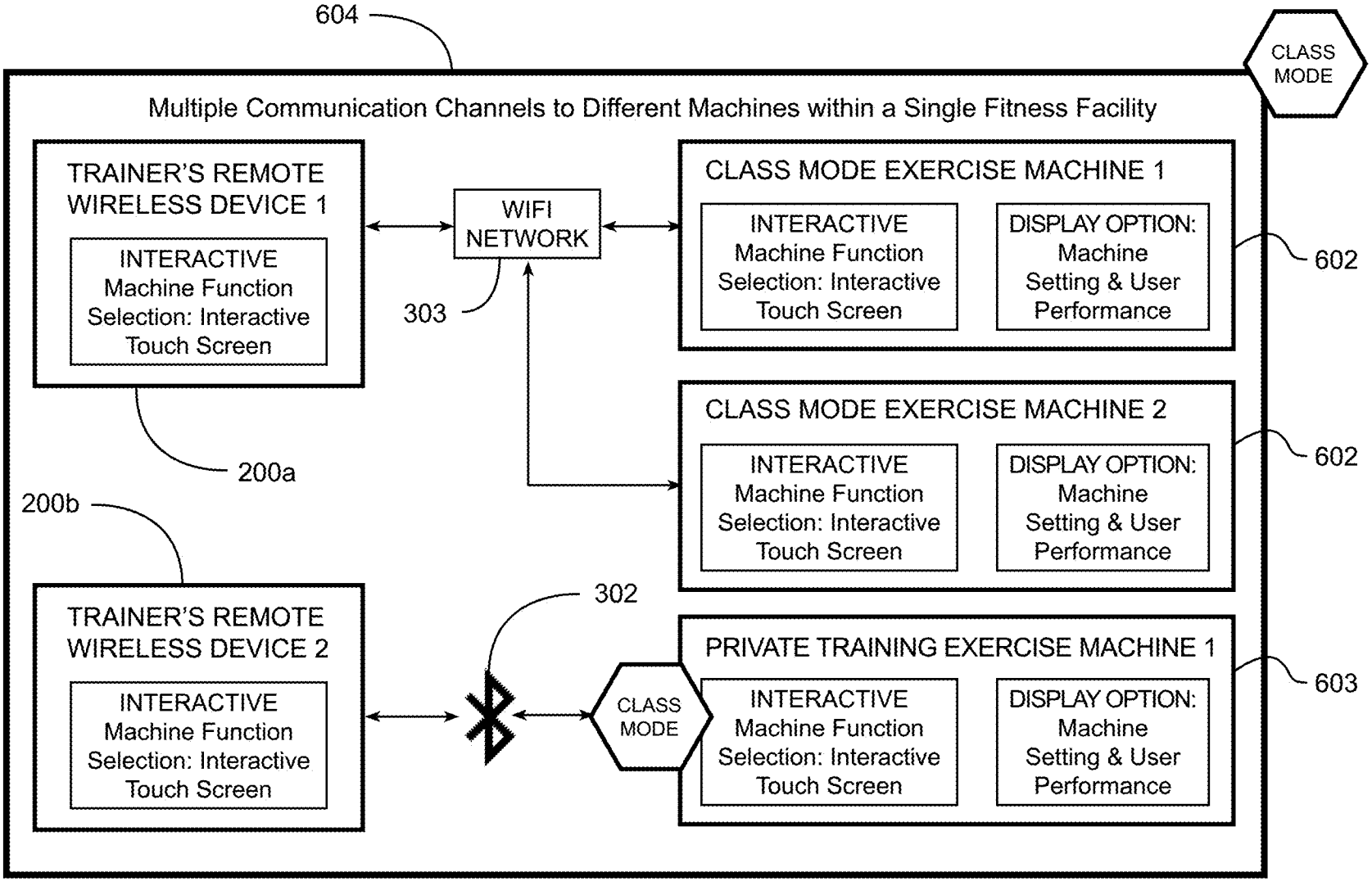
FIG. 21 is an exemplary diagram showing a block diagram of various modes of control of a plurality of improved exercise machines by a plurality of trainer remote control devices via wireless communication in accordance with an example embodiment.

FIG. 21 is an exemplary diagram showing a block diagram of various modes of machine control by multiple wireless trainer remote control devices over a wireless communication network. It is sometimes preferable for two or more trainers to conduct separate training sessions within a facility with a plurality of improved exercise machines. For instance, one instructor may have a small class of four or five users, while a different trainer is conducting a one-on-one class with a private client exerciser. In such instances, it is preferable that each trainer have control over their respective machines without interference from the other trainer's controller instruction. Therefore, a multi-channel communication system is preferred to prevent one trainer from changing the settings on the other trainer's client's machine.

In the drawing, a plurality of exercise machines are positioned within an exercise facility 604, all of the machines having been set to class mode as a means of providing control of the machine settings to a plurality of trainers. In the setup screens, not shown, but as previously discussed, each of a plurality of machines are set up on program-1 602, program-1 providing for each machine to establish communication with the facility wireless network 303. A first trainer using a trainer remote controller 200*a* also connects to the facility wireless network 303, thereby establishing communication with each of the plurality of machines on class mode program-1 602. As fully described herein, the trainer with trainer remote controller 200*a* may now conduct a training class and control the settings of all machines on class mode program-1 throughout the training session.

At the same time, one of the exercisers desires a private training session with a second trainer, the second trainer using a second trainer remote controller 200*b* that has been set up as a Bluetooth device rather than a device connected to the wireless network. Similarly, in the machine setup screen, not shown, but as previously discussed, the singular machine being used for the private training session is set up on program-2 603, program-2 thereby providing for the singular machine to pair with trainer remote controller 200*b* over a Bluetooth communication channel 302.

In the configuration of the plurality of machines and the plurality of training sessions being conducted at the same time, and within the same facility by a plurality of trainers, it can be readily appreciated that a first trainer may control a plurality of machine settings over a first communication channel, and a second trainer may separately control a machine used by a private client exerciser over a second communication channel. Those skilled in the art will appreciate that the description of multiple machines being controlled through multiple communication channels is not limiting, and that the plurality of channels need not be one wireless WIFI communication link and another being a Bluetooth link. For example, multiple routers may be set up and used on the same wireless network without consideration of activating any Bluetooth connections, and further a facility devoid of a wireless router or network may provide for each machine to be paired with a preferred remote trainer controller as desired, by paring each machine with a preferred trainer controller using Bluetooth communications. Other communication channels of various types may be used as well, and the invention is not intended to be limited by any specific type, number, or combination of communication channels employed.

Figure 22:
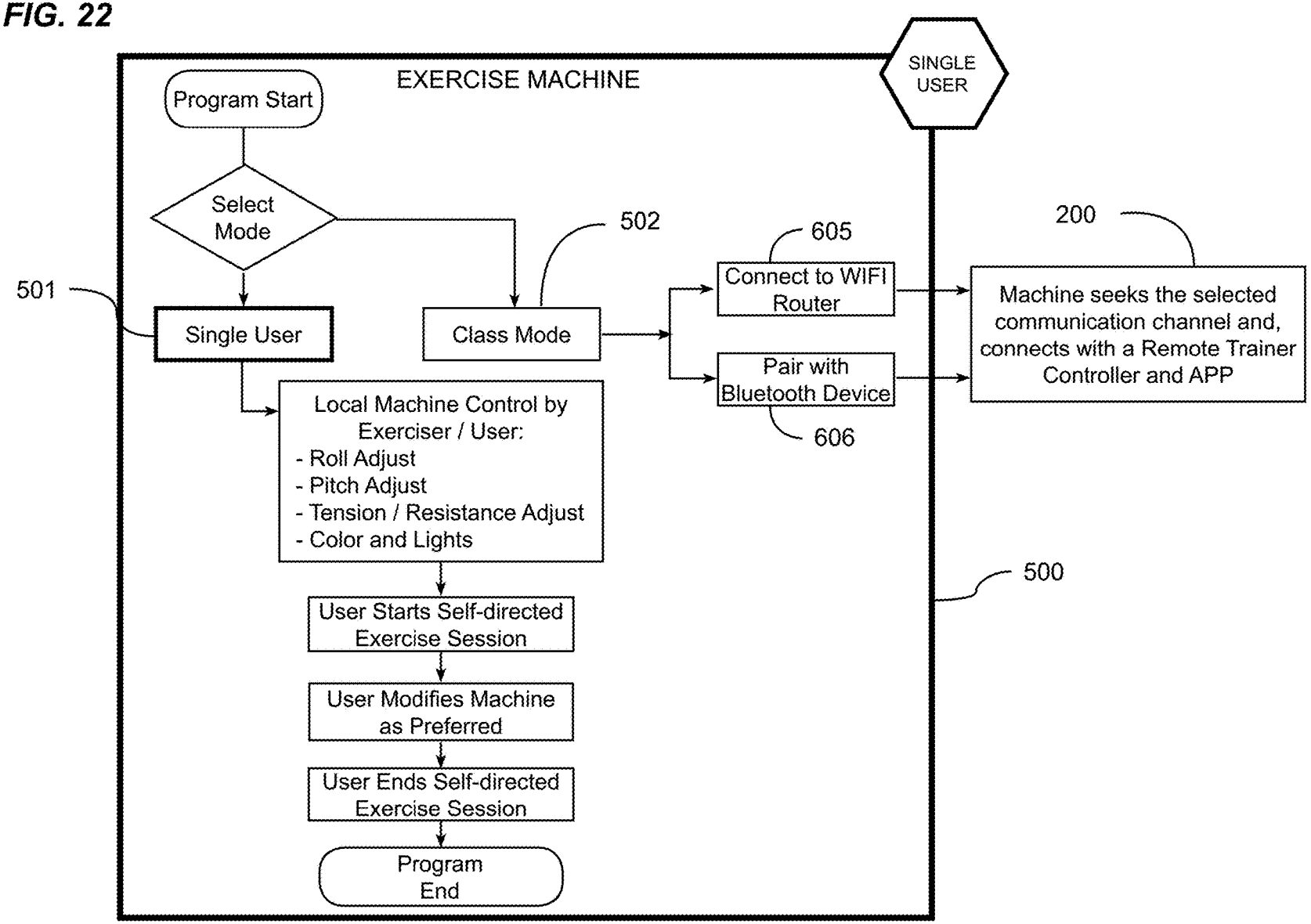
FIG. 22 is an exemplary diagram showing a block diagram and flow chart of the startup mode options of an improved exercise machine in accordance with an example embodiment.

FIG. 22 is an exemplary diagram showing a block diagram of the startup mode options of an improved exercise machine. In the drawing, the onboard user controller 500 of a machine is switched on, the startup screen providing an option to select single user mode 501 or class mode 502. As just discussed, multiple communication channels may be provided in any given facility. In one instance, if the class mode 502 is selected, a second option set provides for a user to select connection through a WIFI channel 605 or a Bluetooth channel 606 as preferred by the trainer. The machine then connects to the trainer remote controller 200 over the desired communication channel.

When a user selects single user mode 501, the machine control is then accessible to the user, the user's control options being expanded compared to when control of the machine is primarily via the trainer remote controller. The list of functions that may be controlled by the user may include, but are not limited to machine pitch and roll, angle adjustment, resistance level adjustment, and machine illumination. Upon completing single user mode setup, the user may commence exercising and modify the settings of the machine throughout the exercise routine as preferred. Upon completion of the exercise period, the user ends the exercise period by touching the home button, not shown but previously described, thereby returning the machine to its default, flat and level starting position. The user then ends the program.

Figure 23:
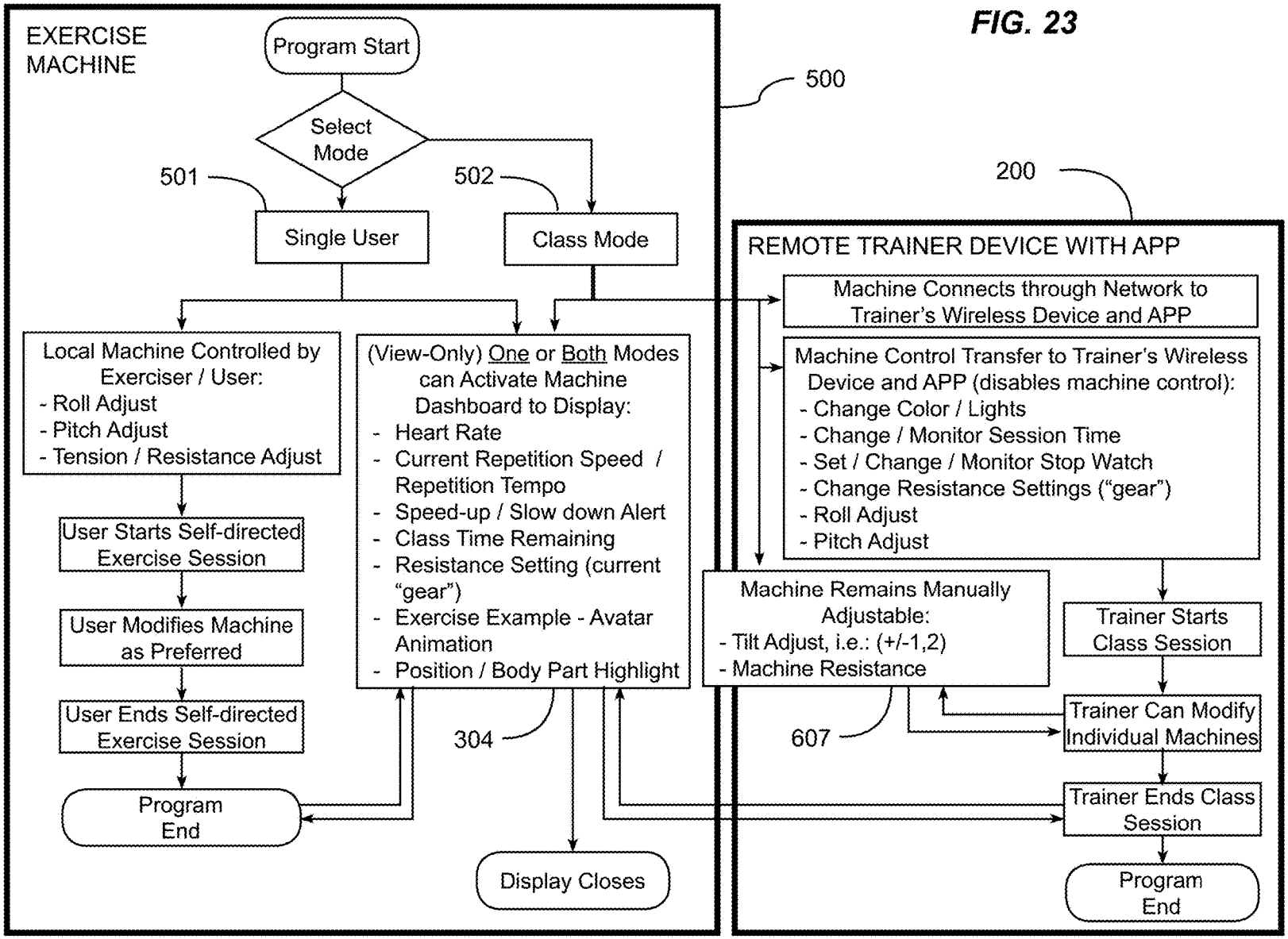
FIG. 23 is an exemplary diagram showing a block diagram and flow chart of the startup mode options of an improved exercise machine, and the interactive communication with a trainer's remote control device in accordance with an example embodiment.

FIG. 23 is an exemplary diagram showing a block diagram of the startup mode options of an improved exercise machine, and the interactive communication with a trainer's remote control device.

In one preferred machine configuration, a machine is started up by opening the onboard user controller 500 and selecting either the single user mode 501 or the class mode 502. By first selecting the single user mode 501, an onboard display screen 304 opens to display view-only information that may include data from external sources such as a wearable heart rate monitor, or exercise instruction videos streamed from the network. Concurrently, control of certain functions and settings of the machine are transferred to the user via the onboard user controller, the controllable functions including at least the adjustment of the tilt and roll of the exercise machine. Throughout the user's exercise period, the user may change settings of the machine as preferred, and may continue to monitor data on the view only display screen 304. Upon completion of the exercise period, the user ends the program by touching the home button, not shown, but previously described, the home button thereby causing the machine to return to the flat and level default position, and at the same time switching off the view-only display screen.

However, in a machine configuration, it may be preferred to set up the machine on class mode 502 so that an instructor may control a plurality of machines during a training session. In such a configuration, the display screen 304 opens as a means to communicate certain information to each user on each machine, the user information preferably including data unique to each user. For instance, the heart rate for each user in a class will be unique to each user, the heart rate information being an important gauge of personal performance. Other information that may be displayed on the view-only screen may include a video animation of the next exercise to be performed, the video being a visual reference for the user to establish the appropriate body positioning on the machine in preparation of performing the exercise.

Further, when class mode 502 is selected, primary control over machine settings for all machines opened in class mode is transferred via wireless communication to a trainer remote controller 200. During the exercise session, the trainer may change the angle of pitch and roll as desired, illuminate different parts of the machine as visual indicia referenced by the users for proper body positioning, and change the resistance level of the plurality of machines simultaneously. The user may still maintain limited control of the available user functions 607, namely functions allowing incremental modification of the trainer-established pitch angle of the machine.

The trainer may continue to change machine settings of the plurality of machines connected to the network throughout the training session. Upon completion of the training session, the trainer ends the session by touching the home button as previously described, the home button thereby terminating the program on the machines, closing the view only display, and returning the plurality of machines to the default horizontal position. The trainer then ends the program.

E. Arm Mounted Remote Control Device, Device Holder, and Strap Assemblies.

Figure 24:
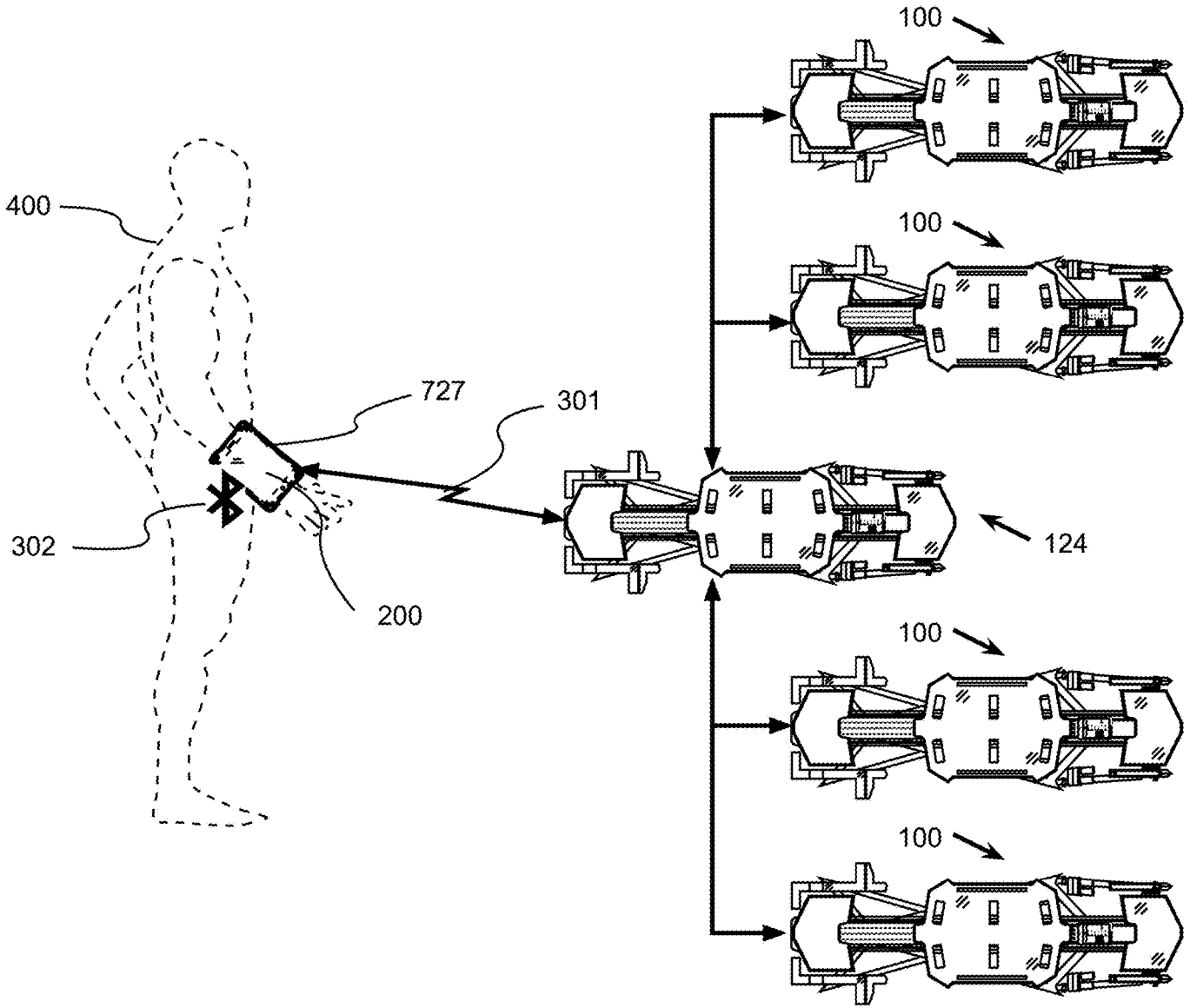
FIG. 24 is an exemplary diagram showing an arm mounted wireless remote control device in communication with a single exercise apparatus, which in turn is in communication with a plurality of other exercise apparatuses over a communication network in accordance with an example embodiment.

FIG. 24 is an exemplary diagram showing an arm mounted wireless remote control device in communication with a single apparatus, the single apparatus in communication with a plurality of apparatuses over a communication network. More specifically, a plurality of substantially similar exercise machines 100 are located within a given fitness facility, the plurality of machines providing for a plurality of users to simultaneously exercise at the direction of a fitness trainer. In the drawing, the plurality of machines is in communication with a designated exercise machine and router 124. The number of machines shown that may be connected to a designated exercise machine and router is not meant to be limiting, and any number of machines reasonably co-located within a facility may be in communication with the designated exercise machine and router.

Now then, as a means to ensure that all of the plurality of exercise machines in communication with the designated exercise machine and router 124, and correspondingly the exercisers upon the machines, all respond substantially in unison to the trainer's direction, the trainer uses a wireless remote control device that when in communication with the designated exercise machine and router 124 may control the settings of all of the machines by routing communications from the interactive touch screen 201 of the remote control device through the designated exercise machine and router 124.

It should be noted that any machine configured similarly to the designated exercise machine and router 124 may act as an exercise machine and router. For instance, in the event that a first designated exercise machine and router encounters an error, or is taken out of service for any reason, a second similarly configured machine will or can, based on the highest signal strength between the remote control device 200 and a candidate machine, become the designated exercise machine and router.

As an instructor moves through the facility, at any time, the signal strength between the remote control device 200 and a second machine not currently the designated exercise machine and router may become stronger than the signal strength between the remote control device and the designated exercise machine and router. In practice, the second machine preferably would assume the role of designated exercise machine and router from the previous machine, the hand-off of the router functions between the first and second machines being seamless, without any required action by an instructor or exerciser.

It should be further noted that the communication method between the remote control device 200, the designated exercise machine and router 124, and the exercise machines 100 is not meant to be limiting, and may be any one or more of the protocols well known to those skilled in the art including but not limited to Bluetooth, WIFI, SigFox, ZigBee, Z-wave or the many other low power communications protocols.

Figure 25:
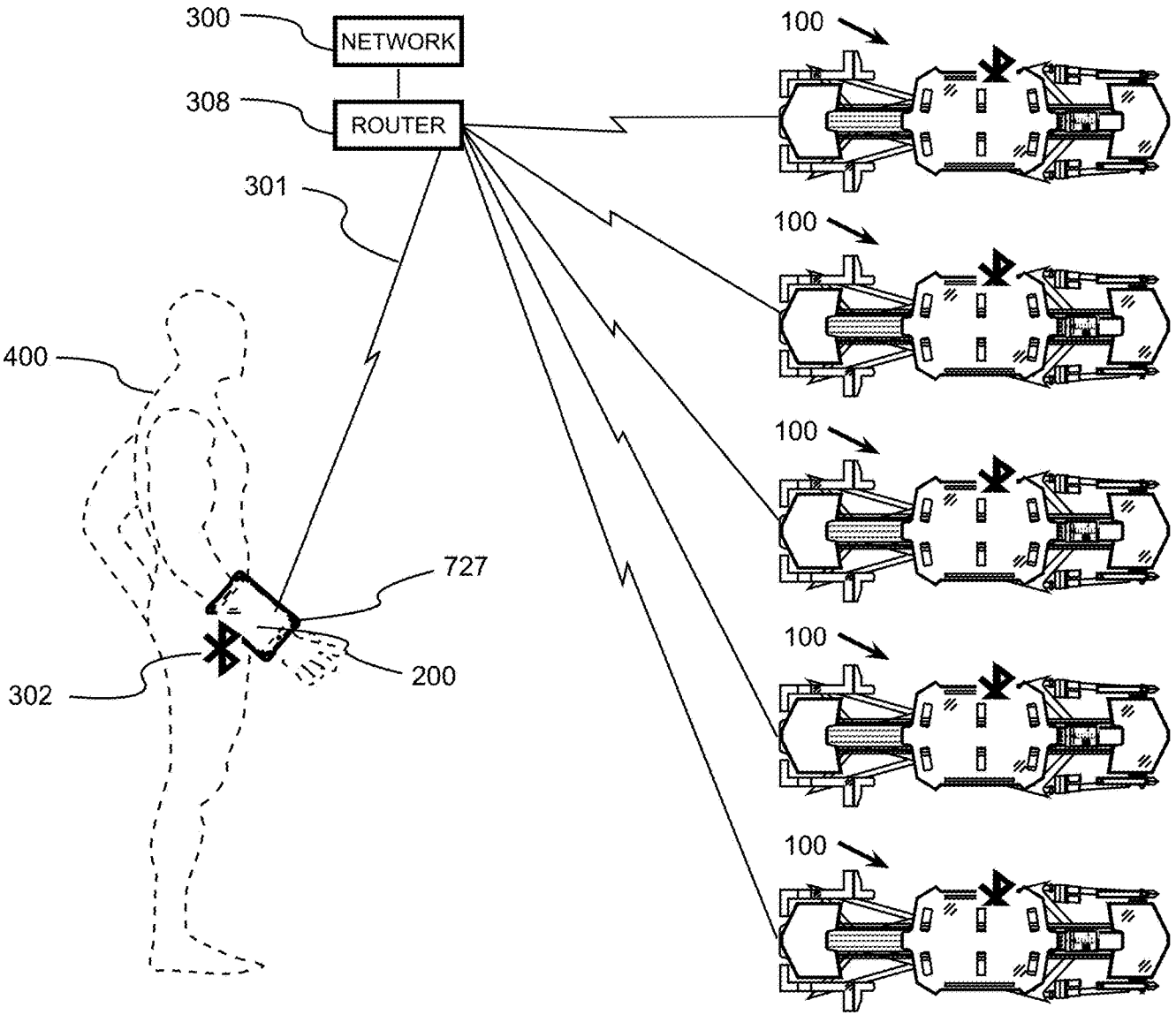
FIG. 25 is an exemplary diagram showing an arm mounted wireless remote control device in communication with a router, the router being in communication with a plurality of exercise apparatuses over a communication network in accordance with an example embodiment.

FIG. 25 is an exemplary diagram showing an arm mounted wireless remote control device 727 in communication with a router, the router being in communication with a plurality of apparatuses over a communication network. In the drawing, a dotted line indicating an exercise instructor 400 is shown with an arm mounted device holder removably affixed to a forearm and wrist, the holder providing for securely retaining a wireless remote control device 200 in communication with a plurality of exercise machines 100 within an exercise facility. More specifically, the remote control device 200 retained within the holder of the arm mounted remote control device 727 may be in Bluetooth 302 communication with one or more exercise machines, and/or may be in wireless communication 301 with a network router 308 in communication with exercise machines 100 and/or a server on a network 300.

It is preferred that the remote control device 200 is useable by an instructor during an exercise class as a means to retrieve exercise routines or exercise class details from a server on the network 300, such details including but not limited to the current time, exercise class time expired, exercise class time remaining, a list of exercises to be performed in a sequence of exercises, or other data related to the exercise class period. However, it is understood that the described embodiment is also useable by other users, and is not necessarily limited to use by an instructor or trainer.

Further, it is also preferred that the remote control device provides interactive communication between one or a plurality of exercise machines 100, the communication thereby comprising instructions from the remote control device 200 to one or more of the exercise machines, the instructions including for example a change in machine resistance, machine incline, machine roll or tilt, or other functional changes in machine settings. Still further, is it another preference that the instructor receive communications on the remote control device 200 from one or more machines, the communication consisting of, for example, the current status of the machine settings, or data related to the exerciser upon any machine, the exerciser information comprising heart rate or other biometric or exercise-related date of any individual exerciser. As can be readily seen in the illustration, the instructor's hands remain free even though a remote control device 200 is securely retained in a holder affixed to the instructor's forearm and wrist.

Figure 26:
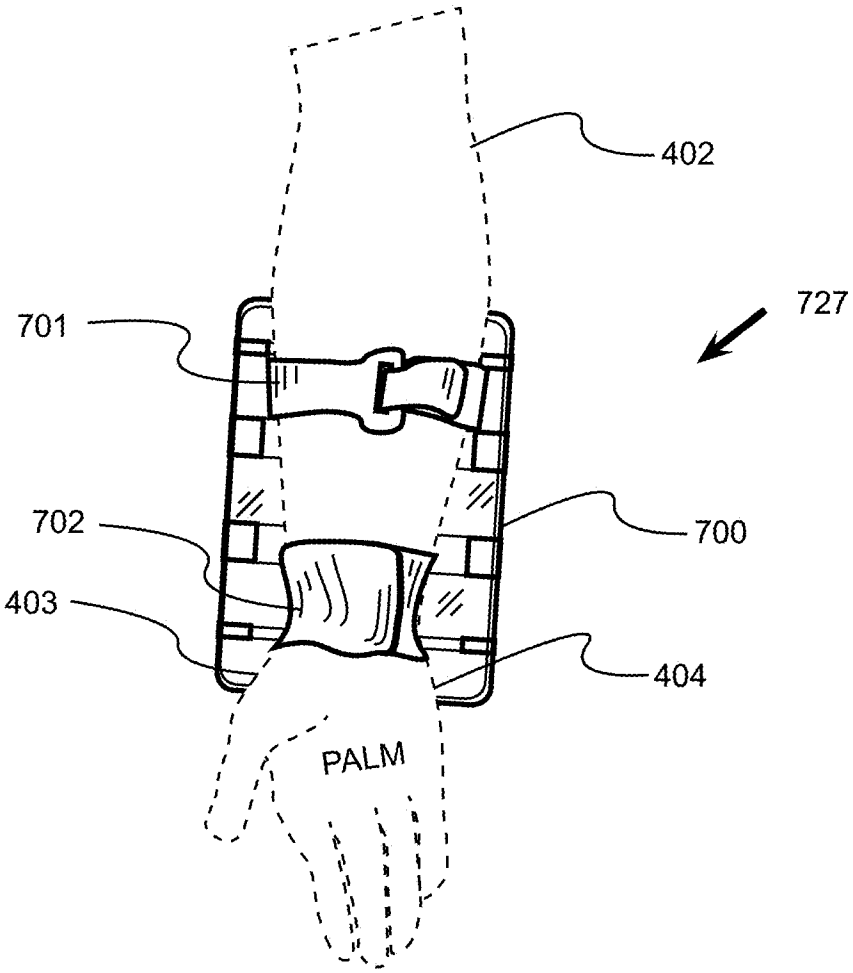
FIG. 26 is an exemplary illustration showing an arm mounted remote control device affixed to a forearm and wrist in accordance with an example embodiment.

FIG. 26 is an exemplary illustration showing a remote control device affixed to a forearm and wrist. As is shown, the arm mounted device 727 is affixed to the posterior forearm 402 of an exercise instructor or other user.

The unique requirement to securely hold a remote control device in a given position on the instructor's arm throughout high intensity exercise and during continuous, oftentimes rigorous, hand and arm movements, militates the need for new and novel strapping and device attachment methods. A structural frame 700 which retains a remote control device (not shown) is secured to the instructor's arm with a plurality of straps, namely a forearm strap 701 and a wrist strap 702. It should be noted that there is a unique requirement to keep the holder from slipping off of, or rotating about the arm during rigorous movements. Therefore, the wrist strap is sufficiently wide, and made of a resilient materials so that the strap conforms to the palmaris brevis muscle, pistiforn and metacarpis 404 of the outside of various sized hands as would be typically encountered in a fitness facility employing more than one instructor, and further to conform to the thenar muscle 403 of the thumb for the same reasons just described.

Figure 27:
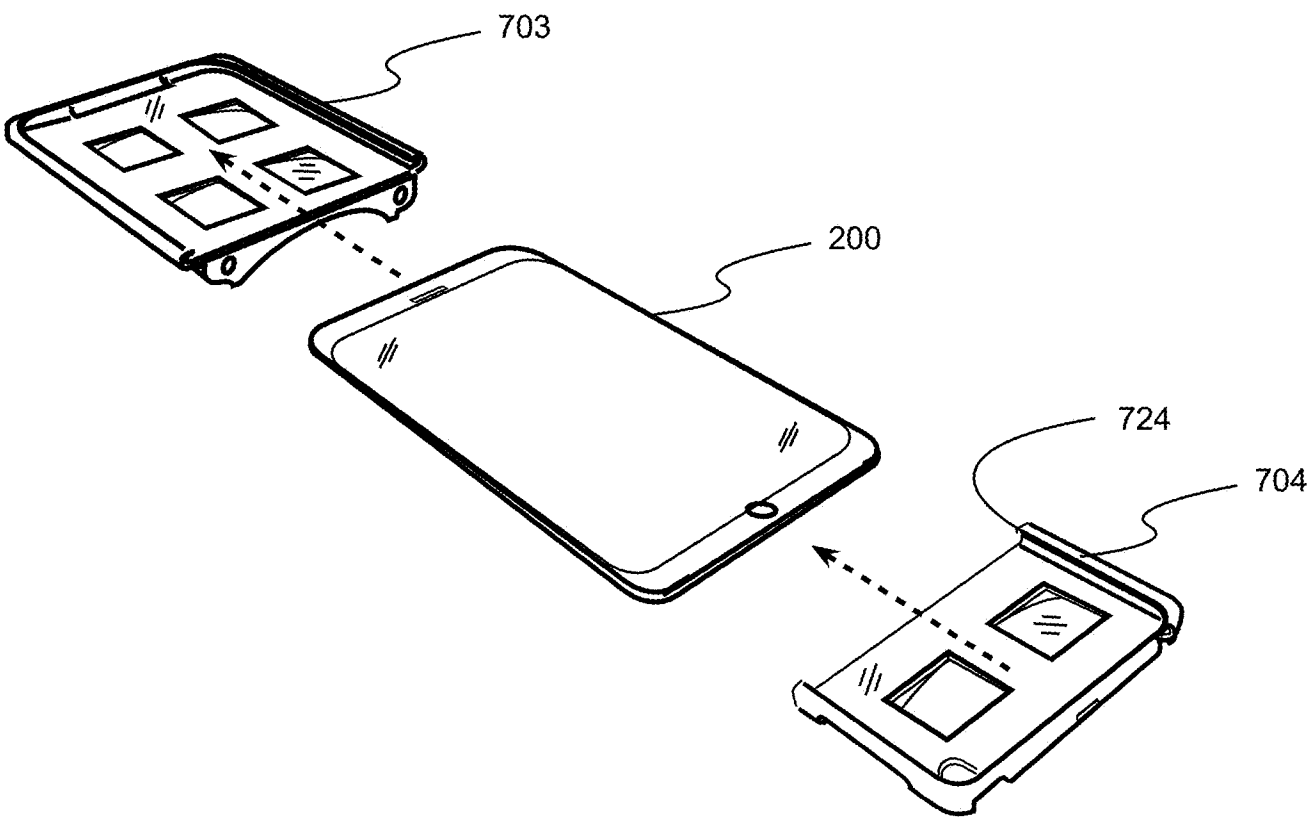
FIG. 27 is an exemplary illustration showing an exploded perspective view of the top of an assembly comprising an arm mounted remote control device and structural frame of a holder in accordance with an example embodiment.

FIG. 27 is an exemplary illustration showing an exploded perspective view of the top of an assembly comprising a remote control device and structural frame. In one variation, one or both of a first frame member 703 and a second frame member 704 have interior channel 724 geometries that associate with the exterior edge geometry of the remote control device 200, thereby substantially securing the device within the assembled structural frame, preferably with a touch screen of the device exposed and accessible by the instructor or other user. As shown in the drawing, the first frame member 703 and second frame member 704 may be assembled by aligning the interior geometry of the frame members with the exterior edge of the remote control device 200, and sliding the frame members along the longitudinal axis of the device until they meet together.

Figure 28:
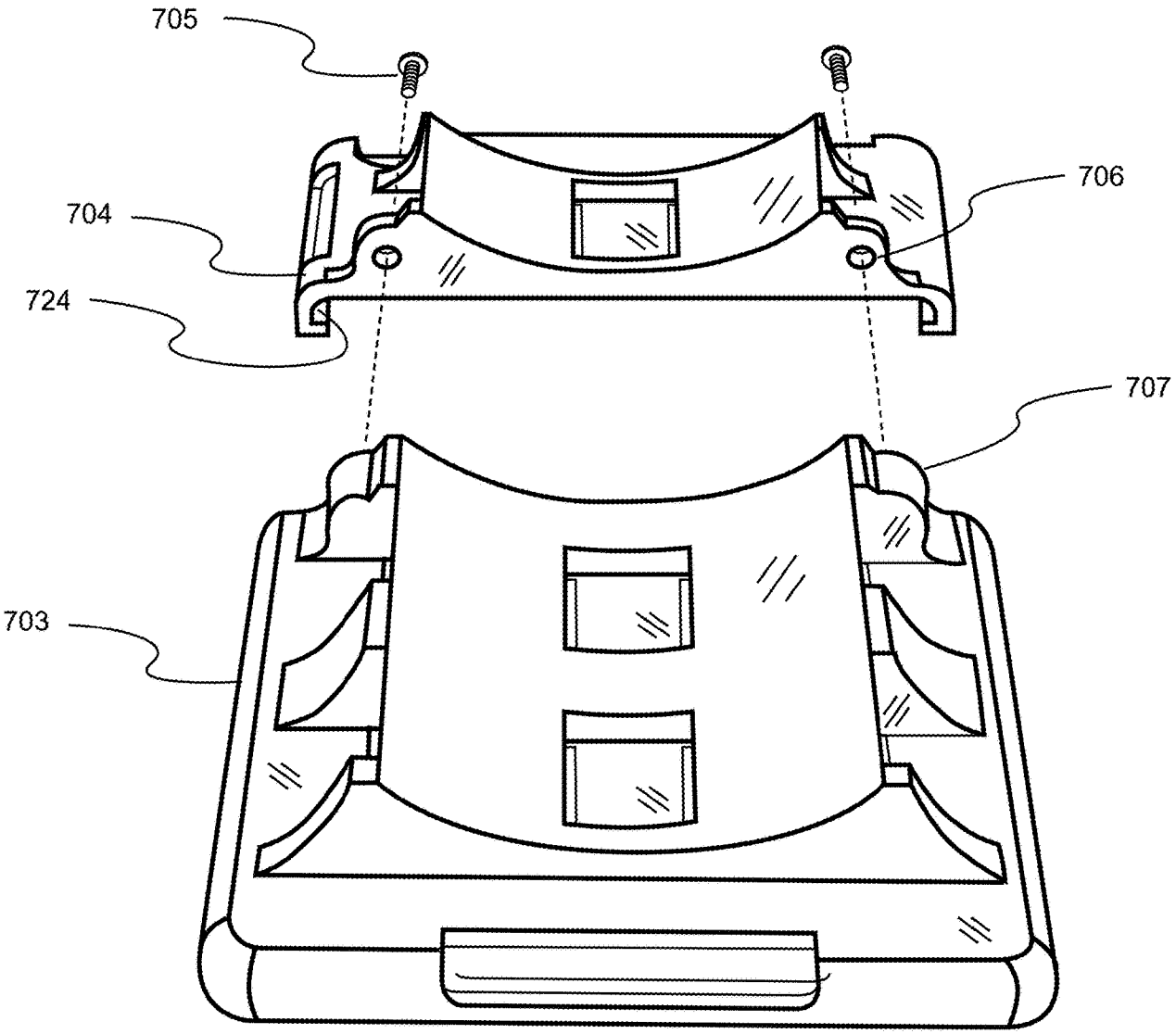
FIG. 28 is an exemplary illustration showing an exploded perspective bottom end view of an assembly of a structural frame of a holder for an arm mounted remote control device in accordance with an example embodiment.

FIG. 28 is an exemplary illustration showing an exploded perspective bottom end view of the assembly of a wireless device structural frame. As previously described, a first frame member 703 and a second frame member 704, one or both of which have interior channel 724 geometries that associate with the exterior edge geometry of the wireless device (not shown), come together as part of the assembly process. As a means of securing the two frame members together, and to further retain the wireless device within the assembled frame members, one or more fasteners 705 may be inserted through one or more eyelet holes 706 in the second frame member, and screwed into one or more respective fastening bosses 707 in the first frame member.

The means of attaching the first and second structural members together as just described is not meant to be limiting. Those skilled in the art will immediately understand that a large number of methods may be used to attach a first member to a second member including, but not limited to heat staking, mating male and female features incorporated into the respective first and second members, or elastic members with distal ends attached to the two structural members thereby drawing the members together.

Figure 29:
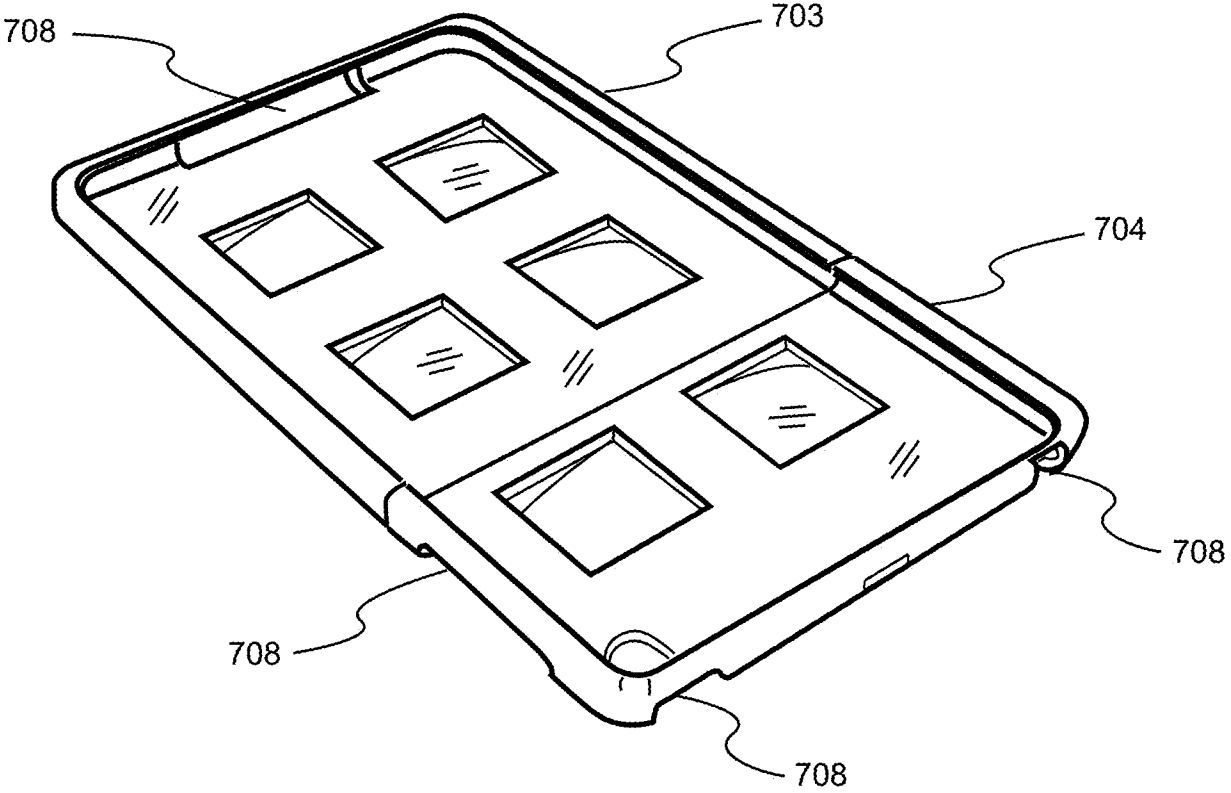
FIG. 29 is an exemplary illustration showing a perspective view of the top of an assembled structural frame of a holder for an arm mounted remote control device in accordance with an example embodiment.

FIG. 29 is an exemplary illustration showing a perspective view of the top of an assembled structural frame comprising a first frame member 703 and a second frame member 704 having been attached as previously described. As can be seen, the two structural members have been attached, absent an enclosed wireless device.

It is well known by those familiar with mobile phones, tablet computers and similar wireless display devices that many features are provided for user interface including on/off buttons, speaker ports, volume buttons, cameras, charging ports, headphone ports, and the like. As a means to provide user access to the features typically incorporated on such wireless devices, a plurality of device feature access ports 708 may be integrated into the structural frame members as shown. Since many different wireless devices may be retained within the holder and may have unique placement of each of the many features just mentioned, and other wireless devices may not contain all of the features, it is important that the device feature access ports 708 be of sufficient number, placement and size so as to accommodate access to the features of the preferred wireless device by the exercise instructor or other user.

It is further contemplated that the remote control device holder, and more particularly the structural frame assembly, may incorporate a power source such as a battery, one or more control buttons, and one or more lights. The power source may comprise, for example, one or more small coin-style batteries, one or more small cylindrical batteries, or one or more rectangular 9-volt style batteries. The battery or batteries may be positioned in battery compartments formed in or on the frame assembly with terminals and wires for electrically connecting the batteries to various devices. In addition, the batteries may be electrically connected to provide charging power to the remote control device, which may be for example an iPhone, iPad, or Android-based phone or tablet. Alternatively, a feature access port 708 may be provided so that a charging port of the remote control device can be connected to a remote source of power, such as a wall socket, via an electrical cable and charging transformer.

The control buttons may comprise mechanical or electronic switches and may be interfaced to electronic circuits adapted to communicate actuation of the buttons to the remote control device, the communications network, or directly to the exercise machines being controlled via WiFi, Bluetooth, or another suitable communications channel. Preferably, the control buttons can be actuated to control lights in the exercise facility and/or on the exercise machines in a manner to that described herein for the remote control device, as well as other settings.

The lights preferably provide sufficient lighting to allow a trainer or instructor to more readily see potential settings on the remote control device, an exercise machine when the trainer's arm is in proximity to the machine, or a written script or instructions for example. The lights may suitably comprise small LED's or other miniature light sources mounted on or recessed within the frame assembly. Preferably the lights require only a small amount of current to operate and are electrically connected to the power source on the frame assembly itself via a switch or one of the control buttons for example.

Figure 30:
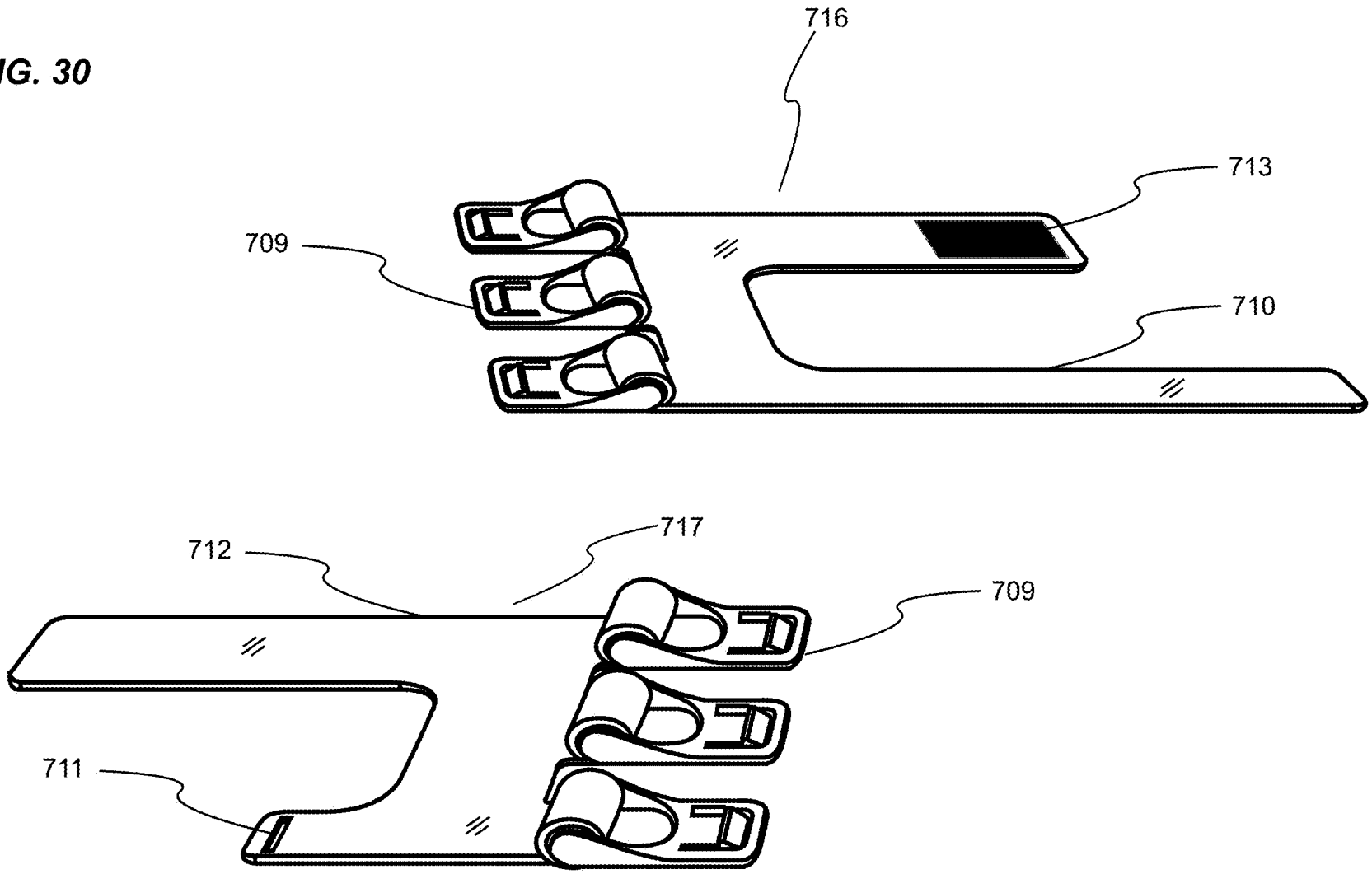
FIG. 30 is an exemplary illustration showing one variation of an arm strap assembly for a holder for an arm mounted remote control device in accordance with an example embodiment.

FIG. 30 is an exemplary illustration showing one variation of an arm strap assembly. In the drawing, two cooperating assemblies are shown, each comprising a resilient material to which a plurality of strap retaining clips 709 are affixed. The method by which the retaining clips are affixed to the resilient material may include sewing, hook and loop fasteners, loop through a buckle detail on the clip, or by any other well known means.

As can be readily seen, on a second strap assembly 717, a long, relatively narrower projection of the materials comprises a portion of the forearm strap 710 which, upon assembly with the previously described structural members, will pass through the buckle slot 711 in the opposed but mating strap material. In a like manner, on a first strap assembly 716, the fastening material 713 shown on the relatively wide projection of material comprises a portion of the wrist strap which, upon assembly with the previously described structural members, will mate with a fastening material on the non-visible side of the opposed end of the wrist strap 712. The fastening material shown may be of a hook and loop type of mating material, or an alternate method of attaching two ends of a strap together after tightening about an arm may be used, for instance, a pass-through buckle.

Figure 31:
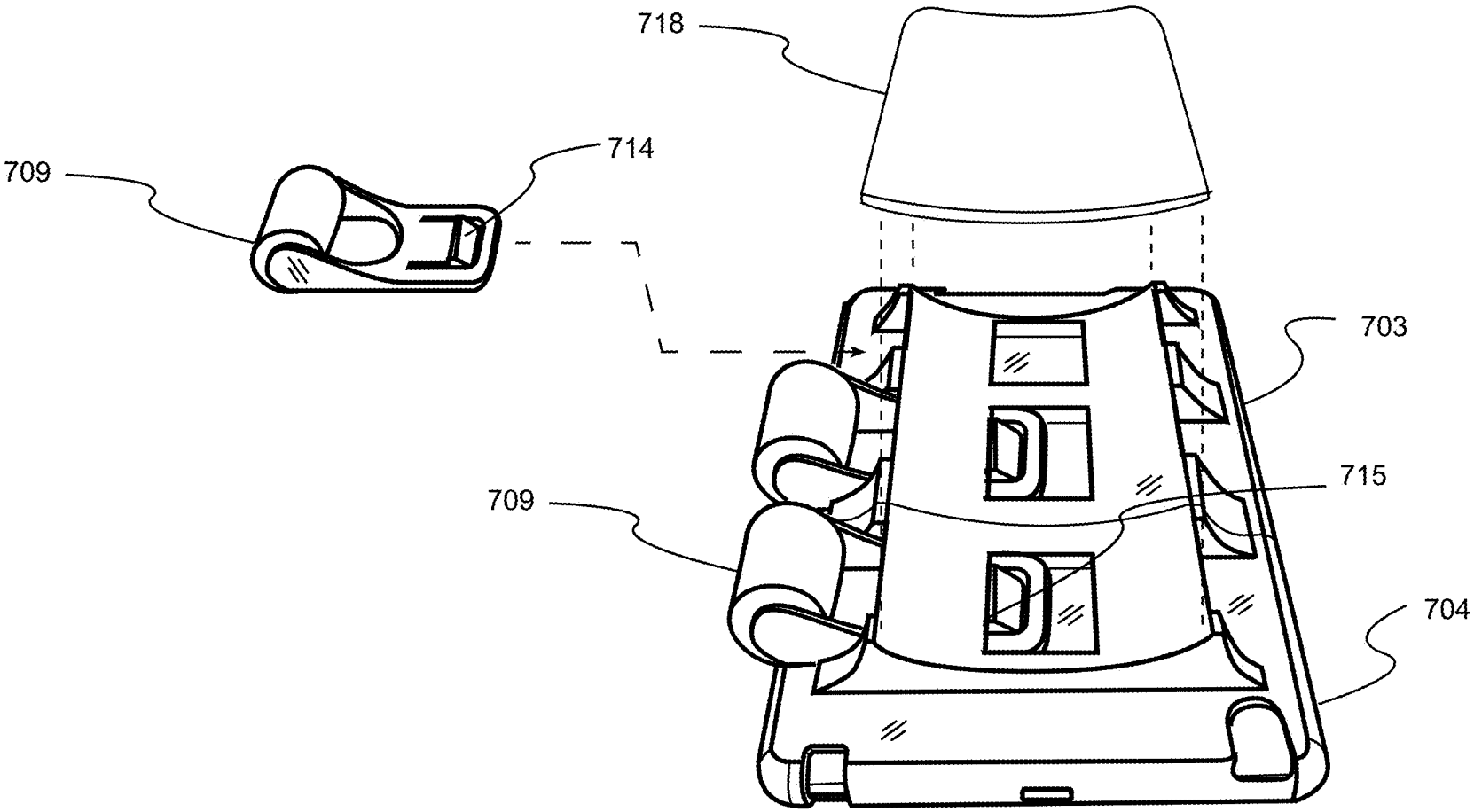
FIG. 31 is an exemplary illustration showing a perspective view of the bottom of a holder for an arm mounted remote control device in accordance with an example embodiment.

FIG. 31 is an exemplary illustration showing a perspective view of the bottom of an arm mounted remote control device holder. As previously described, a first and second structural member 703, 704 have been assembled together, a forearm pad 718 provides for cushioning the holder assembly against the forearm and further minimizes slipping of the holder about the forearm, and a plurality of strap retaining clips 709 are shown installed, and about to be installed, into the structural members. The plurality of strap retaining clips 709 provides for the easy removal of the strap assemblies from the device holder for cleaning, service or replacement.

Each of the retaining clips is formed with a spring latch 714 proximate to the insertion end of the clip, the spring latch being flexable to allow for insertion into the insertion slot of the structural member, and returning to its pre-depressed position so as to snap against the strike 715 formed into the structural member. By repeating this process for each retaining clip, each of the opposed portions of the retaining strap will be removably attached to the structural members of the holder with the distal ends of the strap assemblies used for securing to the forearm of an exercise instructor or other user.

Figure 32:
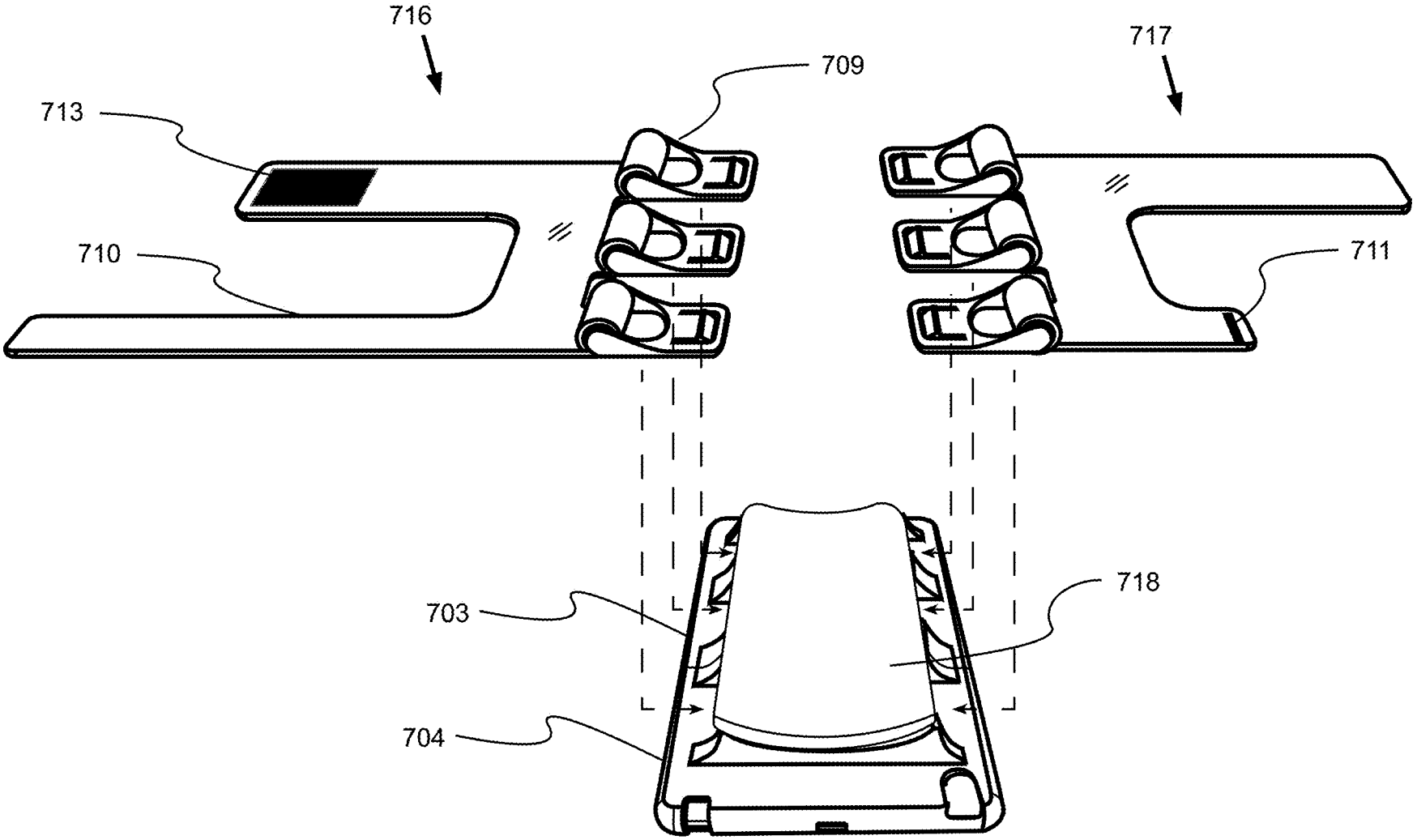
FIG. 32 is an exemplary illustration showing an exploded diagram of an assembly of arm straps and a structural frame for a holder for an arm mounted remote control device in accordance with an example embodiment.

FIG. 32 is an exemplary illustration showing an exploded bottom perspective view of the assembly of arm straps to a structural frame. More specifically, the opposed first strap assembly 716 and the second strap assembly 717 having been previously assembled as previously described, are shown in a condition ready to assemble to the mated first and second structural members 703, 704. The wrist strap portion 713 is shown opposed to the wide wrist strap of the second assembly 717, and the forearm strap portion 710 is shown opposed to the portion of the second strap assembly comprising the buckle slot 711. A forearm pad 718 is shown in the position at which it will be secured after installation of the strap assemblies.

The process of assembling the components just described is:

1. Slide the first and second structural members around the remote control device (not shown);

2. Secure the first and second structural members 703, 704 together using fasteners or other means as previously described;

3. Insert each and all of the strap retaining clips 709 into their respective slots in the structural members until the spring latch 714 fully engages the strike 715; and 4. Install the preferably concave shaped forearm pad 718 on the back surface of the structural members, thus covering the openings and protecting the retaining clips from unintentional disengagement. Although not shown, the forearm pad 718 may be affixed to the structural members by various means such as double-sided adhesive tape, hook and loop fasteners, or mechanical fasteners.

Figure 33:
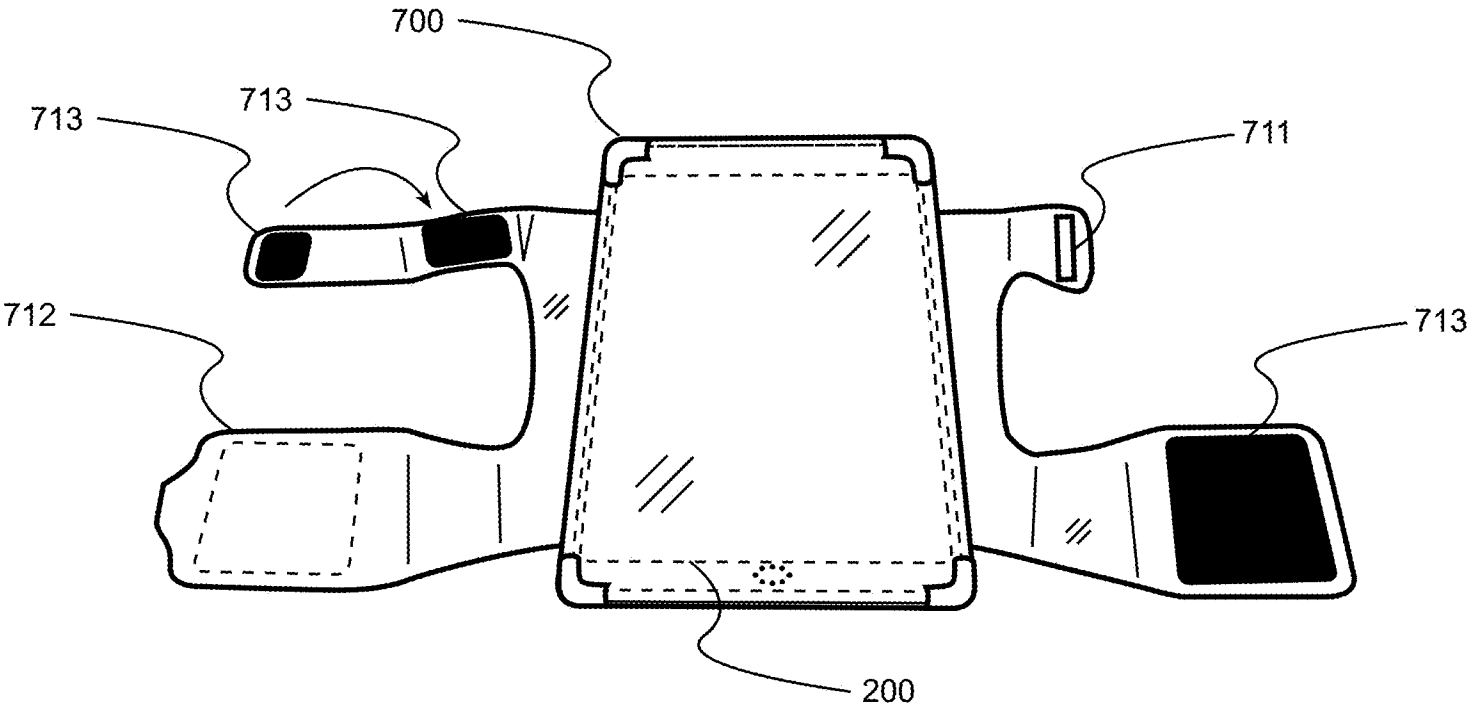
FIG. 33 is an exemplary illustration showing a perspective view of the top of a variation of a holder retaining an arm mounted remote control device in accordance with an example embodiment.

FIG. 33 is an exemplary illustration showing a top perspective view of a variation of an arm mounted device holder. A dotted line represents the placement of a remote control device 200 retained within a structural frame 700. The outside of the strap assembly is shown ready to install on the forearm of a wearer. The wide portions of the strap assemblies are positioned about the wrist with the fastening material 713 on the first side being mated with fastening material on the underside of the opposed wrist strap 712 indicated approximately by the dotted line. Further, the two small portions of fastening materials 713 are shown on the narrower portion of the strap for wrapping around the forearm, the end of the narrow strap being fitted through the buckle slot 711, drawn tight about the forearm, and fastened back to itself using the two small mating portions of the fastening material.

Figure 34:
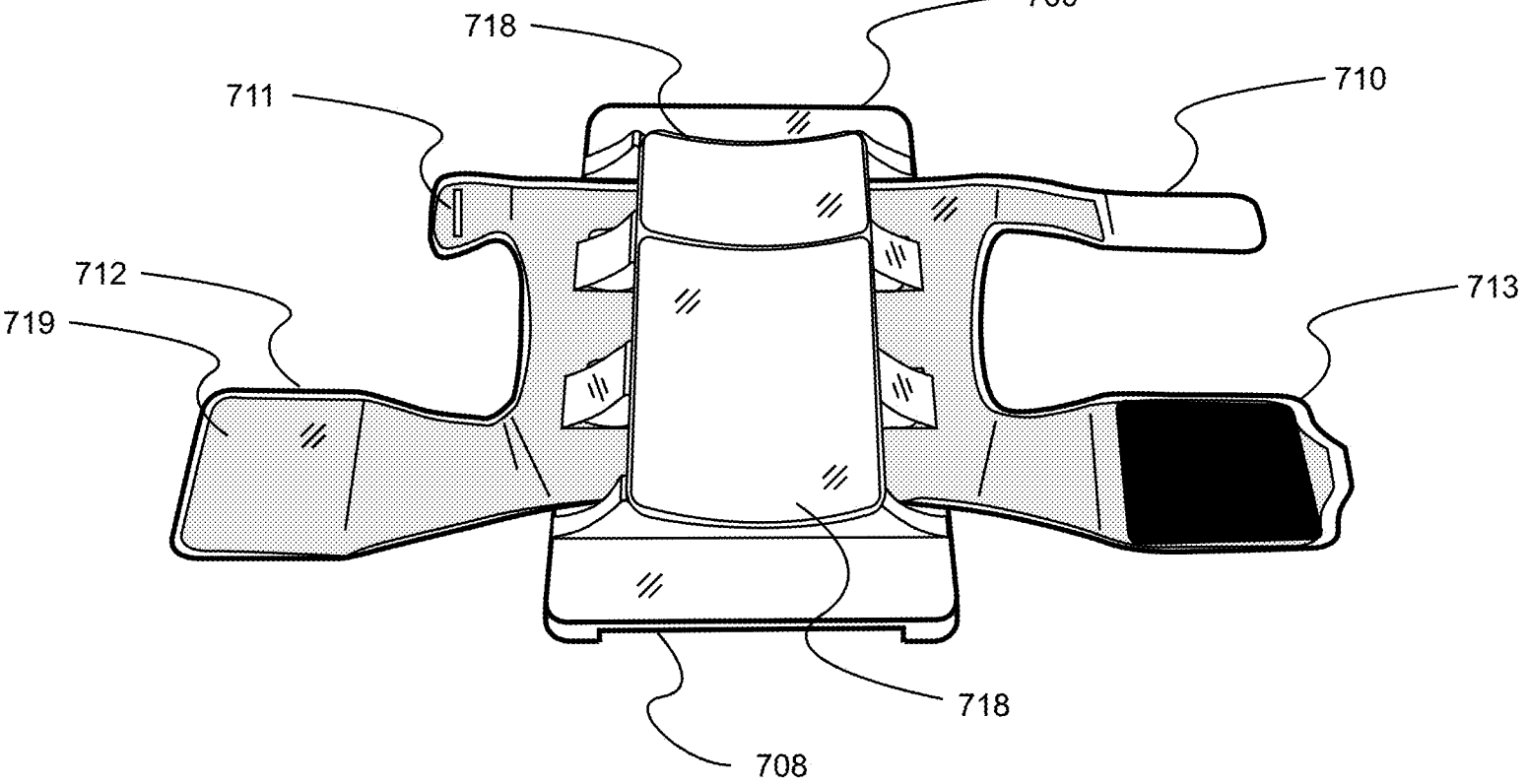
FIG. 34 is an exemplary illustration showing a perspective view of the bottom of a variation of a holder for an arm mounted remote control device in accordance with an example embodiment.

FIG. 34 is an exemplary illustration showing a bottom perspective of view of the variation of the arm mounted device holder of FIG. 33. The underside of the arm mounted device holder shows a structural frame 700 with at least one device feature access port 708. A strap assembly comprises a wrist strap 712 of a resilient material, and an optional liner material 719 that may provide enhanced anti-slip or perspiration absorption functions. A relatively narrow projecting portion of the strap comprises a forearm strap 710 that is threaded through the buckle slot 711 and secured about the forearm using the fastening materials. A large piece of fastening material 713 having been applied to the wide portion of the wrist strap is secured to the fastening materials on the underside of the opposed portion of the strap after wrapping both portions about the wrist. A preferably concave forearm pad 718 is shown affixed to the structural frame to provide enhanced fit and comfort when placed on the instructor's forearm.

Figures 35A, 35B:
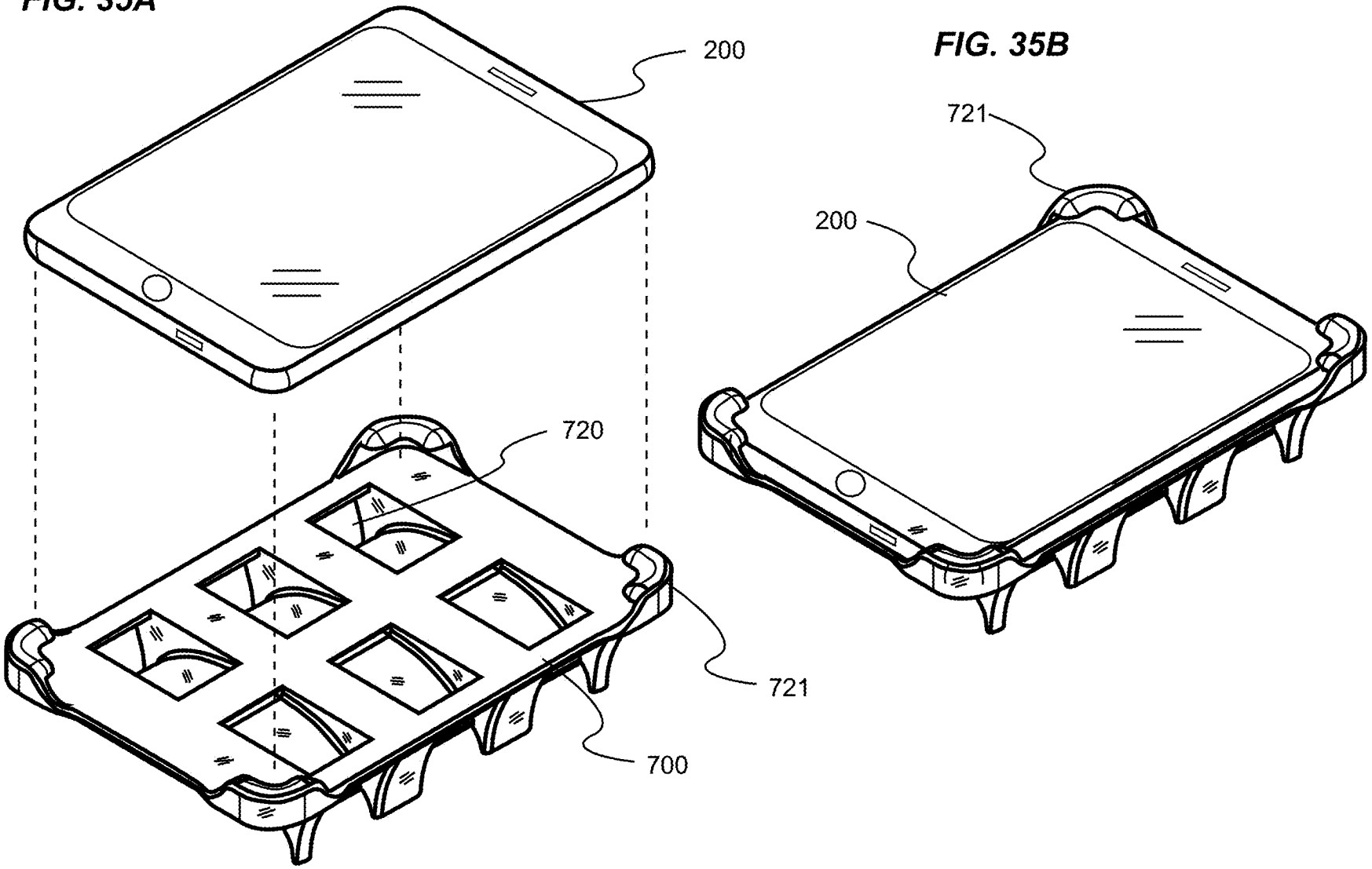
FIG. 35A is an exemplary illustration showing an exploded view of the assembly of an arm mounted remote control device and a structural frame of a holder in accordance with an example embodiment.
FIG. 35B is an exemplary illustration showing an arm mounted remote control device assembled into a structural frame of a holder in accordance with an example embodiment.

FIG. 35A is an exemplary illustration showing an exploded top perspective view of the assembly of a remote control device to a structural frame. A variation of a structural frame 700 is shown with a plurality corner clips 721 that help removably secure a remote control device into the structural frame, and a plurality of strap channels 720 through which a forearm and wrist strap will be positioned and secured. The corner clips are integral to, but project upwards from the top substantially flat surface of the structural frame, and are of such a size and position so as to allow user access to interact with device control features provided substantially around the perimeter of a remote control device. A remote control device 200 is shown prior to securing within the structural frame.

FIG. 35B is an exemplary illustration showing the remote control device 200 assembled into the structural frame 700 of FIG. 35A. Having been inserted into the structural frame 700, the remote control device 200 is shown being securely retained by the plurality of corner clips 721. Those skilled in the art will appreciate that the material used to construct the structural frame and corner clips may be of a flexural modulus providing for momentary deformation to allow insertion of the remote control device, and of sufficient memory so as to allow the corner clips to return to their natural position with a portion that extends over, and retains the corners of the remote control device.

Figure 36:
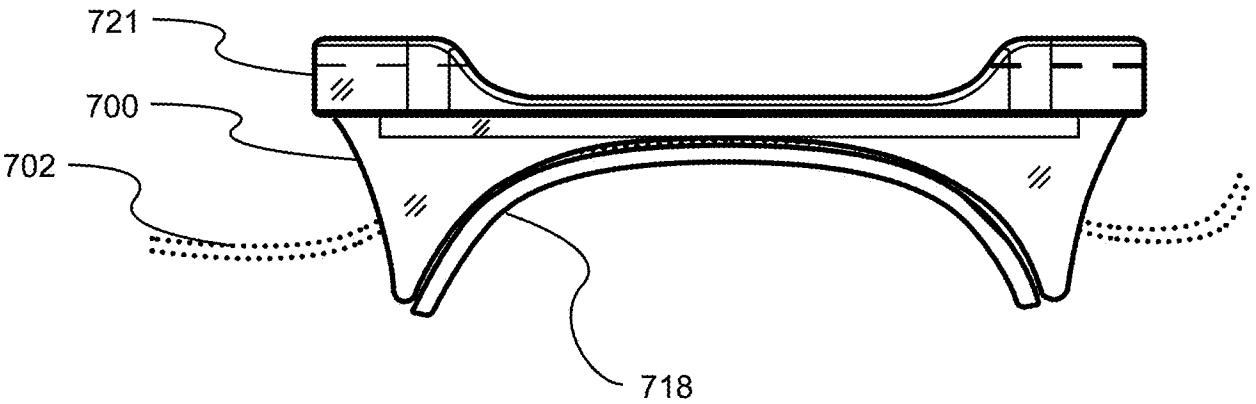
FIG. 36 is an exemplary illustration showing an end view of a holder for an arm mounted remote control device in accordance with an example embodiment.

FIG. 36 is an exemplary illustration showing an end view of an arm mounted device holder. A structural frame 700 is shown formed with a substantially concave central lower portion of the frame, the arc of the concave lower portion preferably approximating a portion of a typical circumference of a forearm of an exercise instructor or other user. As a means to help prevent slipping of the arm mounted device holder from slipping about the instructor's arm, a forearm pad 718 is affixed to the substantially concave surface area of the structural frame, the method of affixing the pad to the frames being one of the methods previously described for example.

A plurality of corner clips 721 as previously described is shown projecting upward from the structural frame a prescribed dimension so as to accommodate the typical thickness of a remote control device. Finally, as a means of securing the structural frame to the instructor's forearm and wrist, a wrist strap (not shown) and forearm strap 702 are secured to or threaded through strap channels 720 formed in the structural holder.

Figure 37:
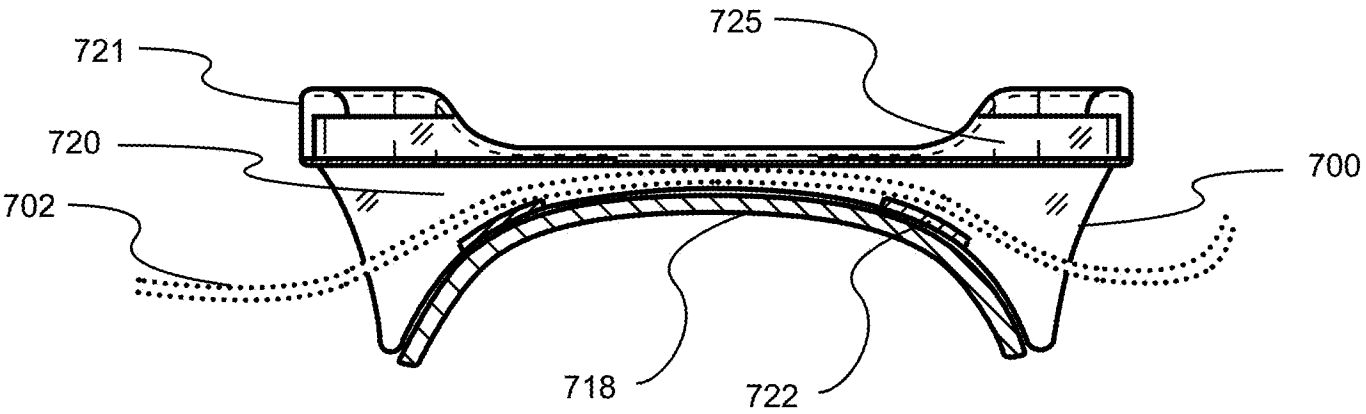
FIG. 37 is an exemplary illustration showing a first sectional view taken transversely through the holder for an arm mounted remote control device of FIG. 36 in accordance with an example embodiment.

FIG. 37 is an exemplary illustration showing a first transverse sectional view through the arm mounted device holder of FIG. 36. The structural frame is shown formed with a substantially concave central lower portion of the frame, the arc of the concave lower portion preferably approximating a portion of a typical circumference of a forearm, and a forearm pad 718 affixed to the surface area of the concave lower portion of the frame as previously described. A void is shown between an upper substantially flat wall of the frame and a lower substantially concave wall, the void serving as a strap channel 720 through which a wrist strap 702 is positioned during the product assembly process previously described. Preferably, retainer bars 722 traverse the strap channel between the relatively large castellated portions of the frame that form the lower arcuate surface, thereby providing additional surfaces against which the wrist strap will pull once mounted to an instructor's arm. A plurality of corner clips 721 are shown with the corner clip recess 725 shown, the vertical dimension of the recess opening being substantially the same as the thickness of the remote control device that would be mounted into the corner clips.

Figure 38:
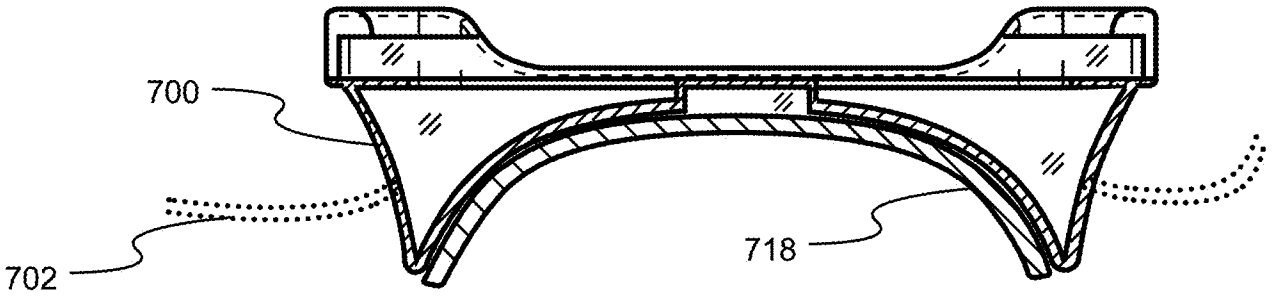
FIG. 38 is an exemplary illustration showing a second sectional view taken transversely through the holder for an arm mounted remote control device of FIG. 36 in accordance with an example embodiment.

FIG. 38 is an exemplary illustration showing a second transverse sectional view through the arm mounted device holder of FIG. 36. The structural frame 700 is shown with the lower arcuate surfaces of the castellated portions of the frame forming a substantially concave central lower portion, and a forearm pad 718 affixed to the surface area of the concave lower portion. Portions of the wrist strap 702 are threaded transversely through strap channels positioned between the castellated portions of the frame.

Figure 39:
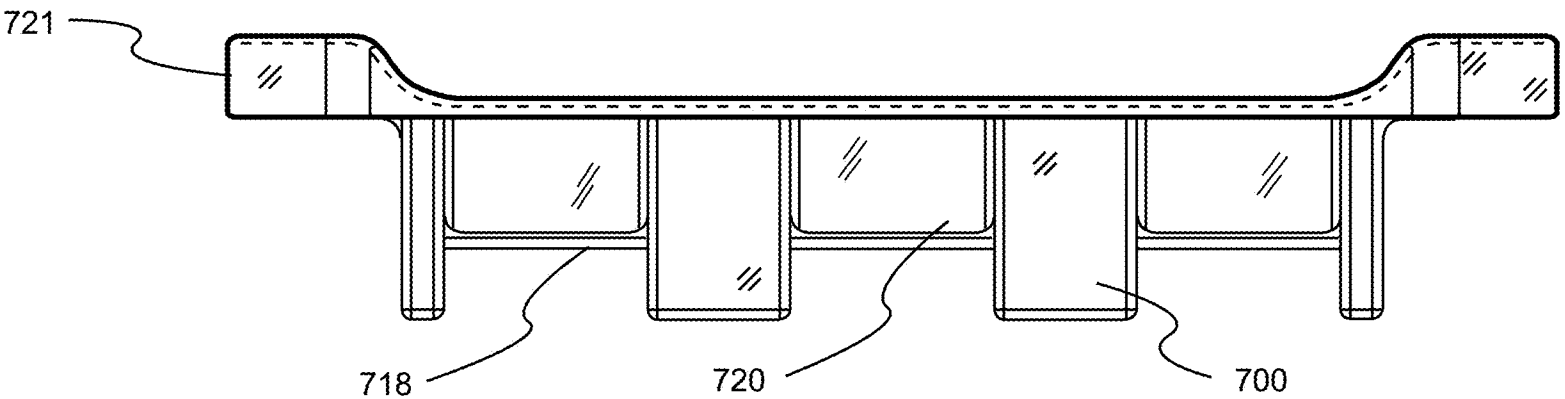
FIG. 39 is an exemplary illustration showing a side view of an arm mounted remote control device holder in accordance with an example embodiment.

FIG. 39 is an exemplary illustration showing a side view of the arm mounted device holder. The structural frame 700 is shown with a plurality of corner clips 721 projecting upwards from the upper substantially flat remote control device mounting surface, and downward projecting castellated portions that form the lower arcuate surface to which a forearm pad 718 is affixed. A plurality of strap channels 720 as previously described are positioned between the castellations of the structural frame.

Figure 40:
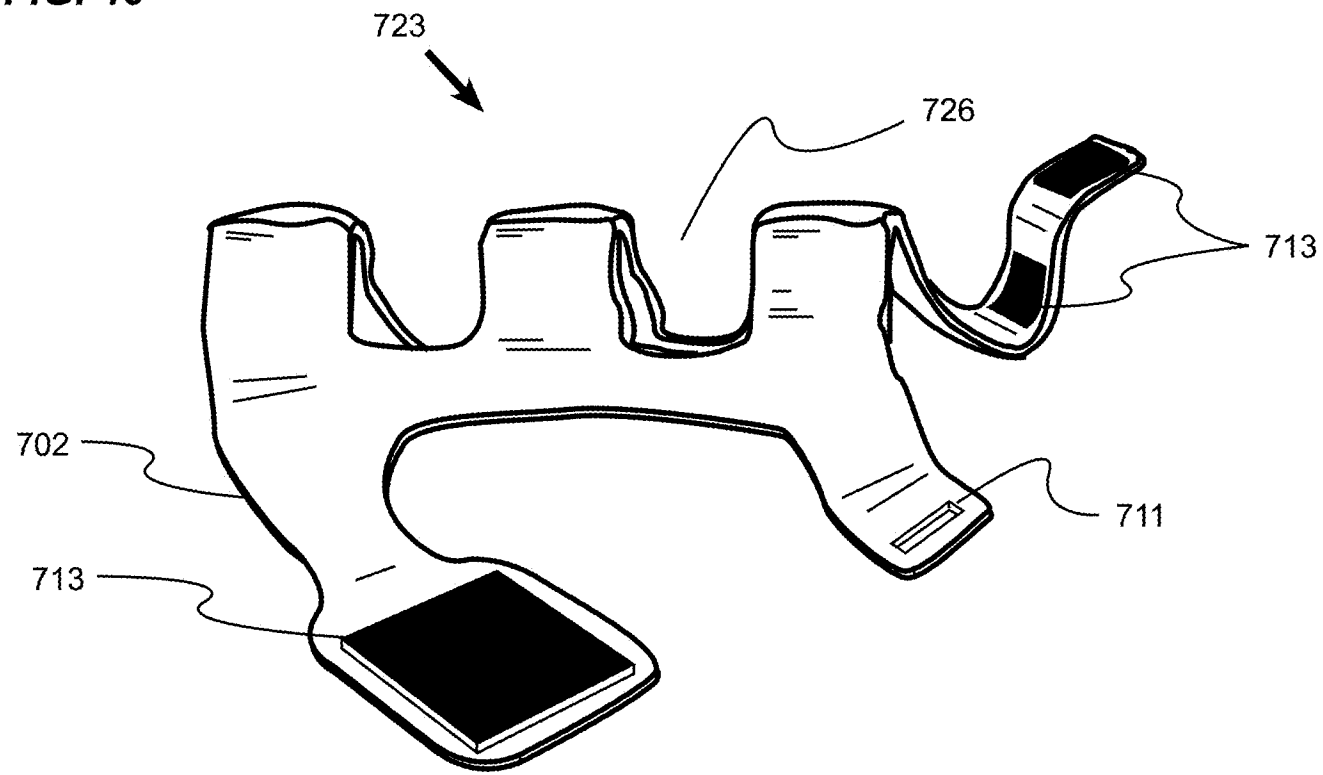
FIG. 40 is an exemplary illustration showing a second variation of a retainer strap assembly for a holder for an arm mounted remote control device in accordance with an example embodiment.

FIG. 40 is an exemplary illustration showing a second variation of a retainer strap assembly 723. In contrast to the previously described multiple strap assemblies shown in FIGS. 30-32, the instant strap is shown as a single fabricated wrist strap 702 comprising the resilient materials to which fastening materials 713 have been affixed, and with a buckle slot 711 through which the opposed narrow projecting forearm strap will be threaded and secured on the instructor's forearm. Further, strap mounting openings 726 are shown formed into the single piece assembly, the openings positioned to allow the strap to be laid around the castellations of the holder as previously described. One obvious advantage of the instant variation is the elimination of the plurality of spring clips and additional assembly time, both of which may result in a substantial cost reduction compared to the previously described variation.

Figure 41:
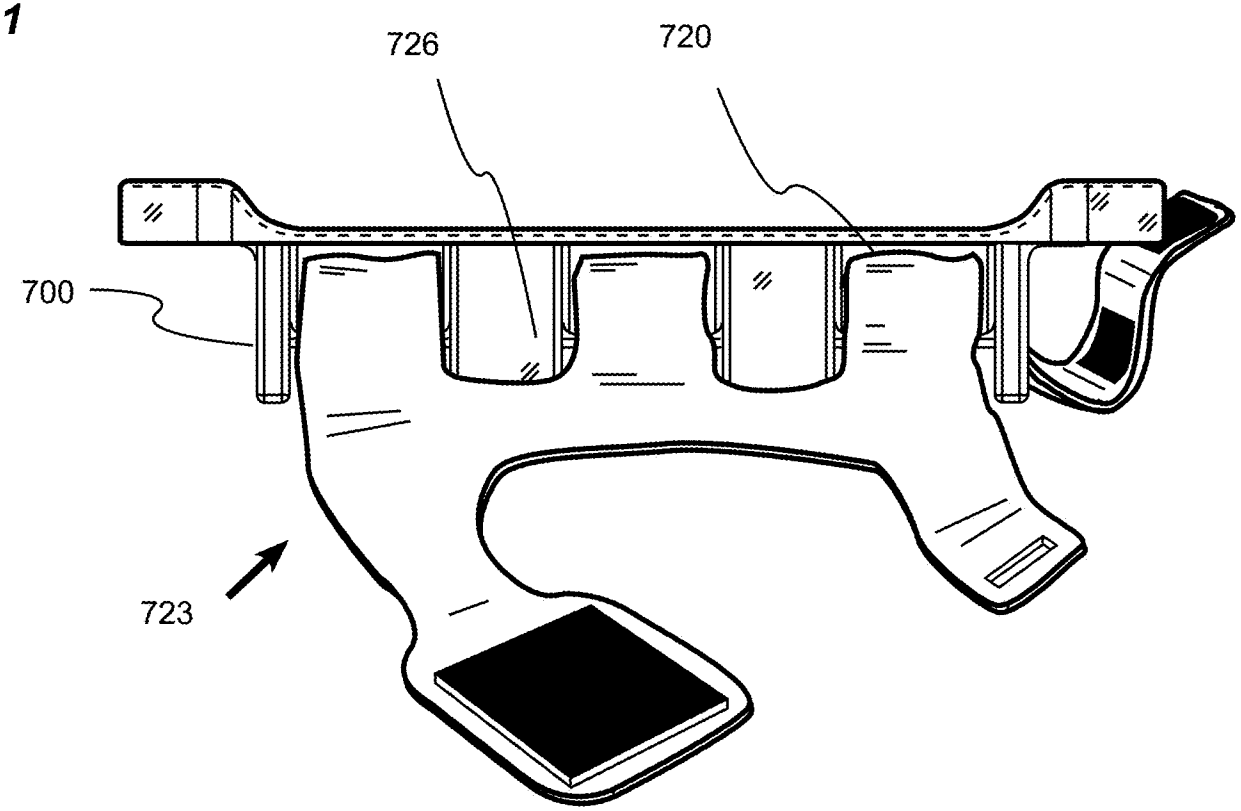
FIG. 41 is an exemplary illustration showing a second variation of a retainer strap assembly for an arm mounted remote control device affixed to a structural frame of a holder in accordance with an example embodiment.

FIG. 41 is an exemplary illustration showing the second variation of retainer strap assembly 723 removably affixed to a structural frame 700. The continuous portions of the strap adjacent to the strap mounting openings 726 are shown positioned within the plurality of strap channels 720, and the strap openings 726 being positioned around the castellated portions of the structural frame. As previously described, a forearm pad (not shown) may be mounted to the concave arcuate surface of the underside of the frame thereby retaining the strap in the position as just described.

Figure 42:
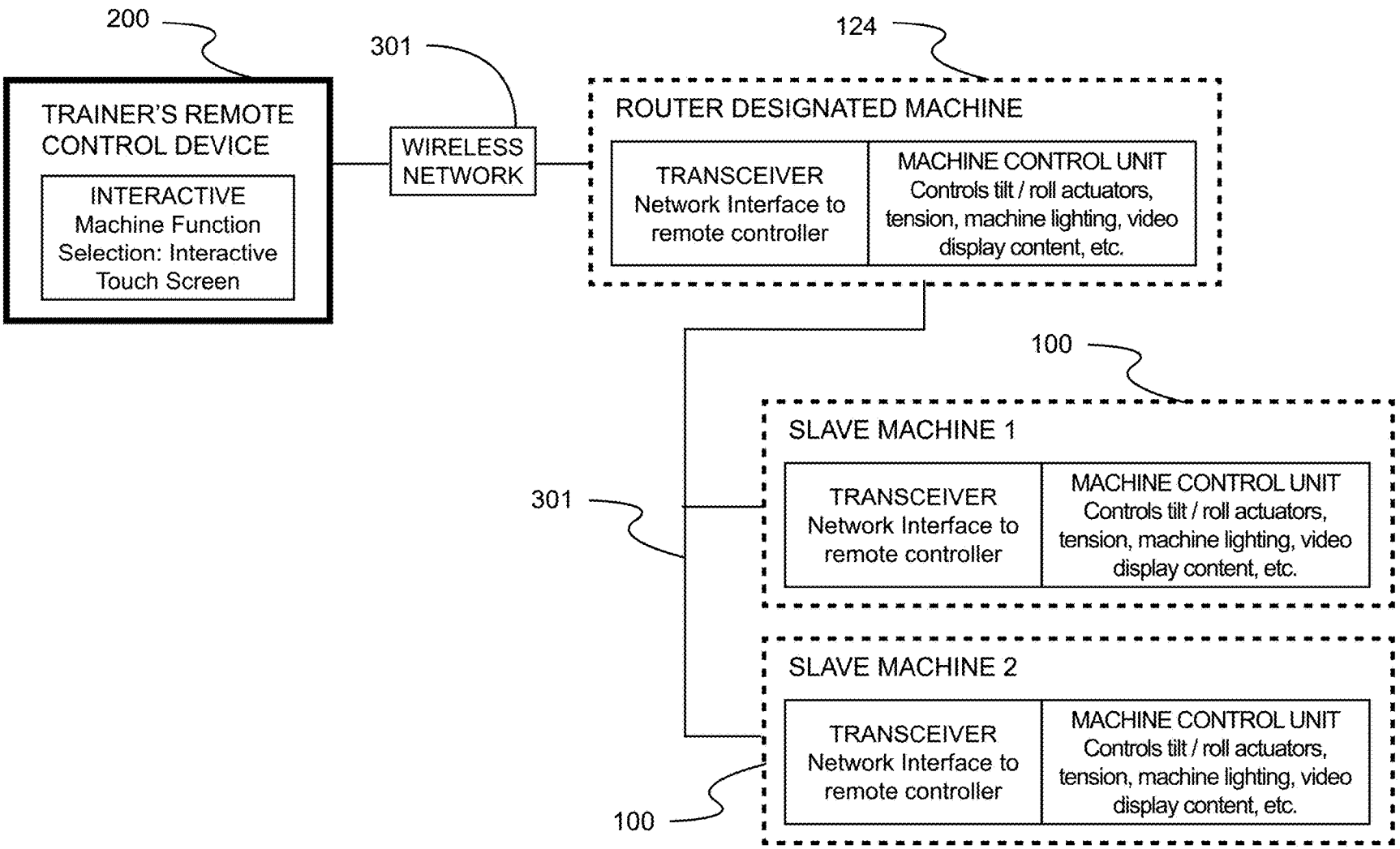
FIG. 42 is an exemplary illustration showing a block diagram of an arm mounted remote control device in communication with a router designated machine in accordance with an example embodiment.

FIG. 42 is an exemplary illustration showing a block diagram illustrating communication between an arm mounted remote control device 200 and a router designated machine 124. More specifically, one embodiment shown in the drawing provides for an arm mounted remote control device 200 in wireless communication over a wireless network 301 with a transceiver of one exercise machine designated as a router 124. Instructions sent by the trainer to the router designated machine may include tilt or roll angle, change in resistance levels, or other functions of the machine that may be activated by the trainer as identified in FIG. 42. Further, continuing on a wireless network 301, the router designated machine further routes the trainer's machine instructions to one or more additional exercise machines in the facility by communicating with the transceivers of the respective exercise machines 100. The routing of the communication sent by the trainer's remote control device therefore preferable causes the router designated machine, as well as any or all of the exercise machines to which the router designated machine is in communication, to all substantially simultaneously activate the instructions sent by the trainers remote control device.

Figure 43:
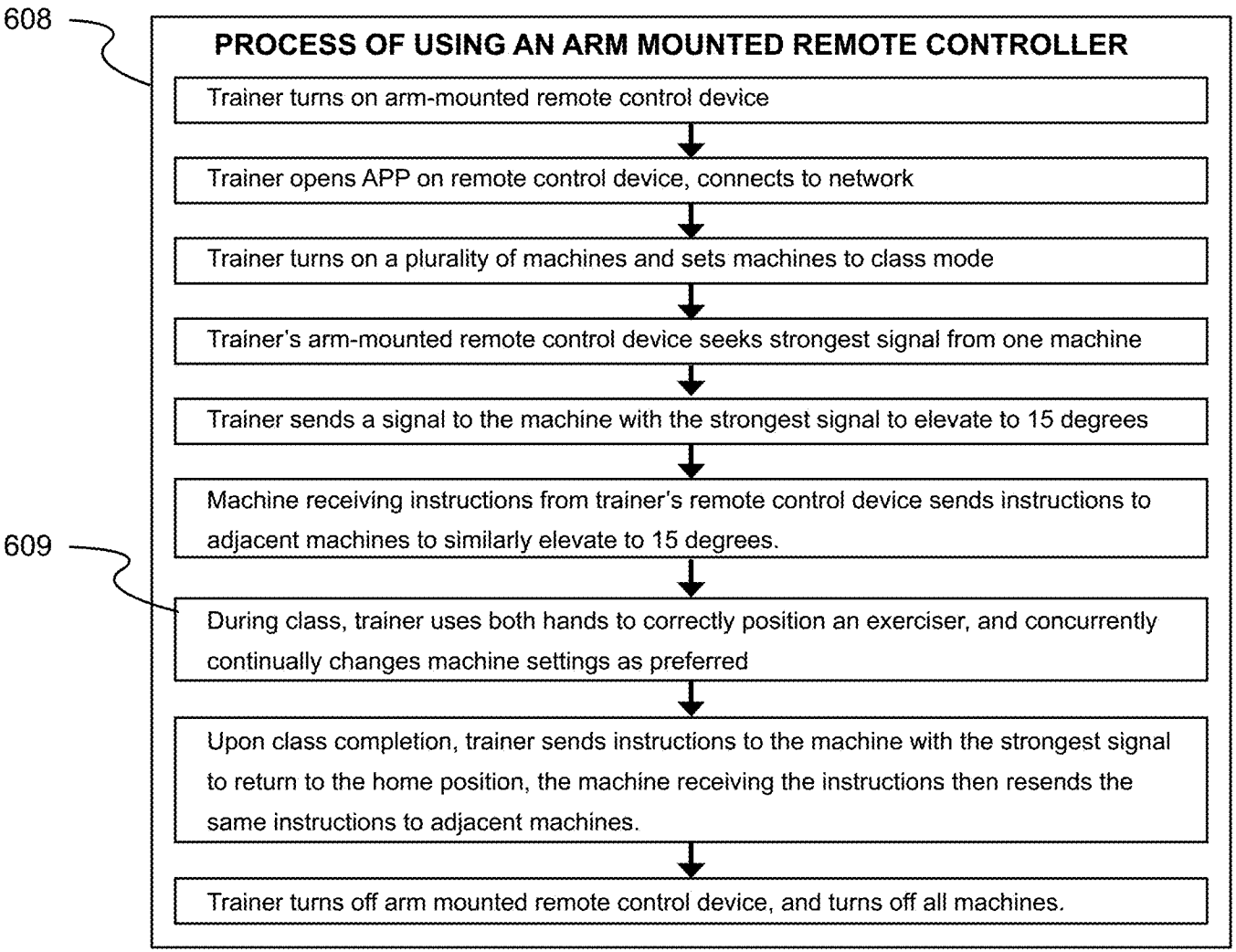
FIG. 43 is an exemplary illustration showing a flow chart of a trainer using an arm mounted remote control device in accordance with an example embodiment.

FIG. 43 is an exemplary illustration showing a flow chart of a preferred process 608 for a trainer or instructor using an arm mounted remote control device. It should be noted that every one of the many thousands of trainers instructing classes on performing one or more of hundreds of different exercises on the improved exercise machines will each implement a process unique to each trainer. Therefore, the steps of using an arm mounted remote control device as shown in the flow chart are not meant to be limiting, but merely represent one possible process. Nevertheless, one unique function of the various example embodiments described herein provides for a trainer to interface with an arm mounted remote control device throughout the exercise class in a manner that allows the trainer to use their hands while using arm mounted controller, as indicated in process step 609, for such functions as repositioning an exerciser's hands or feet properly on the machine, or for making manual adjustments to any given machine.

Figure 44B:
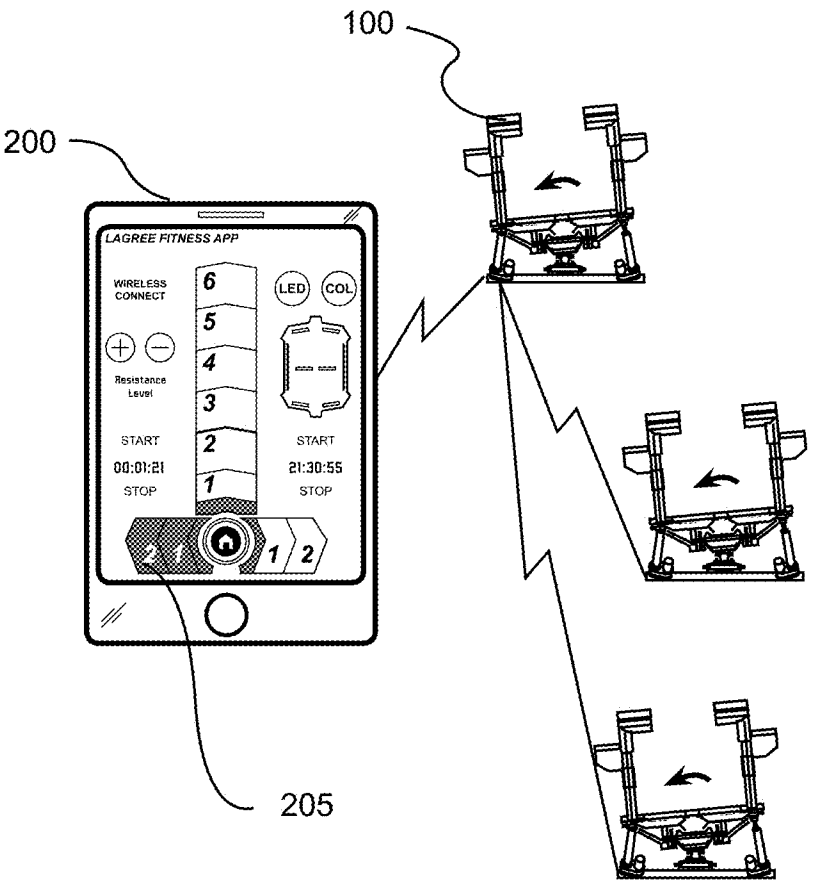
FIG. 44B is an exemplary illustration showing a display of an arm mounted remote control device adapted to control the counter-clockwise rotation of a plurality of exercise machines with a plurality of such machines rotated counter-clockwise in accordance with an example embodiment.
Figure 44A:
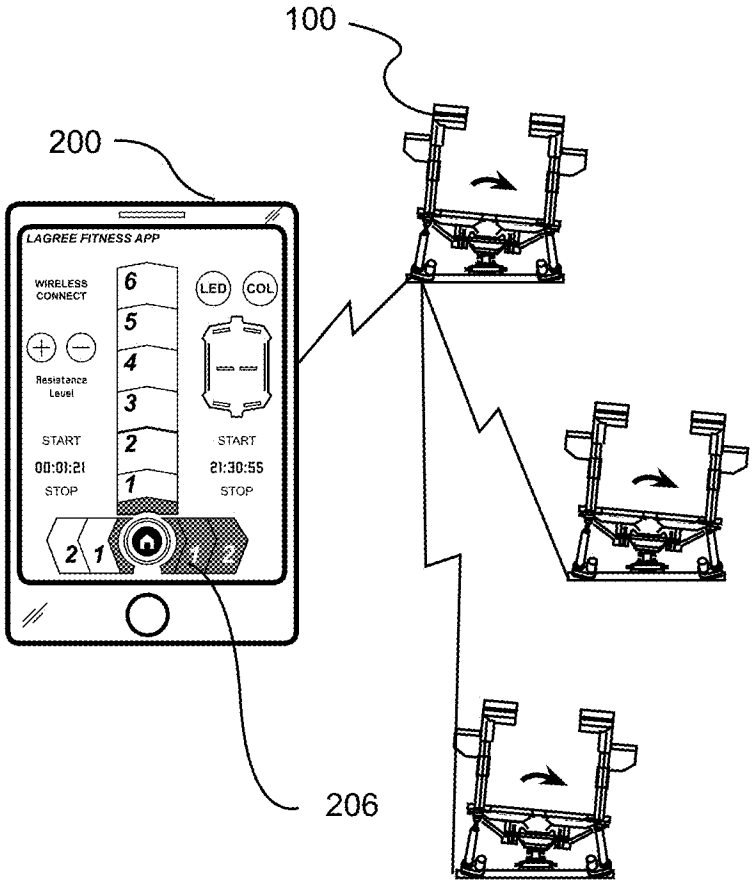
FIG. 44A is an exemplary illustration showing a display of an arm mounted remote control device adapted to control the clockwise rotation of a plurality of exercise machines together with a plurality of such machines rotated clockwise in accordance with an example embodiment.

FIG. 44A is an exemplary illustration showing a display of an arm mounted remote control device adapted for controlling clockwise rotation of a plurality of exercise machines. In the drawing, the remote control device 200 of an arm mounted device is in communication with one or more substantially similar exercise machines 100 in an exercise class in any of the ways previously described. When the trainer activates the right tilt adjustment 206 of the touch screen, each and all machines 100 in direct or indirect communication with the remote control device will simultaneously rotate clockwise about its longitudinal center axis to a preferred angle of tilt.

FIG. 44B is an exemplary illustration showing a display of an arm mounted remote control device adapted for controlling counter-clockwise rotation of a plurality of exercise machines. In the drawing, the remote control device 200 of an arm mounted device is in communication with one or more substantially similar exercise machines 100 in an exercise class in any of the ways previously described. When the trainer activates the left tilt adjustment 205 of the touch screen, each and all machines 100 in direct or indirect communication with the remote control device will simultaneously rotate counter-clockwise about its longitudinal center axis to a preferred angle of tilt.

Figure 45A:
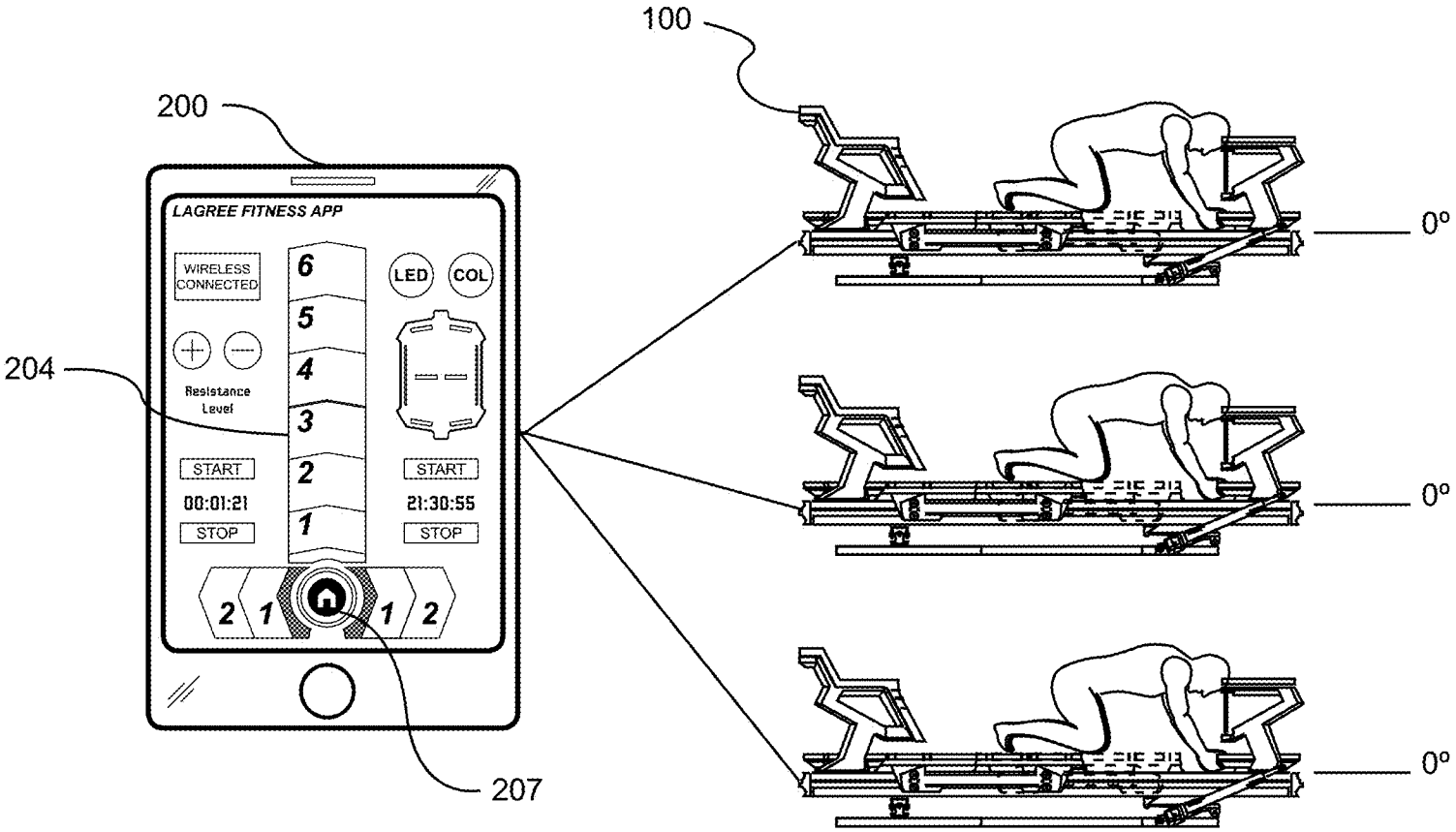
FIG. 45A is an exemplary illustration showing a display of an arm mounted remote control device adapted to control the incline of a plurality of exercise machines with a plurality of such machines illustrated in the same zero-incline, home position in accordance with an example embodiment.

FIG. 45A is an exemplary illustration showing a display of an arm mounted remote control device adapted for controlling the zero-incline, home position of a plurality of exercise machines. In the drawing, the remote control device 200 of an arm mounted device is in communication with one or more substantially similar exercise machines 100 in an exercise class in any of the ways previously described. When the trainer activates the home button 207 of the touch screen, each and all machines 100 in direct or indirect communication with the remote control device will simultaneously return the longitudinal axis and accompanying machine structure to a default starting position in which the longitudinal axis is positioned at substantially zero degrees relative to a horizontal plane.

Figure 45B:
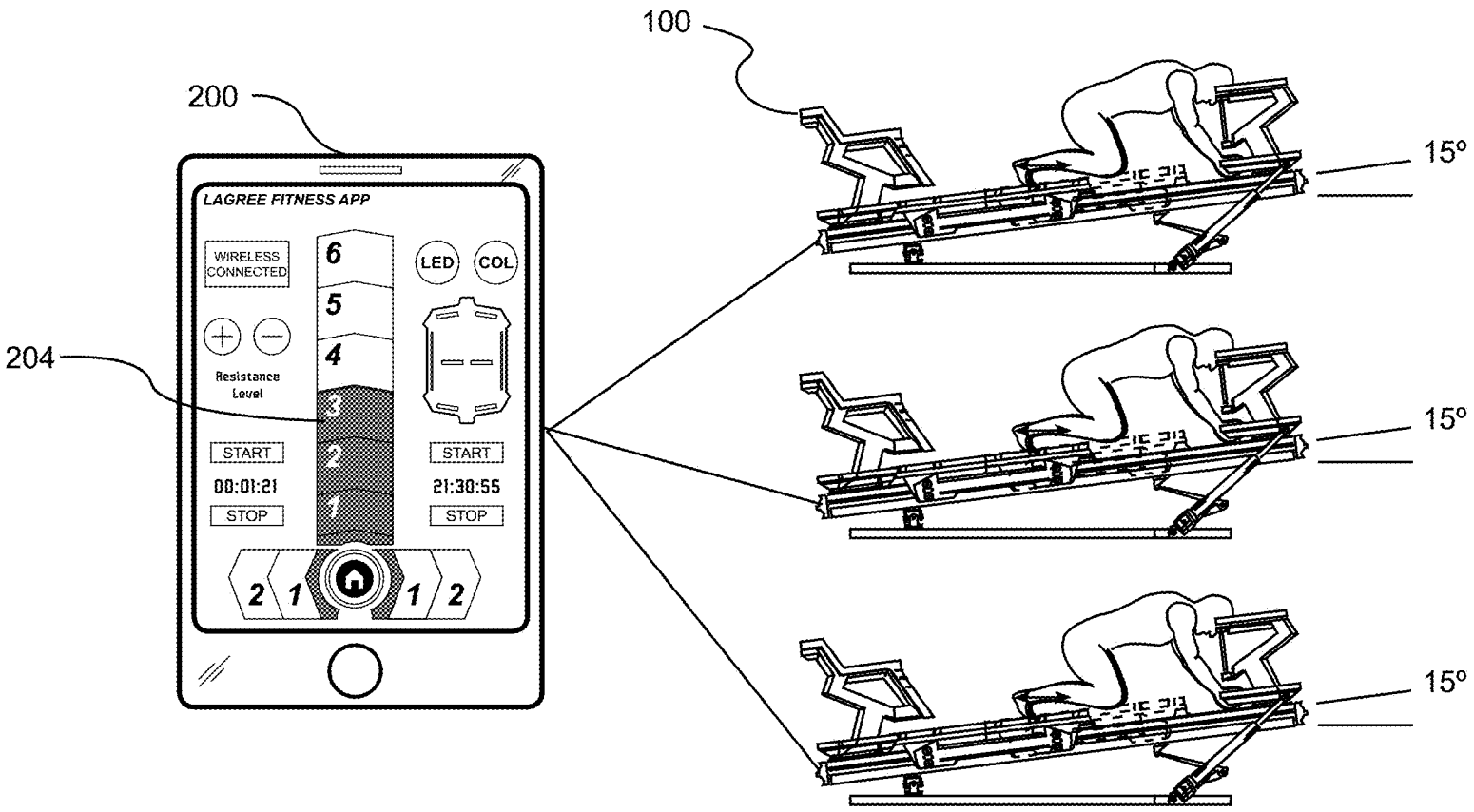
FIG. 45B is an exemplary illustration showing a display of an arm mounted remote control device adapted to control the incline of a plurality of exercise machines with a plurality of such machines illustrated in the same inclined position in accordance with an example embodiment.

FIG. 45B is an exemplary illustration showing a display of an arm mounted remote control device adapted for controlling the concurrent inclining of a plurality of exercise machines. In the drawing, the remote control device 200 of an arm mounted device is in communication with one or more substantially similar exercise machines 100 in an exercise class in any of the ways previously described. When the trainer activates the elevation adjuster 204 of the touch screen, each and all machines 100 in direct or indirect communication with the remote control device will simultaneously elevate one designated end of the longitudinal axis by an angle relative to a horizontal plane as determined by the software application program of the controller, for example fifteen degrees.

Figure 46:
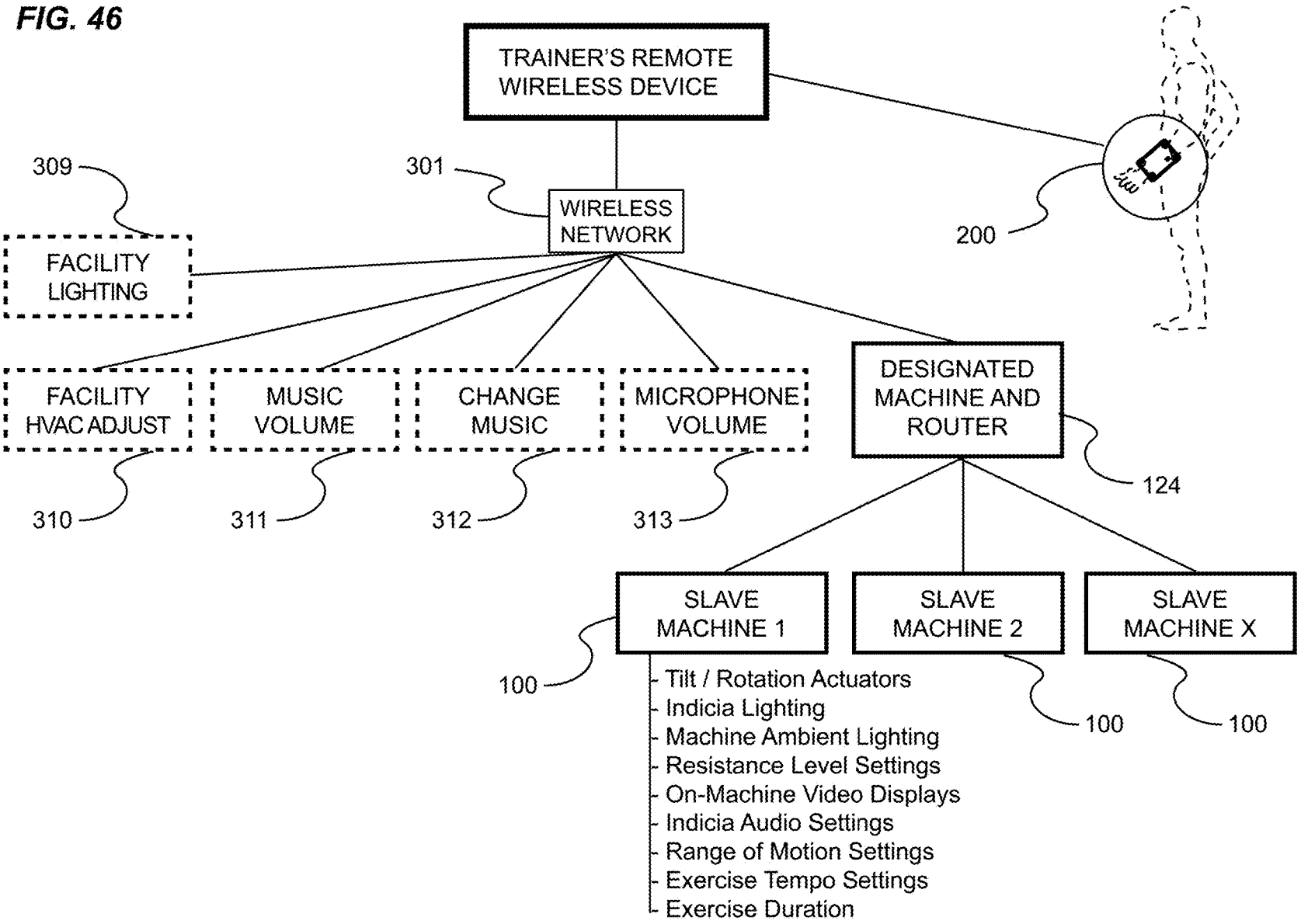
FIG. 46 is an exemplary illustration showing a block diagram of an arm mounted remote control device in communication with a plurality of exercise machines and non-exercise machine devices in accordance with an example embodiment.

FIG. 46 is an exemplary illustration showing a block diagram illustrating communication between an arm mounted remote control device and a plurality of exercise machines and non-exercise machine devices. In the drawing, the remote control device 200 of an arm mounted device is in communication with a plurality of devices over a wireless network 301. More specifically, the arm mounted remote control device is intended to provide for the trainer to conduct an exercise class in a hands free mode throughout an exercise class during which time the trainer may control all of the exercise machines 100 as previously described either directly, or indirectly through a designated machine and router 124, and may further control the total exercise environment within the exercise facility in which the machines are located.

For instance, the trainer may use the arm mounted remote control device in communication with various devices to control the facility lighting 309, change the thermostat of the facility HVAC 310, control the facility music volume 311, change the music source 312, and/or change the volume of the trainer microphone 313, any of which may be achieved by tapping on an appropriate area of the display screen of the remote control device while it is mounted to the arm of the trainer. In addition, the various machine functions controllable by the trainer using the arm mounted remote control device include, but are not limited to extending or retracting actuators that change the exercise plane of the exercise platforms of the machine, activating lighting on the machine as indicia that help exercisers interface with the proper component of the machine for each exercise, turning on or off the ambient lighting of the machine, or changing ambient lighting colors, increasing or decreasing the machine resistance settings, directing specific images or videos to display on the display screens on each machine, actuating audio indicia or visual indicia that instructs exercisers on the proper range of motion and/or exercise tempo, or setting the duration of any of the adjustable functions of the machines.

Although specific embodiments have been illustrated and described herein, it will be appreciated by those of ordinary skill in the art that a wide variety of alternate and/or equivalent implementations may be substituted for the specific embodiments shown and described without departing from the scope of the present disclosure. The claims of this application are therefore intended to define the scope of coverage of the application, including any adaptations or variations of the embodiments whether or not specifically discussed herein.

The data structures and code described in this detailed description are typically stored on a computer readable storage medium, which may be any device or medium that can store code and/or data for use by a computer system. This includes, but is not limited to, magnetic and optical storage devices such as disk drives, magnetic tape, CDs (compact discs), DVDs (digital video discs), and computer instruction signals embodied in a transmission medium (with or without a carrier wave upon which the signals are modulated). For example, the transmission medium may include a telecommunications network, such as the Internet.

At least one embodiment of the system and method for networking fitness machines is described above with reference to block and flow diagrams of systems, methods, apparatuses, and/or computer program products according to example embodiments of the invention. It will be understood that one or more blocks of the block diagrams and flow diagrams, and combinations of blocks in the block diagrams and flow diagrams, respectively, can be implemented by computer-executable program instructions. Likewise, some blocks of the block diagrams and flow diagrams may not necessarily need to be performed in the order presented, or may not necessarily need to be performed at all, according to some embodiments of the invention. These computer-executable program instructions may be loaded onto a general-purpose computer, a special-purpose computer, a processor, or other programmable data processing apparatus to produce a particular machine, such that the instructions that execute on the computer, processor, or other programmable data processing apparatus create means for implementing one or more functions specified in the flow diagram block or blocks. These computer program instructions may also be stored in a computer-readable memory that can direct a computer or other programmable data processing apparatus to function in a particular manner, such that the instructions stored in the computer-readable memory produce an article of manufacture including instruction means that implement one or more functions specified in the flow diagram block or blocks. As an example, embodiments of the invention may provide for a computer program product, comprising a computer usable medium having a computer-readable program code or program instructions embodied therein, the computer-readable program code adapted to be executed to implement one or more functions specified in the flow diagram block or blocks. The computer program instructions may also be loaded onto a computer or other programmable data processing apparatus to cause a series of operational elements or steps to be performed on the computer or other programmable apparatus to produce a computer-implemented process such that the instructions that execute on the computer or other programmable apparatus provide elements or steps for implementing the functions specified in the flow diagram block or blocks. Accordingly, blocks of the block diagrams and flow diagrams support combinations of means for performing the specified functions, combinations of elements or steps for performing the specified functions, and program instruction means for performing the specified functions. It will also be understood that each block of the block diagrams and flow diagrams, and combinations of blocks in the block diagrams and flow diagrams, can be implemented by special-purpose, hardware-based computer systems that perform the specified functions, elements or steps, or combinations of special-purpose hardware and computer instructions.

The present invention may be embodied in other specific forms without departing from the spirit or essential attributes thereof, and it is therefore desired that the present embodiment be considered in all respects as illustrative and not restrictive. Many modifications and other embodiments of the system and method for networking fitness machines will come to mind to one skilled in the art to which this invention pertains and having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although methods and materials similar to or equivalent to those described herein can be used in the practice or testing of the system and method for networking fitness machines, suitable methods and materials are described above. Thus, the system and method for networking fitness machines is not intended to be limited to the embodiments shown, but is to be accorded the widest scope consistent with the principles and features disclosed herein.

Unless otherwise defined, all technical and scientific terms used herein have the same meaning as commonly understood by one of ordinary skill in the art to which this invention belongs. Although methods and materials similar to or equivalent to those described herein can be used in the practice or testing of the system and method for networking fitness machines, suitable methods and materials are described above. All publications, patent applications, patents, and other references mentioned herein are incorporated by reference in their entirety to the extent allowed by applicable law and regulations. The system and method for networking fitness machines may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. A system for networking a plurality of exercise machines comprising:

a remote control comprising:

a display adapted to simultaneously display a plurality of exercise machine settings and corresponding setting values;

an input adapted to select a displayed setting and corresponding setting value; and a circuit responsive to the input to wirelessly transmit a data signal comprising the selected setting and corresponding setting value;

a plurality of exercise machines, wherein each exercise machine of the plurality of exercise machines comprises:

a plurality of machine settings, wherein each of the plurality of machine settings corresponds with one of the plurality of exercise machine settings selectable via the input of the remote control; and an actuator that is operative to control the plurality of machine settings and is responsive to the exercise machine wirelessly receiving from the remote control a data signal comprising a selected setting corresponding to the machine setting controlled by the actuator and a corresponding setting value to change the machine setting according to the setting value; and a wireless communication network operative to wirelessly receive data signals transmitted from the remote control and to wirelessly communicate the data signals to the plurality of exercise machines;

whereby selection of a displayed setting and corresponding setting value on the remote control causes all exercise machines of the plurality of exercise machines to change the selected setting according to the corresponding setting value substantially in common;

wherein the wireless communication network comprises a wireless router adapted for wireless communication with the remote control, wherein the wireless router is combined with a designated exercise machine of the plurality of exercise machines, and wherein the designated exercise machine and router are adapted to communicate data signals received wirelessly from the remote control to the other exercise machines of the plurality of exercise machines.

2. The system of claim 1, wherein the display and input of the remote control comprise a touch screen.

3. The system of claim 1, wherein the plurality of exercise machine settings displayed on the remote control comprise one or more of resistance, incline, rotation, home position, and on/off state of a plurality of indicia lights.

4. The system of claim 1, wherein each exercise machine of the plurality of exercise machines comprises a moveable carriage.

5. The system of claim 4, wherein each moveable carriage comprises a plurality of indicia lights, with each indicia light of the plurality being located on the carriage to indicate a position for placement of a body part during an exercise; and the remote control is operative to display a representation corresponding to a carriage, wherein the representation comprises a plurality of selectable zones, and wherein each selectable zone of the plurality corresponds to an indicia light of the plurality of indicia lights on the carriage of each exercise machine.

6. A method for networking a plurality of exercise machines comprising:

using a remote control to wirelessly transmit data signals over a wireless communication network to control a plurality of exercise machines substantially in common;

wherein the remote control comprises:

a display adapted to simultaneously display a plurality of exercise machine settings and a plurality of corresponding setting values;

an input adapted to select the plurality of exercise machine settings and the plurality of corresponding setting values; and a circuit responsive to the input to wirelessly transmit a data signal comprising a selected setting and a corresponding setting value;

wherein each of the plurality of exercise machines comprises a plurality of machine settings corresponding to the plurality of exercise machine settings selectable via the input of the remote control, and wherein the plurality of machine settings of each machine of the plurality of exercise machines is in common with machine settings of each of the other machines of the plurality of exercise machines;

wherein the data signals are adapted to cause each of the plurality of exercise machines to change the same machine setting corresponding to a selected machine setting selected from the plurality of exercise machine settings via the input of the remote control according to a selecting setting value selected from the plurality of corresponding setting values via the input of the remote control substantially in unison; and wherein using the remote control comprises using the input to select one of the plurality of exercise machine settings and one of the plurality of corresponding setting values.

7. The method of claim 6, wherein the plurality of exercise machine settings comprise one or more of resistance, incline, rotation, home position, and on/off state of a plurality of indicia lights.

8. The method of claim 6, wherein each of the plurality of exercise machines comprises a moveable carriage.

9. The method of claim 8, wherein each moveable carriage comprises a plurality of indicia lights with each indicia light of the plurality being located on the carriage to indicate a position for placement of a body part during an exercise.

10. The method of claim 9, wherein the display of the remote control is adapted to display a representation corresponding to a carriage, wherein the representation comprises a plurality of selectable zones, and wherein each selectable zone of the plurality corresponds to an indicia light of the plurality of indicia lights on the carriage of each of the plurality of exercise machines.

11. The method of claim 10, comprising using the input to select one or more of the selectable zones.

12. The method of claim 11, wherein:

the display of the remote control is adapted to display a selectable first virtual button corresponding to an on/off state of all indicia lights of the plurality of indicia lights; and using the remote control to control the plurality of exercise machines comprises using the input to select the first virtual button to selectively turn on and turn off all of the indicia lights.

13. The method of claim 12, wherein:

the display of the remote control is adapted to display a selectable second virtual button corresponding to a color selection of the plurality of indicia lights; and using the remote control to control the plurality of exercise machines comprises using the input to select the second virtual button to selectively change the color of all of the indicia lights.

14. A system for networking a plurality of exercise machines comprising:

a remote control comprising:

a display adapted to simultaneously display a plurality of exercise machine settings and a plurality of corresponding setting values;

an input adapted to select the plurality of exercise machine settings and the plurality of corresponding setting values; and a circuit responsive to the input to wirelessly transmit a data signal comprising a selected setting and a corresponding setting value;

a plurality of exercise machines, wherein each of the plurality of exercise machines comprises:

a plurality of machine settings corresponding to the plurality of exercise machine settings selectable via the input of the remote control; and an actuator that is operative to control the plurality of machine settings and is responsive to the exercise machine wirelessly receiving from the remote control a data signal comprising a selected setting corresponding to the machine setting controlled by the actuator and a corresponding setting value to change the machine setting according to the setting value; and a wireless communication network operative to wirelessly receive data signals transmitted from the remote control and to wirelessly communicate the data signals to the plurality of exercise machines;

whereby selection of one of the plurality of exercise machine settings and one of the plurality of corresponding setting values on the remote control causes all of the plurality of exercise machines to change the selected setting according to the corresponding setting value substantially in common;

wherein the plurality of exercise machine settings displayed on the remote control comprise the on/off state of each indicia light of a plurality of indicia lights on each of the plurality of exercise machines.

15. The system of claim 14, wherein each exercise machine of the plurality of exercise machines comprises a moveable carriage.

16. The system of claim 15, wherein the plurality of indicia lights are located on the carriage.

17. The system of claim 16, wherein the plurality of indicia lights each indicate a position for placement of a body part during an exercise.

18. The system of claim 17, wherein the remote control is operative to display a representation corresponding to a carriage, wherein the representation comprises a plurality of selectable zones, and wherein each of the plurality of selectable zones corresponds to one of the plurality of indicia lights on the carriage.

19. The system of claim 18, wherein the remote control is operative to display a selectable first virtual button corresponding to an on/off state of each of the plurality of indicia lights, and in response to selection of the first virtual button to wirelessly transmit a data signal to selectively turn on and turn off each of the indicia lights.

20. The system of claim 19, wherein the remote control is operative to display a selectable second virtual button corresponding to a color selection of the plurality of indicia lights, and in response to selection of the second virtual button to wirelessly transmit a data signal to selectively change the color of each of the plurality of indicia lights.

* * * * *